US012396515B2

(12) United States Patent
Fujita et al.

(10) Patent No.: US 12,396,515 B2
(45) Date of Patent: Aug. 26, 2025

(54) SHOE SOLE AND SHOE

(71) Applicant: ASICS CORPORATION, Kobe (JP)

(72) Inventors: Hisanori Fujita, Kobe (JP); Kenta Tateno, Kobe (JP); Yoshihiro Eguchi, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 17/455,008

(22) Filed: Nov. 15, 2021

(65) Prior Publication Data

US 2022/0151337 A1 May 19, 2022

(30) Foreign Application Priority Data

Nov. 16, 2020 (JP) ..... 2020-190364

(51) Int. Cl.
*A43B 13/14* (2006.01)

(52) U.S. Cl.
CPC ..... *A43B 13/14* (2013.01)

(58) Field of Classification Search
CPC ..... A43B 13/14; A43B 13/026; A43B 13/127; A43B 13/187; A43B 13/183; A43B 13/12; A43B 23/0245; A43B 23/26
See application file for complete search history.

(56) References Cited

U.S. PATENT DOCUMENTS 4,890,397 A * 1/1990 Harada ..... A43B 13/187 36/114
6,151,803 A * 11/2000 Charles ..... A43B 13/141 36/85
7,886,461 B2 * 2/2011 Sato ..... A43B 13/183 36/27
8,567,093 B2 * 10/2013 Sato ..... A43B 13/12 36/27
9,572,398 B2 * 2/2017 Hurd ..... A43B 13/125
9,820,529 B2 * 11/2017 Droege ..... A43B 13/12
9,936,765 B2 * 4/2018 Sato ..... A43B 13/186
10,010,137 B2 * 7/2018 Foxen ..... A43B 13/42
10,299,535 B2 * 5/2019 Hurd ..... A43B 13/185
(Continued)

FOREIGN PATENT DOCUMENTS

JP 2014210035 A 11/2014

OTHER PUBLICATIONS

JP Office Action for JP Application No. 2020-190364, drafting date Oct. 21, 2024, mailing date Oct. 29, 2024, 6 pages (including English language translation).

*Primary Examiner* — Bao-Thieu L Nguyen
(74) *Attorney, Agent, or Firm* — KONRAD, RAYNES, DAVDA & VICTOR LLP; Alan S. Raynes

(57) ABSTRACT

A shoe sole includes: a sole body located to extend continuously from a forefoot portion to a rearfoot portion; and a highly rigid member fixed to the sole body, the highly rigid member being formed of a material that is higher in rigidity than a material forming the sole body. The highly rigid member includes a curved plate portion extending in a direction crossing a right-left direction corresponding to a foot width direction of a foot of a wearer. The curved plate portion has an inverted arch shaped portion that protrudes toward a ground contact surface of the shoe sole in a cross section taken along a line orthogonal to a direction in which the curved plate portion extends. At least a part of the curved plate portion is disposed in the forefoot portion.

19 Claims, 31 Drawing Sheets

(56) References Cited

U.S. PATENT DOCUMENTS

| | | | | |
|---|---|---|---|---|
| 10,765,172 | B2 * | 9/2020 | Foxen | A43B 13/14 |
| 11,006,695 | B2 * | 5/2021 | Chambers | A43B 3/0036 |
| 11,089,834 | B2 * | 8/2021 | Chambers | A43B 13/127 |
| 11,559,104 | B2 * | 1/2023 | Chambers | A43B 13/08 |
| 2008/0052965 | A1 * | 3/2008 | Sato | A43B 13/026 36/103 |
| 2011/0113656 | A1 * | 5/2011 | Sato | A43B 7/1445 36/30 R |
| 2014/0115925 | A1 * | 5/2014 | Hurd | A43B 13/125 156/182 |
| 2015/0107132 | A1 * | 4/2015 | Takeshita | A43B 13/18 36/28 |
| 2016/0029741 | A1 * | 2/2016 | Foxen | A43B 13/188 36/103 |
| 2017/0035143 | A1 * | 2/2017 | Sato | A43B 7/148 |
| 2017/0095034 | A1 | 4/2017 | Dupre et al. | |
| 2017/0105480 | A1 * | 4/2017 | Hurd | A43B 13/145 |
| 2018/0092431 | A1 * | 4/2018 | Luchi | A43B 13/026 |
| 2018/0271215 | A1 * | 9/2018 | Foxen | A43B 13/125 |
| 2018/0338568 | A1 * | 11/2018 | Chambers | A43B 13/141 |
| 2019/0365030 | A1 * | 12/2019 | Chambers | A43B 13/188 |
| 2019/0365033 | A1 * | 12/2019 | Chambers | A43B 3/0057 |
| 2020/0100565 | A1 * | 4/2020 | Yoshida | A43B 13/026 |
| 2020/0390191 | A1 * | 12/2020 | Foxen | A43B 13/187 |
| 2021/0227928 | A1 * | 7/2021 | Chambers | A43B 13/146 |
| 2021/0337925 | A1 * | 11/2021 | Chambers | A43B 13/183 |
| 2022/0053879 | A1 * | 2/2022 | Redon | A43B 13/16 |
| 2022/0378145 | A1 * | 12/2022 | Tateno | A43B 13/026 |
| 2023/0104731 | A1 * | 4/2023 | Mitsuhata | A43B 13/127 36/25 R |

* cited by examiner

SHOE SOLE AND SHOE

This nonprovisional application is based on Japanese Patent Application No. 2020-190364 filed on Nov. 16, 2020 with the Japan Patent Office, the entire contents of which are hereby incorporated by reference.

BACKGROUND OF THE INVENTION

Field of the Invention

The present invention relates to a shoe sole having a sole body to which a highly rigid member formed of a material higher in rigidity than a material of the sole body is fixed, and a shoe including the shoe sole.

Description of the Background Art

For example, U.S. Patent Application Publication No. 2017/0095034 discloses a shoe provided with a highly rigid plate, in addition to a midsole, disposed between an upper and an outsole. According to the shoe provided with a highly rigid plate in this way, the highly rigid plate is elastically deformed when a wearer's foot kicks the ground, and this elastic deformation produces repulsive force to thereby produce propulsive force.

In this case, in the shoe disclosed in the above-mentioned publication, a portion of the highly rigid plate that extends from a forefoot portion to a midfoot portion of the sole of the shoe is curved toward a ground contact surface so as to have a prescribed curvature in the front-rear direction corresponding to a foot length direction of a foot of a wearer. By such a configuration, the repulsive force of the highly rigid plate obtained when kicking the ground is increased, and accordingly, the propulsive force is also increased.

SUMMARY OF THE INVENTION

As described above, in the shoe provided with a highly rigid plate, the highly rigid plate is formed of an elastically deformable material so as to achieve high repulsive force. However, the shoe having such a highly rigid plate without any configuration refinement leads to a lack of stability at foot landing. Specifically, the stability at foot landing is impaired when the highly rigid plate is significantly deformed, for example, depending on the condition of the landing surface at foot landing.

In this way, the shoe provided with a highly rigid plate having a conventionally known configuration exhibits what is called a trade-off relation between the improvement in propulsive force produced when the wearer's foot kicks or takes off the ground (hereinafter also simply referred to as "at the time of kicking the ground") and the improvement in stability at foot landing. Thus, it is difficult to achieve both the improvements.

Accordingly, the present invention has been made in order to solve the above-described problems, and an object of the present invention is to provide a shoe sole having a novel configuration that is improved both in propulsive force at the time of kicking the ground and in stability at foot landing, and a shoe including the shoe sole.

A shoe sole according to the present invention may include: a forefoot portion that supports a toe portion and a ball portion of a foot of a wearer; a midfoot portion that supports an arch portion of the foot; and a rearfoot portion that supports a heel portion of the foot, in which the forefoot portion, the midfoot portion, and the rearfoot portion are connected in a front-rear direction corresponding to a foot length direction of the foot of the wearer. The shoe sole includes: a sole body located to extend continuously from the forefoot portion to the rearfoot portion; and a highly rigid member fixed to the sole body, the highly rigid member being formed of a material that is higher in rigidity than a material forming the sole body. The highly rigid member includes a curved plate portion extending in a direction crossing a right-left direction that corresponds to a foot width direction of the foot of the wearer. The curved plate portion has an inverted arch shaped portion that protrudes toward a ground contact surface of the shoe sole in a cross section taken along a line orthogonal to a direction in which the curved plate portion extends. At least a part of the curved plate portion is disposed in the forefoot portion.

A shoe according to the present invention may include: the shoe sole according to the above description and an upper provided above the shoe sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
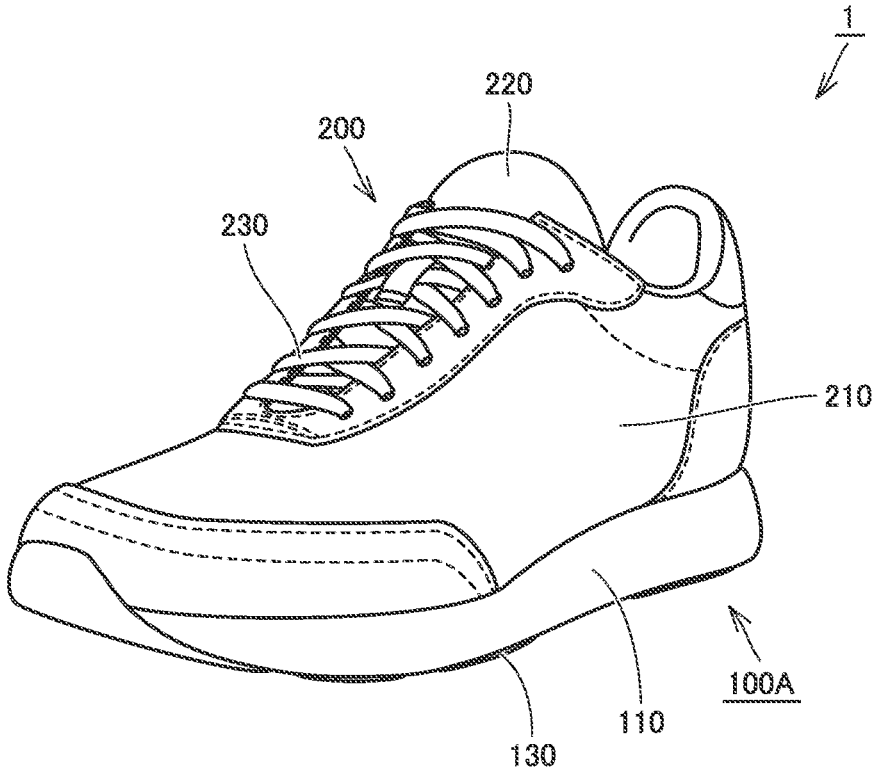
FIG. 1 is a schematic perspective view of a shoe sole and a shoe including the shoe sole, according to a first embodiment.

In the following, embodiments of the present invention will be described in detail with reference to the accompanying drawings. In the embodiments described below, the same or corresponding components are denoted by the same reference characters, and the description thereof will not be repeated.

First Embodiment

FIG. 1 is a schematic perspective view of a shoe sole and a shoe including the shoe sole, according to a first embodiment. Referring to FIG. 1, schematic configurations of a shoe 1 and a shoe sole 100A according to the present embodiment will be described below.

As shown in FIG. 1, the shoe 1 includes a shoe sole 100A and an upper 200. The shoe sole 100A is a member covering a sole of a foot and having a substantially flat shape. The upper 200 has a bag-like shape enclosing the entire foot inserted into a shoe and is positioned above the shoe sole 100A.

The upper 200 includes an upper body 210, a shoe tongue 220, and a shoelace 230. The upper body 210 has a bag-like shape as described above. Both the shoe tongue 220 and the shoelace 230 are fixed or attached to the upper body 210.

The upper body 210 has: a lower portion having a bottom portion to be fixed to the shoe sole 100A; and an upper portion provided with an opening through which an upper part of an ankle and a part of the top of the foot are exposed. The shoe tongue 220 is fixed to the upper body 210 by sewing, welding, bonding, or a combination thereof so as to cover a portion of the opening provided in the upper body 210 through which a part of the top of a foot is exposed. For the upper body 210 and the shoe tongue 220, for example, woven fabric, knitted fabric, synthetic leather, resin, or the like may be used. For a shoe particularly required to be air permeable and lightweight, a double raschel warp knitted fabric with a polyester yarn knitted therein may be used.

The shoelace 230 is formed of a member in the form of a string for pulling together, in the foot width direction, portions of a peripheral edge of the opening that is provided in the upper body 210 and exposes a part of the top of a foot. The shoelace 230 is passed through a plurality of holes provided along the peripheral edge of the opening. When the shoelace 230 is tightened in the state where a foot is inserted into the upper body 210, the upper body 210 can be brought into close contact with the foot.

The shoe sole 100A includes a midsole 110, a highly rigid member 120 (see FIGS. 2 to 7), and an outsole 130. The midsole 110 corresponds to a sole body. The midsole 110, the highly rigid member 120, and the outsole 130 are integrated with each other, so that the shoe sole 100A is entirely formed in a substantially flat shape.

The outsole 130 has a lower surface provided with a ground contact surface 131 (see FIGS. 3 and 5 to 7). The midsole 110 is located above the outsole 130. The highly rigid member 120 is embedded in the midsole 110 and thereby fixed to the midsole 110.

Figure 2:
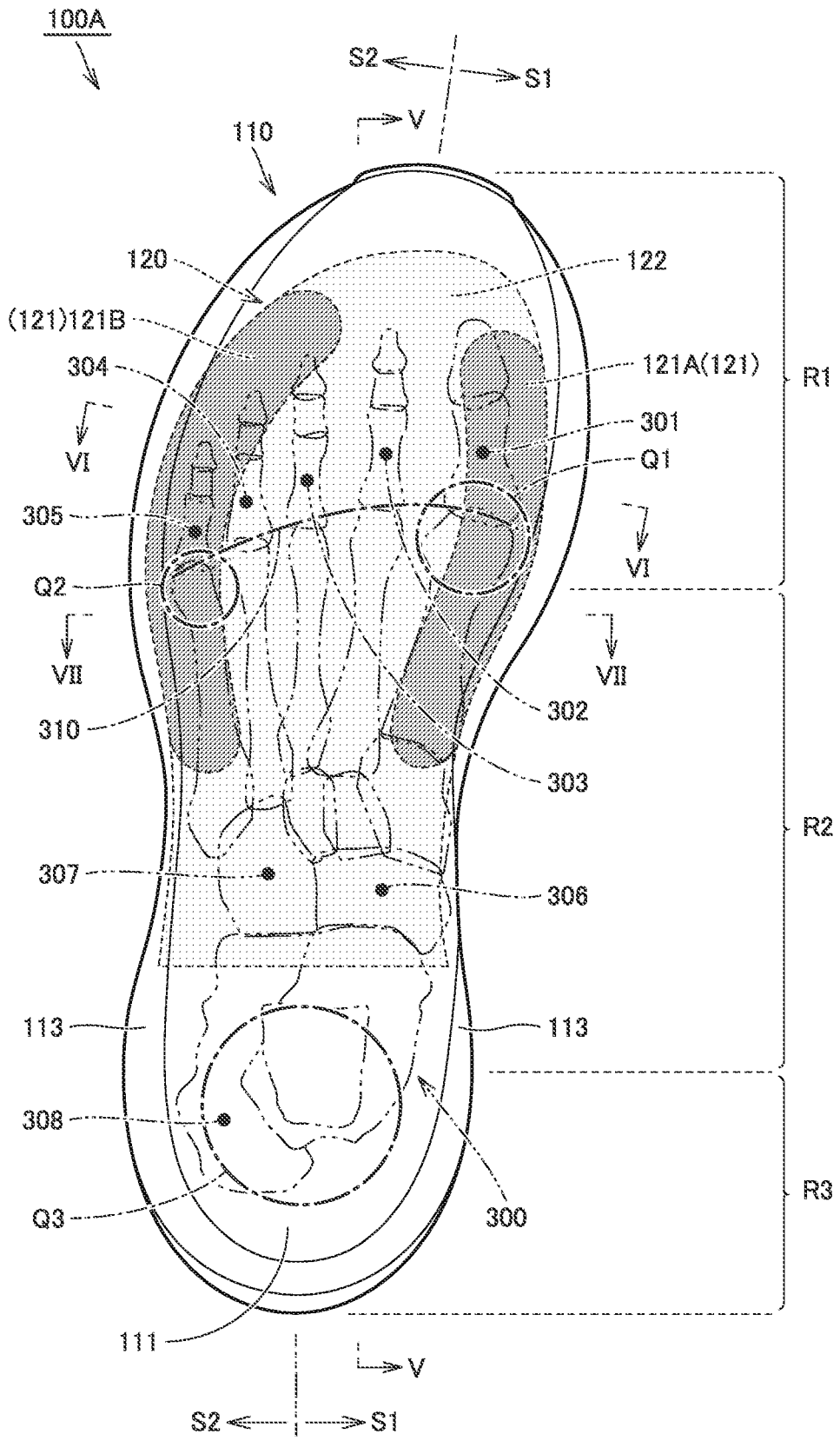
FIG. 2 is a schematic plan view of the shoe sole shown in FIG. 1.
Figure 3:
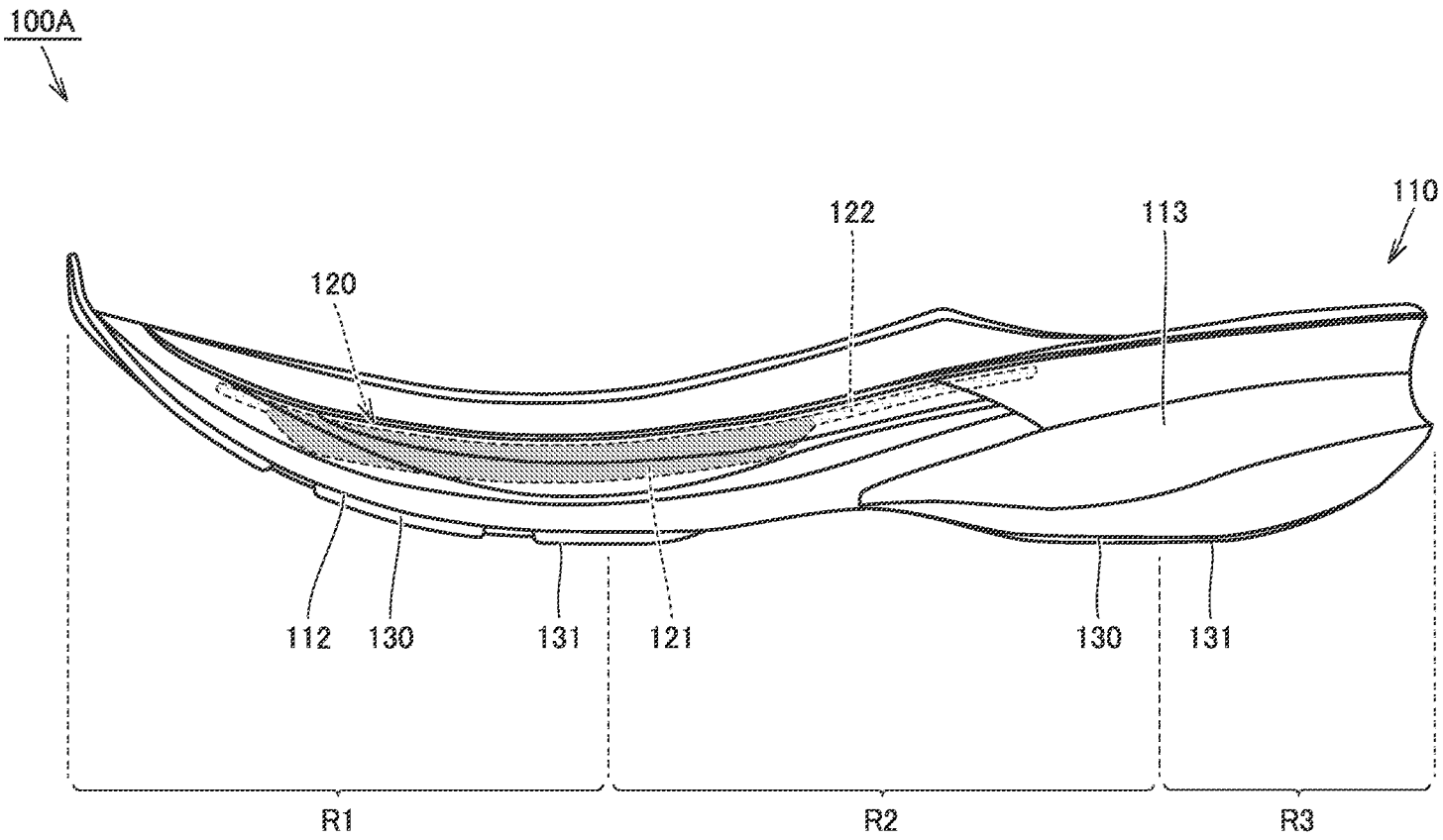
FIG. 3 is a schematic side view of the shoe sole shown in FIG. 1.
Figure 4:
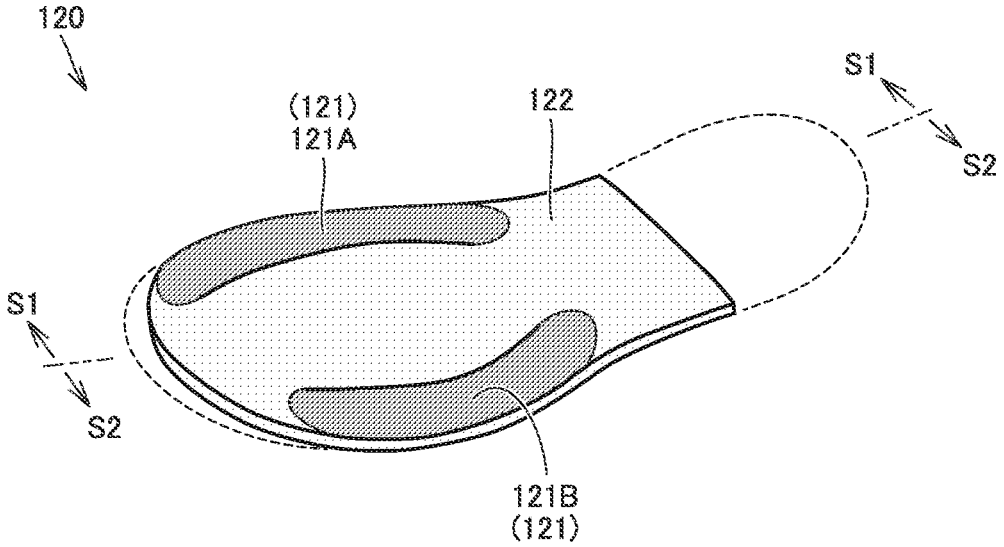
FIG. 4 is a schematic perspective view of a highly rigid member shown in FIGS. 2 and 3.
Figure 5:
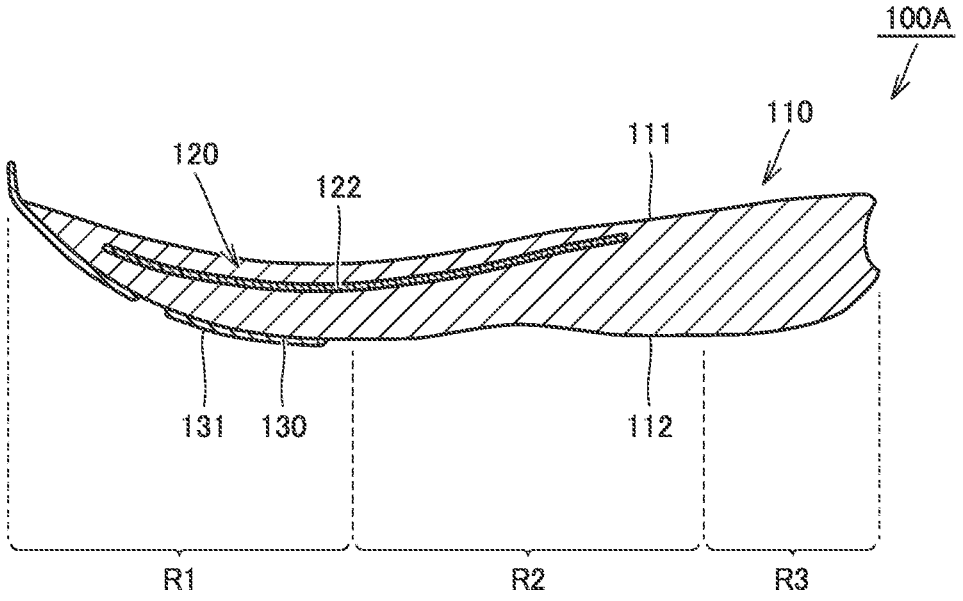
FIG. 5 is a schematic longitudinal cross-sectional view of the shoe sole shown in FIG. 1.
Figure 6:
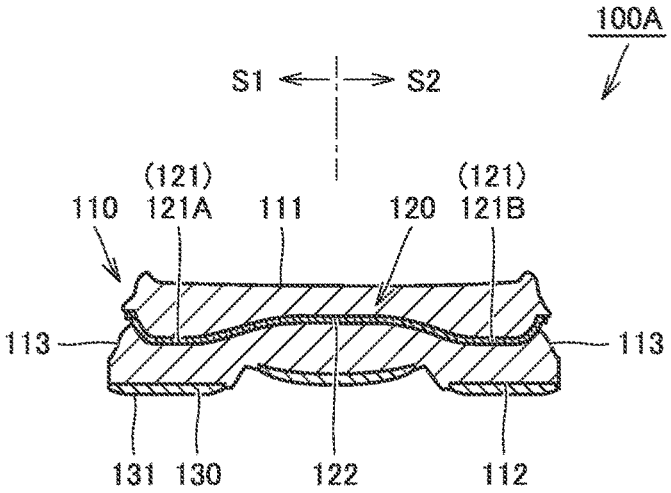
FIG. 6 is a schematic transverse cross-sectional view of the shoe sole shown in FIG. 1.
Figure 7:
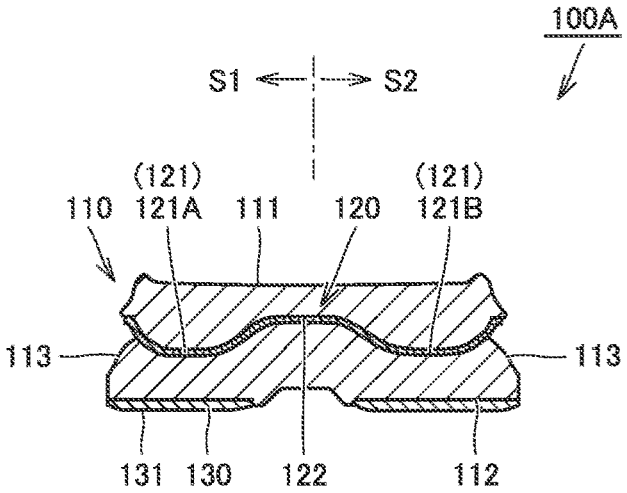
FIG. 7 is a schematic transverse cross-sectional view of the shoe sole shown in FIG. 1.

FIGS. 2 and 3 are a schematic plan view and a schematic side view, respectively, of the shoe sole shown in FIG. 1. FIG. 4 is a schematic perspective view of the highly rigid member shown in FIGS. 2 and 3. FIG. 5 is a schematic longitudinal cross-sectional view taken along a line V-V shown in FIG. 2. FIGS. 6 and 7 are schematic transverse cross-sectional views taken along lines VI-VI and VII-VII, respectively, shown in FIG. 2. The configuration of the shoe sole 100A according to the present embodiment will be described below in greater detail with reference to FIGS. 2 to 7. Note that a wearer is assumed to be a person who has a standard physique having feet conforming to the size of the shoes. In FIG. 2, bones 300 of a foot are superimposed on the shoe sole 100A so as to allow clear understanding of the positional relation between the shoe sole and the bones of the foot of the wearer wearing the shoe.

As shown in FIG. 2, the shoe sole 100A is divided into: a forefoot portion R1 that supports a toe portion and a ball portion of a foot of a wearer; a midfoot portion R2 that supports an arch portion of the foot; and a rearfoot portion R3 that supports a heel portion of the foot, in a front-rear direction (substantially in the up-down direction in the figure) corresponding to a foot length direction of the foot of the wearer in a plan view.

With reference to the front end of the shoe sole 100A, a first boundary position is assumed to be a position located at 40% of the dimension of the shoe sole 100A from the front end in the front-rear direction, and a second boundary position is assumed to be a position located at 80% of the dimension of the shoe sole 100A from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the shoe sole in the front-rear direction.

Further, the shoe sole 100A is divided into a portion on the medial foot side (a portion on the S1 side shown in the figure) and a portion on the lateral foot side (a portion on the S2 side shown in the figure) in the right-left direction (substantially in the right-left direction in the figure) corresponding to the foot width direction of the wearer's foot in a plan view. In this case, the portion on the medial foot side corresponds to the medial side of the foot in anatomical position (i.e., the side close to the midline) and the portion on the lateral foot side is opposite to the medial side of the foot in anatomical position (i.e., the side away from the midline).

Referring to FIGS. 2, 3 and 5 to 7, the shoe sole 100A includes the midsole 110, the highly rigid member 120, and the outsole 130, as described above. The midsole 110 has an upper surface 111, a lower surface 112, and a side surface 113, and forms a portion on the upper side of the shoe sole 100A. The outsole 130 has an upper surface and a lower surface that serves as the above-mentioned ground contact surface 131, and forms a portion on the lower side of the shoe sole 100A.

The midsole 110 is located to extend continuously from the forefoot portion R1 to the rearfoot portion R3. The upper surface 111 of the midsole 110 defines the upper surface of the shoe sole 100A, and has a peripheral edge portion protruding as compared with its surrounding area. Thereby, the upper surface 111 of the midsole 110 is provided with a concave portion in which the upper 200 is received. A portion other than the peripheral edge portion in the upper surface 111 of the midsole 110, which corresponds to the bottom surface of the concave portion, has a smooth curved surface shape so as to fit to the shape of the sole of the foot.

The outsole 130 is located to extend continuously from the forefoot portion R1 to the rearfoot portion R3. The outsole 130 may be formed of a single member, or may be formed of a plurality of members divided as shown in the figure. Since the lower surface of the outsole 130 forms the ground contact surface 131 as described above, the exposed surface of this lower surface may be provided with protrusions and recesses to thereby form a tread pattern for improving the grip performance. The upper surface of the outsole 130 is bonded to the lower surface 112 of the midsole 110, for example, by adhesion.

It is preferable that the midsole 110 has suitable strength and excellent shock absorbing performance. From this viewpoint, the midsole 110 is made, for example, using a resin-made foam material containing: a resin material as a main component; and a foaming agent and a crosslinking agent as sub-components. Alternatively, the midsole 110 may be made using a rubber-made foam material containing: a rubber material as a main component; and a plasticizer, a foaming agent, a reinforcing agent, and a crosslinking agent as sub-components.

Examples applicable as the above-mentioned resin material may be a foam of ethylene-vinyl acetate copolymer (EVA), a foam of polyolefin resin, a foam of thermoplastic polyurethane, a foam of thermoplastic polyamide elastomer (TPA, TPAE), a foam of thermoplastic polyester elastomer, and the like. As the rubber material, butadiene rubber can be suitably used, for example.

Thus, the midsole 110 is generally formed of a member that is lower in Young's modulus and lower in hardness than the outsole 130. The midsole 110 may have a prescribed portion including various types of shock absorbing parts or including reinforcing parts other than the highly rigid member 120 described later.

The outsole 130 is preferably excellent in wear resistance and grip performance. From this viewpoint, the outsole 130 is formed using a member made of a material, for example, containing a rubber material as a main component and a plasticizer, a reinforcing agent, and a crosslinking agent as sub-components.

Thus, the outsole 130 is generally formed of a member that is higher in Young's modulus and higher in hardness than the midsole 110. The shape and the above-mentioned tread pattern of the outsole 130 may be designed as appropriate according to the intended use of the shoe 1.

The highly rigid member 120 may be formed of a single member and is located to extend continuously from the forefoot portion R1 to the midfoot portion R2. More specifically, the highly rigid member 120 is disposed to extend over the portion on the medial foot side (the portion on the S1 side) and the portion on the lateral foot side (the portion on the S2 side) in the right-left direction of the shoe sole 100A, and also extend over the portion other than the front end portion in the forefoot portion R1 and the portion other than the rear end portion in the midfoot portion R2 in the front-rear direction of the shoe sole 100A.

The highly rigid member 120 is entirely formed of a plate-shaped member and embedded in the midsole 110 and thereby fixed to the midsole 110 as described above. In this case, examples of a specific method of embedding the highly rigid member 120 in the midsole 110 include: a method of vertically dividing the midsole 110 and placing the highly rigid member 120 to be sandwiched between the divided midsoles 110 for bonding; a method of inserting the highly rigid member 120 during cast molding or injection molding of the midsole 110; and the like.

As shown in FIGS. 2 to 7 and particularly in FIG. 4, the highly rigid member 120 has a curved plate portion 121 and a connecting plate portion 122. The curved plate portion 121 includes a medial foot side curved plate portion 121A and a lateral foot side curved plate portion 121B that are separated from each other. The medial foot side curved plate portion 121A and the lateral foot side curved plate portion 121B are connected to each other through the connecting plate portion 122. In FIGS. 2 to 4, the curved plate portion 121 is colored in dark gray and the connecting plate portion 122 is colored in light gray for the sake of easy understanding.

As shown in FIG. 2, the medial foot side curved plate portion 121A is located to extend continuously from the forefoot portion R1 to the midfoot portion R2. More specifically, the medial foot side curved plate portion 121A is disposed along the portion located on the medial foot side (i.e., the portion on the S1 side) and including a part Q1 for supporting a big toe of the wearer's foot, and extends substantially in the front-rear direction of the shoe sole 100A.

Specifically, in the present embodiment, the medial foot side curved plate portion 121A has a front end located in a portion corresponding to the first distal phalanx, and a rear end located in a portion corresponding to a rear end portion of the first metatarsal bone. Thus, in a plan view, the medial foot side curved plate portion 121A substantially overlaps with the first distal phalanx, the first proximal phalanx, and the first metatarsal bone of the wearer's foot. In FIG. 2, only the first proximal phalanx of bones 300 of a foot is denoted by reference numeral 301.

As shown in FIGS. 6 and 7, the medial foot side curved plate portion 121A has an inverted arch shaped portion that protrudes toward the ground contact surface 131 of the shoe sole 100A in a cross section taken along a line orthogonal to a direction in which the medial foot side curved plate portion 121A extends. In other words, the medial foot side curved plate portion 121A is formed in a curved plate shape such that both ends thereof in the right-left direction are located close to the upper 200 and a central portion thereof in the right-left direction is located close to the ground contact surface 131. Also, a curved concave portion formed on the upper surface side of the medial foot side curved plate portion 121A is located to extend substantially in the front-rear direction.

As shown in FIG. 2, the lateral foot side curved plate portion 121B is located to extend continuously from the forefoot portion R1 to the midfoot portion R2. More specifically, the lateral foot side curved plate portion 121B is disposed along the portion located on the lateral foot side (i.e., the portion on the S2 side) and including a part Q2 for supporting a little toe of the wearer's foot, and extends substantially in the front-rear direction of the shoe sole 100A.

Specifically, in the present embodiment, the lateral foot side curved plate portion 121B has a front end located in a portion corresponding to the third distal phalanx, and a rear end located in a portion corresponding to a rear end portion of the fifth metatarsal bone. Thus, in a plan view, the lateral foot side curved plate portion 121B substantially overlaps with the third distal phalanx, the fourth distal phalanx, the fourth middle phalanx, the fifth distal phalanx, the fifth middle phalanx, the fifth proximal phalanx, and the fifth metatarsal bone of the wearer's foot. In FIG. 2, only the fifth proximal phalanx of the bones 300 of a foot is denoted by reference numeral 305.

As shown in FIGS. 6 and 7, the lateral foot side curved plate portion 121B has an inverted arch shaped portion that protrudes toward the ground contact surface 131 of the shoe sole 100A in a cross section taken along a line orthogonal to a direction in which the lateral foot side curved plate portion 121B extends. In other words, the lateral foot side curved plate portion 121B is formed in a curved plate shape such that both ends thereof in the right-left direction are located close to the upper 200 and a central portion thereof in the right-left direction is located close to the ground contact surface 131. Also, a curved concave portion formed on the upper surface side of the lateral foot side curved plate portion 121B is located to extend substantially in the front-rear direction.

Further, as shown in FIG. 2, the connecting plate portion 122 is located to extend continuously from the forefoot portion R1 to the midfoot portion R2, and includes: a portion located between the medial foot side curved plate portion 121A and the lateral foot side curved plate portion 121B; and portions protruding forward and rearward of the portion located between the medial foot side curved plate portion 121A and the lateral foot side curved plate portion 121B.

As shown in FIGS. 3 and 5 to 7, the connecting plate portion 122 is entirely formed in a substantially flat plate shape curved in the front-rear direction. More specifically, the connecting plate portion 122 is formed in a curved plate shape such that both ends thereof in the front-rear direction are located close to the upper 200 and a central portion thereof in the front-rear direction is located close to the ground contact surface 131. Note that the medial foot side curved plate portion 121A and the lateral foot side curved plate portion 121B as mentioned above are also curved in the front-rear direction so as to correspond to the shape of the connecting plate portion 122.

The highly rigid member 120 is made of a material higher in rigidity than the material of the midsole 110. The material of the highly rigid member 120 is not particularly limited, and examples suitably applicable as reinforcing fibers may include: fiber-reinforced resin formed using carbon fibers, glass fibers, aramid fibers, Dyneema® fibers, Zylon® fibers, boron fibers, or the like; non-fiber-reinforced resin made of a polymer resin such as urethane-based thermoplastic elastomer (TPU) or amide-based thermoplastic elastomer (TPA); and the like.

As described above, in the shoe sole 100A according to the present embodiment, the highly rigid member 120 is provided with the curved plate portion 121 having an inverted arch-shaped cross section. Also, the highly rigid member 120 includes, as the curved plate portion 121, the medial foot side curved plate portion 121A disposed along a portion located on the medial foot side and including the part Q1 for supporting a big toe of the wearer's foot, and the lateral foot side curved plate portion 121B disposed along a portion located on the lateral foot side and including the part Q2 for supporting a little toe of the wearer's foot. This allows improvement both in the propulsive force at the time of kicking the ground and in the stability at foot landing. The reason will be described below in detail.

Figure 8A:
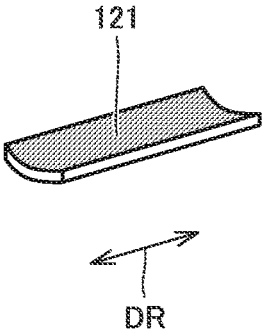
FIGS. 8A to 8C are schematic diagrams showing behaviors of a curved plate portion.
Figure 8B:
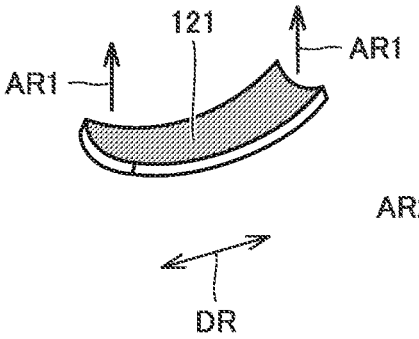
Figure 8C:
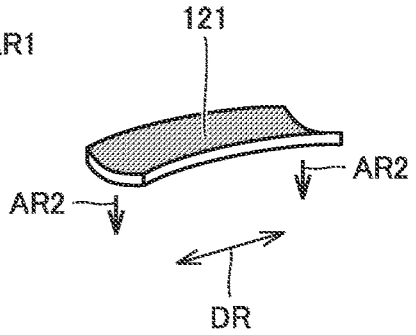

FIGS. 8A to 8C are schematic diagrams showing behaviors of the curved plate portion. FIG. 8A shows the curved plate portion 121 in the state where the shoe sole 100A is under no load, FIG. 8B shows the curved plate portion 121 in the state where the shoe sole 100A is dorsiflexed under load, and FIG. 8C shows the curved plate portion 121 in the state where the shoe sole 100A is plantarflexed under load.

In this case, dorsiflexion means deformation that occurs when a shoe sole is curved to protrude downward in the front-rear direction, which mainly occurs in the forefoot portion and the midfoot portion of the shoe sole at the time of kicking the ground. Further, plantarflexion means deformation that occurs when a shoe sole is curved to protrude upward in the front-rear direction, which may occur in the forefoot portion and the midfoot portion of the shoe sole at foot landing depending on the condition of the landing surface or the like.

Referring to FIG. 8A, as described above, in the shoe sole 100A according to the present embodiment, the curved plate portion 121 (including both the medial foot side curved plate portion 121A and the lateral foot side curved plate portion 121B) provided in the highly rigid member 120 has an inverted arch shaped portion that protrudes downward in a cross section taken along a line orthogonal to the direction in which the curved plate portion 121 extends (i.e., the direction indicated by an arrow DR shown in the figure). In other words, the curved plate portion 121 is shaped such that both ends thereof in the right-left direction are warped toward the upper 200.

Accordingly, when external force is applied to the shoe sole 100A at the time of kicking the ground, the shoe sole 100A is curved to protrude downward in the front-rear direction and thereby dorsiflexed. In this case, the highly rigid member 120 is also dorsiflexed as shown in FIG. 8B. At this time, due to its inverted arch shape, the curved plate portion 121 is readily warped in the direction indicated by an arrow AR1 shown in the figure and thereby significantly elastically deformed, and thus, dorsiflexion of the curved plate portion 121 is not hindered.

On the other hand, there may also be a case where external force is unequally applied to the shoe sole 100A at foot landing depending on the condition of the landing surface. In this case, the shoe sole 100A may be curved to protrude upward in the front-rear direction according to the condition of the landing surface, and thereby, the shoe sole 100A may be plantarflexed. At this time, the highly rigid member 120 is also plantarflexed as shown in FIG. 8C. However, at this time, the curved plate portion 121 cannot be readily warped in the direction indicated by an arrow AR2 shown in the figure due to its inverted arch shape, with the result that plantarflexion of the curved plate portion 121 is suppressed.

Further, at foot landing, external force is applied to a toe portion (i.e., the forefoot portion R1) of the shoe sole 100A such that this toe portion becomes flat irrespective of the condition of the landing surface. However, since the curved plate portion 121 of the highly rigid member 120 is disposed in this toe portion, plantarflexion of the shoe sole 100A is suppressed as described above. Thus, the original shape of the shoe sole 100A is kept, with the result that the stability at foot landing is also improved.

In the shoe sole 100A according to the present embodiment, as described above, the medial foot side curved plate portion 121A is disposed along the portion located on the medial foot side and including the part Q1 for supporting a big toe of the wearer's foot, and also, the lateral foot side curved plate portion 121B is disposed along the portion located on the lateral foot side and including the part Q2 for supporting a little toe of the wearer's foot. The part Q1 for supporting a big toe of a foot and the part Q2 for supporting a little toe of a foot are regions each receiving a relatively large load at foot landing as compared with other portions. Thus, these parts Q1 and Q2 each are provided with the above-mentioned curved plate portion 121, and thereby, plantarflexion of the shoe sole 100A can be effectively suppressed in these regions and surrounding areas thereof (i.e., both ends in the right-left direction in each of the forefoot portion R1 and the midfoot portion R2 in the shoe sole 100A). Therefore, the stability at foot landing is dramatically enhanced.

On the other hand, in the shoe sole 100A according to the present embodiment, both the medial foot side curved plate portion 121A and the lateral foot side curved plate portion 121B as the curved plate portion 121 are readily dorsiflexed at the time of kicking the ground, as described above. Thus, the portion of the highly rigid member 120 that corresponds to the forefoot portion R1 and the midfoot portion R2 is entirely readily dorsiflexed and thereby elastically deformed. Accordingly, this elastic deformation produces repulsive force to thereby produce significant propulsive force.

Therefore, the configuration as described above can implement the shoe sole 100A that is improved both in propulsive force at the time of kicking the ground and in stability at foot landing, and the shoe 1 including the shoe sole 100A.

As described above, the highly rigid member 120 can be formed of various types of fiber-reinforced resins, non-fiber-reinforced resins, or the like. In addition, the bending modulus of elasticity of the highly rigid member 120 is preferably 5 GPa or more and 15 GPa or less for aiming at improving both the propulsive force at the time of kicking the ground and the stability at foot landing.

The thickness of the highly rigid member 120 is not particularly limited. However, when the highly rigid member 120 has the bending modulus of elasticity as mentioned above, the thickness of the curved plate portion 121 is preferably 0.5 mm or more and 5.0 mm or less, and more preferably 1.0 mm or more and 1.5 mm or less. When the thickness of the curved plate portion 121 is 1.5 mm or more and 5.0 mm or less, the bending rigidity can be increased, and the stability at foot landing can be enhanced. On the other hand, when the thickness of the curved plate portion 121 is 0.5 mm or more and 1.0 mm or less, the weight can be reduced while enhancing the stability at foot landing.

Further, the thickness of the highly rigid member 120 does not have to be entirely uniform, but the highly rigid member 120 may be configured to be relatively thin on the front end side in the front-rear direction and to be thicker toward the rear end side in the front-rear direction. By such a configuration, the portion receiving a larger load is increased in rigidity, and thereby, the highly rigid member 120 can be increased in durability. On the other hand, the highly rigid member 120 may be configured to be relatively thick on the front end side in the front-rear direction and to be thinner toward the rear end side in the front-rear direction. By such a configuration, forward shift of the center of gravity can be promoted during running.

In the shoe sole 100A and the shoe 1 including the same according to the present embodiment, as described above, the highly rigid member 120 is entirely formed in a curved plate shape such that both ends thereof in the front-rear direction are located close to the upper 200 and a central portion thereof in the front-rear direction is located close to the ground contact surface 131. Thus, due to this curved shape, the repulsive force of the highly rigid member 120 obtained at the time of kicking the ground is increased, and accordingly, the propulsive force is also increased.

In this case, both the medial foot side curved plate portion 121A and the lateral foot side curved plate portion 121B extend substantially in the front-rear direction. Thereby, the repulsive force at the time of kicking the ground that is obtained by providing the highly rigid member 120 is more likely to act on the foot sole in the forward direction, and thus, the forward propulsion efficiency can be enhanced.

Further, in the shoe sole 100A and the shoe 1 including the shoe sole 100A according to the present embodiment, the medial foot side curved plate portion 121A and the lateral foot side curved plate portion 121B are connected through the connecting plate portion 122 having a substantially flat plate shape, as described above. Thus, the stability at foot landing is increased as compared with the case where the medial foot side curved plate portion 121A and the lateral foot side curved plate portion 121B are not connected to each other but are provided independently of each other.

Further, in the shoe sole 100A and the shoe 1 including the shoe sole 100A according to the present embodiment, the highly rigid member 120 is embedded in the midsole 110 as described above. Such a configuration can ensure an improved fit to the wearer's foot while mitigating the impact at foot landing.

In the present embodiment, the medial foot side curved plate portion 121A is configured such that its front end is located in a portion corresponding to the first distal phalanx and its rear end is located in a portion corresponding to the rear end portion of the first metatarsal bone. However, the medial foot side curved plate portion 121A may be configured at least such that its front end is located forward of the portion corresponding to a central portion of a first proximal phalanx 301 extending in the foot length direction of the wearer's foot and its rear end is located rearward of the portion corresponding to a rear end portion of the first proximal phalanx 301 extending in the foot length direction of the wearer's foot (i.e., the portion corresponding to a metatarsophalangeal joint 310). Such a configuration allows improvement both in the propulsive force at the time of kicking the ground and in the stability at foot landing. However, also in this case, the length of the medial foot side curved plate portion 121A in the front-rear direction is preferably at least 10 mm or more in order to achieve an effect of suitably suppressing plantarflexion.

Further, in the present embodiment, the lateral foot side curved plate portion 121B is configured such that its front end is located in a portion corresponding to the third distal phalanx and its rear end is located in a portion corresponding to a rear end portion of the fifth metatarsal bone. However, the lateral foot side curved plate portion 121B may be configured at least such that its front end is located forward of the portion corresponding to a central portion of a fifth proximal phalanx 305 extending in the foot length direction of the wearer's foot and its rear end is located rearward of the portion corresponding to a rear end portion of the fifth proximal phalanx 305 extending in the foot length direction of the wearer's foot (i.e., the portion corresponding to the metatarsophalangeal joint 310). Such a configuration allows improvement both in the propulsive force at the time of kicking the ground and in the stability at foot landing as described above. However, also in this case, the length of the lateral foot side curved plate portion 121B in the front-rear direction is preferably at least 10 mm or more in order to achieve an effect of suitably suppressing plantarflexion.

The lateral foot side curved plate portion 121B may be configured, in a plan view, not only to overlap with the third distal phalanx, the fourth distal phalanx, the fourth middle phalanx, the fifth distal phalanx, the fifth middle phalanx, the fifth proximal phalanx, and the fifth metatarsal bone of the wearer's foot, but also to overlap with the fourth proximal phalanx and the fourth metatarsal bone of the wearer's foot. In this case, the lateral foot side curved plate portion 121B may be disposed at least such that its front end is located forward of a portion corresponding to a central portion of a fourth proximal phalanx 304 extending in the foot length direction of the wearer's foot and its rear end is located rearward of a portion corresponding to a rear end portion of the fourth proximal phalanx 304 extending in the foot length direction of the wearer's foot (i.e., the portion corresponding to the metatarsophalangeal joint 310).

First Modification

Figure 9:
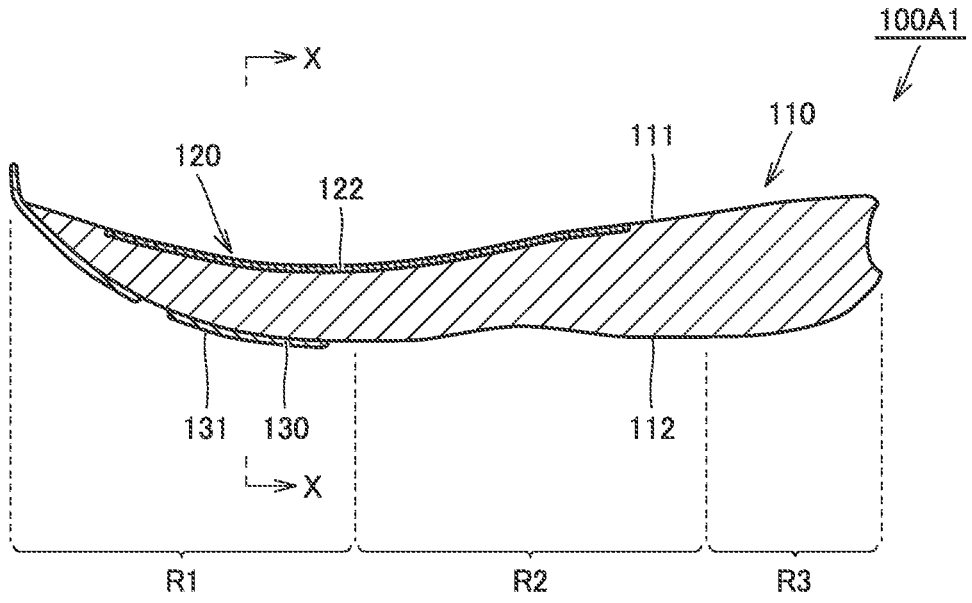
FIG. 9 is a schematic longitudinal cross-sectional view of a shoe sole according to a first modification.
Figure 10:
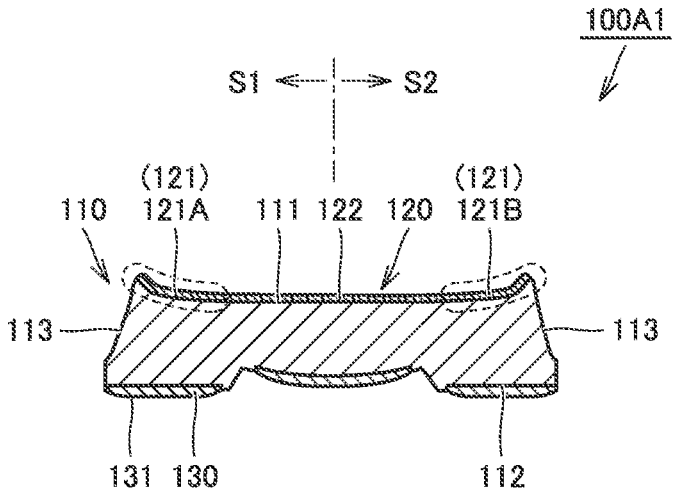
FIG. 10 is a schematic transverse cross-sectional view of the shoe sole shown in FIG. 9.

FIG. 9 is a schematic longitudinal cross-sectional view of a shoe sole according to a first modification based on the above-described first embodiment. FIG. 10 is a schematic transverse cross-sectional view taken along a line X-X shown in FIG. 9. The following describes a shoe sole 100A1 according to the present modification with reference to FIGS. 9 and 10. The shoe sole 100A1 according to the present modification is provided in the shoe 1 in place of the shoe sole 100A according to the above-described first embodiment.

As shown in FIGS. 9 and 10, when comparing the shoe sole 100A1 according to the present modification with the shoe sole 100A according to the above-described first embodiment, the position of the highly rigid member 120 is the main difference therebetween. Specifically, in the shoe sole 100A1, the highly rigid member 120 is not embedded in the midsole 110 but is disposed on the upper surface 111 of the midsole 110 and fixed to the midsole 110. The highly rigid member 120 can be fixed to the upper surface 111 of the midsole 110, for example, by means of adhesion or the like.

As shown in FIG. 10, also in the shoe sole 100A1 according to the present modification, the highly rigid member 120 is provided with: a curved plate portion 121 having an inverted arch-shaped cross section; and a connecting plate portion 122 having a substantially flat plate shape, as in the above-described first embodiment. The curved plate portion 121 includes: a medial foot side curved plate portion 121A disposed along a portion located on the medial foot side and including a part Q1 for supporting a big toe of the wearer's foot; and a lateral foot side curved plate portion 121B disposed along a portion located on the lateral foot side and including a part Q2 for supporting a little toe of the wearer's foot. In FIG. 10, the portion corresponding to the curved plate portion 121 in the highly rigid member 120 is surrounded by a broken line for the sake of easy understanding.

Also in such a configuration, the shoe sole 100A1 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. Further, in the configuration as described above, the highly rigid member 120 is disposed at a position closer to the foot sole of the wearer, so that plantarflexion of the shoe sole 100A1 at foot landing can be more effectively suppressed.

Second Modification

Figure 11:
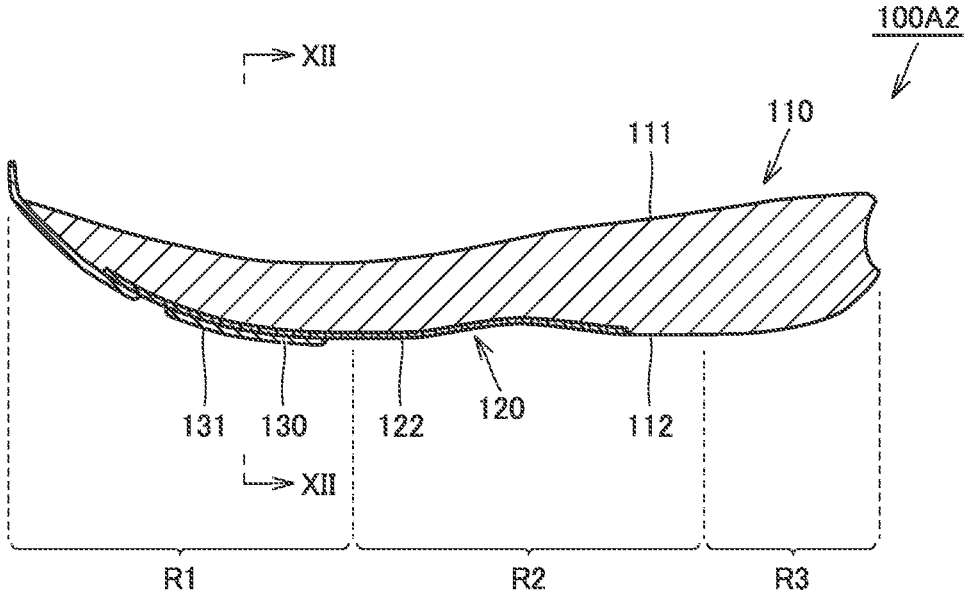
FIG. 11 is a schematic longitudinal cross-sectional view of a shoe sole according to a second modification.
Figure 12:
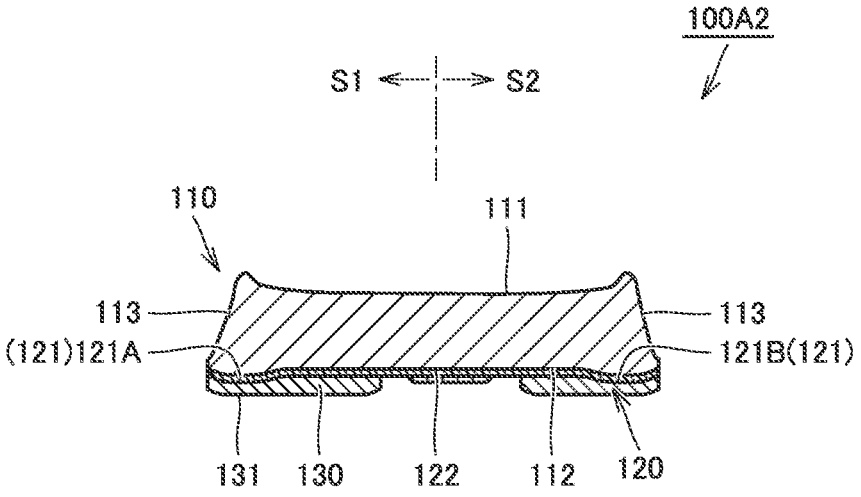
FIG. 12 is a schematic transverse cross-sectional view of the shoe sole shown in FIG. 11.

FIG. 11 is a schematic longitudinal cross-sectional view of a shoe sole according to a second modification based on the above-described first embodiment. FIG. 12 is a schematic transverse cross-sectional view taken along a line XII-XII shown in FIG. 11. The following describes a shoe sole 100A2 according to the present modification with reference to FIGS. 11 and 12. Note that the shoe sole 100A2 according to the present modification is provided in the shoe 1 in place of the shoe sole 100A according to the above-described first embodiment.

As shown in FIGS. 11 and 12, when comparing the shoe sole 100A2 according to the present modification with the shoe sole 100A according to the above-described first embodiment, the position of the highly rigid member 120 is the main difference therebetween. Specifically, in the shoe sole 100A2, the highly rigid member 120 is not embedded in the midsole 110 but is disposed on the lower surface 112 of the midsole 110 and fixed to the midsole 110. The highly rigid member 120 can be fixed to the lower surface 112 of the midsole 110, for example, by means of adhesion or the like. Note that the outsole 130 located in a portion where the highly rigid member 120 is disposed is fixed to the highly rigid member 120, for example, by means of adhesion or the like.

As shown in FIG. 12, also in the shoe sole 100A2 according to the present modification, the highly rigid member 120 is provided with: a curved plate portion 121 having an inverted arch-shaped cross section; and a connecting plate portion 122 having a substantially flat plate shape, as in the above-described first embodiment. The curved plate portion 121 includes: a medial foot side curved plate portion 121A disposed along a portion located on the medial foot side and including a part Q1 for supporting a big toe of the wearer's foot; and a lateral foot side curved plate portion 121B disposed along a portion located on the lateral foot side and including a part Q2 for supporting a little toe of the wearer's foot.

Also in such a configuration, the shoe sole 100A2 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. Further, in the configuration as described above, the highly rigid member 120 is disposed at a position farther away from the sole of the wearer's foot, so that an improved fit to the wearer's foot can be further ensured while mitigating the impact at foot landing.

Third Modification

Figure 13:
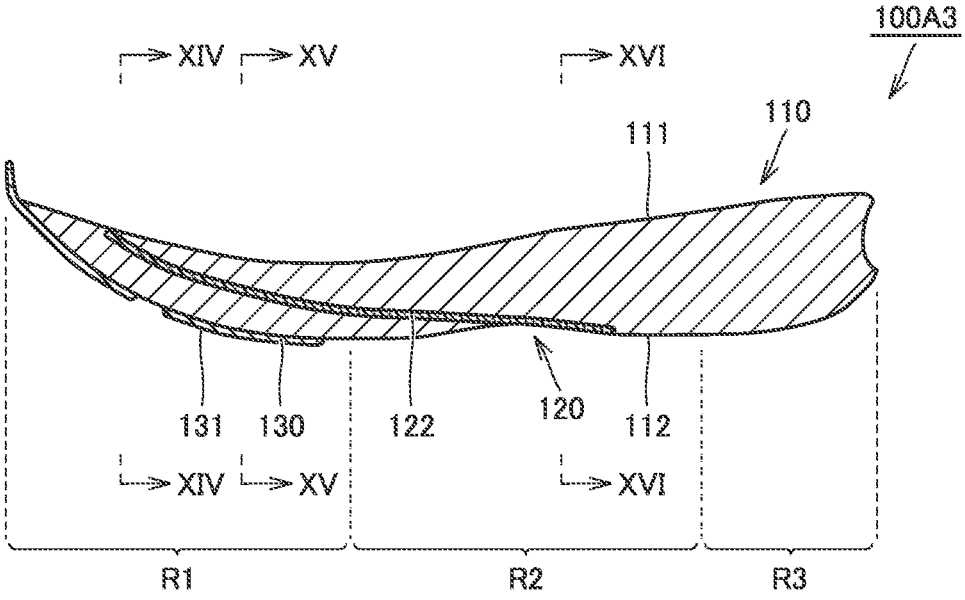
FIG. 13 is a schematic longitudinal cross-sectional view of a shoe sole according to a third modification.
Figure 14:
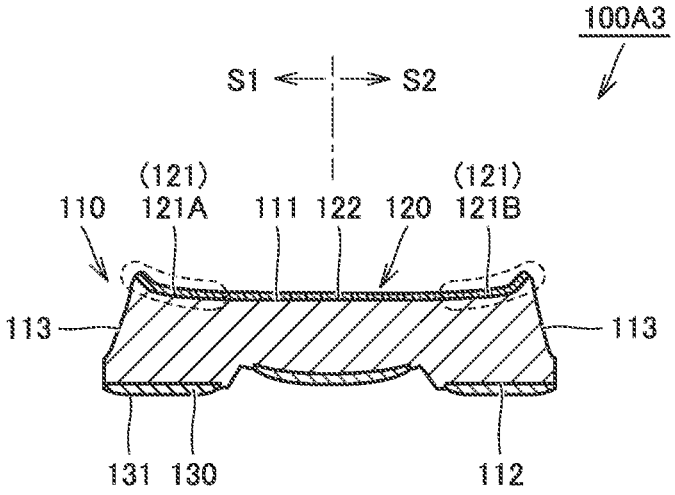
FIG. 14 is a schematic transverse cross-sectional view of the shoe sole shown in FIG. 13.
Figure 15:
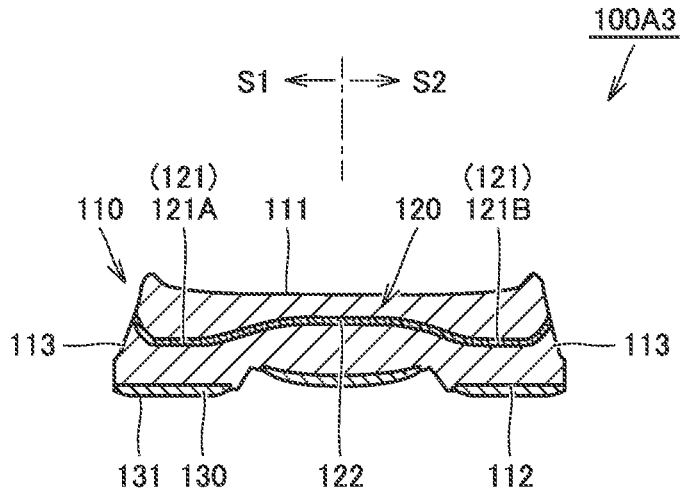
FIG. 15 is a schematic transverse cross-sectional view of the shoe sole shown in FIG. 13.
Figure 16:
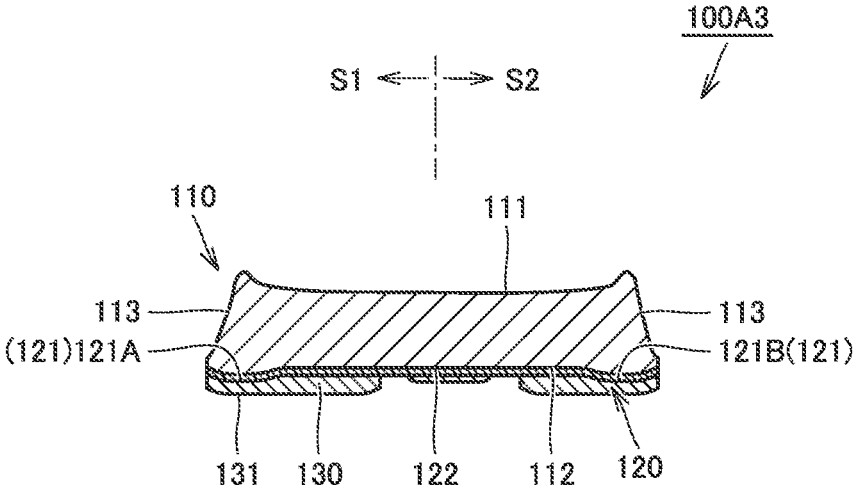
FIG. 16 is a schematic transverse cross-sectional view of the shoe sole shown in FIG. 13.

FIG. 13 is a schematic longitudinal cross-sectional view of a shoe sole according to a third modification based on the above-described first embodiment. FIGS. 14 to 16 are schematic transverse cross-sectional views taken along lines XIV-XIV, XV-XV, and XVI-XVI, respectively, shown in FIG. 13. The following describes a shoe sole 100A3 according to the present modification with reference to FIGS. 13 to 16. Note that the shoe sole 100A3 according to the present modification is provided in the shoe 1 in place of the shoe sole 100A according to the above-described first embodiment.

As shown in FIGS. 13 to 16, when comparing the shoe sole 100A3 according to the present modification with the shoe sole 100A according to the above-described first embodiment, the position of the highly rigid member 120 is the main difference therebetween. Specifically, in the shoe sole 100A3, the front end and the rear end of the highly rigid member 120 are not embedded in the midsole 110, but the front end is disposed to be exposed on the upper surface 111 of the midsole 110 and the rear end is disposed to be exposed on the lower surface 112 of the midsole 110. In other words, the highly rigid member 120 is partially embedded in the midsole 110 such that the distance from the upper surface 111 of the midsole 110 increases from the front side toward the rear side in the front-rear direction.

As shown in FIGS. 14 to 16, also in the shoe sole 100A3 according to the present modification, the highly rigid member 120 is provided with: a curved plate portion 121 having an inverted arch-shaped cross section; and a connecting plate portion 122 having a substantially flat plate shape, as in the above-described first embodiment. The curved plate portion 121 includes: a medial foot side curved plate portion 121A disposed along a portion located on the medial foot side and including a part Q1 for supporting a big toe of the wearer's foot; and a lateral foot side curved plate portion 121B disposed along a portion located on the lateral foot side and including a part Q2 for supporting a little toe of the wearer's foot. In FIG. 14, the portion corresponding to the curved plate portion 121 in the highly rigid member 120 is surrounded by a broken line for the sake of easy understanding.

Also in such a configuration, the shoe sole 100A3 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In particular, the highly rigid member 120 inclined in this way allows a relatively large curvature of the highly rigid member 120 that is curved in the front-rear direction, with the result that the repulsive force of the highly rigid member 120 obtained at the time of kicking the ground can be increased, and thus, the propulsive force can also be further increased.

Further, also when the highly rigid member 120 is inclined as described above, the front end and the rear end of the highly rigid member 120 do not necessarily have to be exposed on the upper surface 111 and the lower surface 112, respectively, of the midsole 110. For example, only the front end of the highly rigid member 120 may be exposed on the upper surface 111 of the midsole 110, and the rear end of the highly rigid member 120 may not be exposed on the lower surface 112 of the midsole 110 but may be disposed near the lower surface 112. Alternatively, the front end of the highly rigid member 120 may not be exposed on the upper surface 111 of the midsole 110 but may be disposed near the upper surface 111, and only the rear end of the highly rigid member 120 may be exposed on the lower surface 112 of the midsole 110. Further, the front end and the rear end of the highly rigid member 120 may not be exposed on the upper surface 111 and the lower surface 112, respectively, of the midsole 110 but may be disposed near the upper surface 111 and the lower surface 112, respectively, of the midsole 110. In other words, at least a part of the highly rigid member 120 is embedded in the midsole 110, and thereby, the highly rigid member 120 is disposed such that the distance from the upper surface 111 of the midsole 110 increases from the front side toward the rear side in the front-rear direction, with the result that the above-described propulsive force can be further increased.

Fourth Modification

Figure 17:
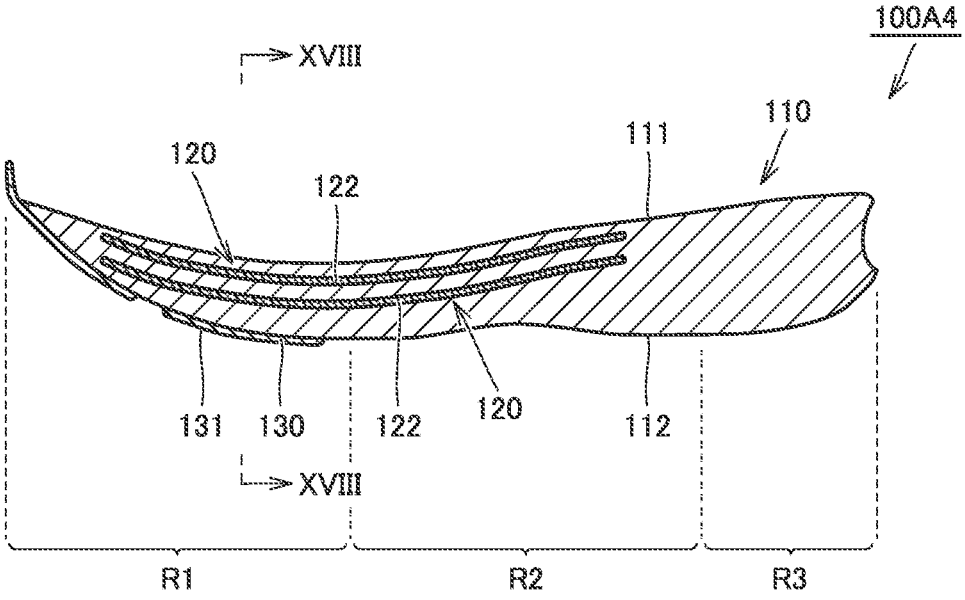
FIG. 17 is a schematic longitudinal cross-sectional view of a shoe sole according to a fourth modification.
Figure 18:
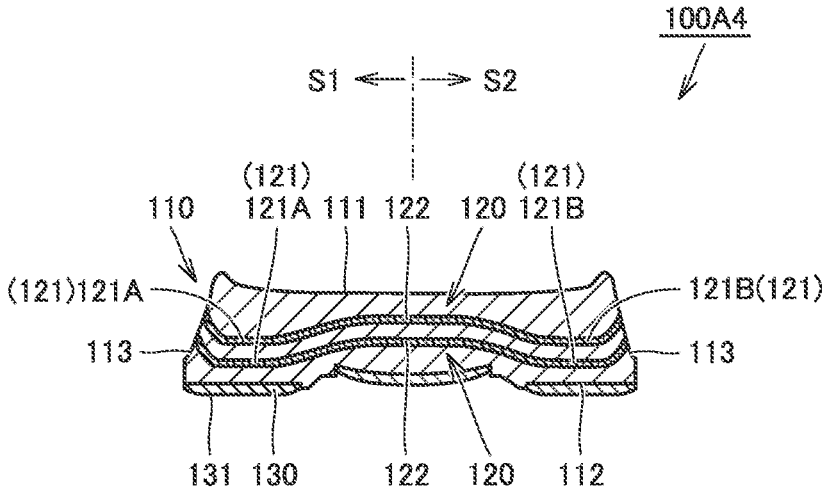
FIG. 18 is a schematic transverse cross-sectional view of the shoe sole shown in FIG. 17.

FIG. 17 is a schematic longitudinal cross-sectional view of a shoe sole according to a fourth modification based on the above-described first embodiment. FIG. 18 is a schematic transverse cross-sectional view taken along a line XVIII-XVIII shown in FIG. 17. The following describes a shoe sole 100A4 according to the present modification with reference to FIGS. 17 and 18. Note that the shoe sole 100A4 according to the present modification is provided in the shoe 1 in place of the shoe sole 100A according to the above-described first embodiment.

As shown in FIGS. 17 and 18, when comparing the shoe sole 100A4 according to the present modification with the shoe sole 100A according to the above-described first embodiment, the number of highly rigid members 120 is the main difference therebetween. Specifically, in the shoe sole 100A4, two highly rigid members 120 are embedded in the midsole 110. These two highly rigid members 120 are stacked on top of the other at a distance from each other in the up-down direction (i.e., in the thickness direction of the shoe sole 100A4).

In the shoe sole 100A4 according to the present modification, the two highly rigid members 120 each are provided with: a curved plate portion 121 having an inverted arch-shaped cross section; and a connecting plate portion 122 having a substantially flat plate shape. The curved plate portion 121 includes: a medial foot side curved plate portion 121A disposed along a portion located on the medial foot side and including a part Q1 for supporting a big toe of the wearer's foot; and a lateral foot side curved plate portion 121B disposed along a portion located on the lateral foot side and including a part Q2 for supporting a little toe of the wearer's foot.

Also in such a configuration, the shoe sole 100A4 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In particular, in the case where the highly rigid members 120 are stacked in this way, the repulsive force of the highly rigid members 120 obtained at the time of kicking the ground is thereby increased, and the propulsive force is increased accordingly, and further, the stability at foot landing is also further improved.

Fifth Modification

Figure 19:
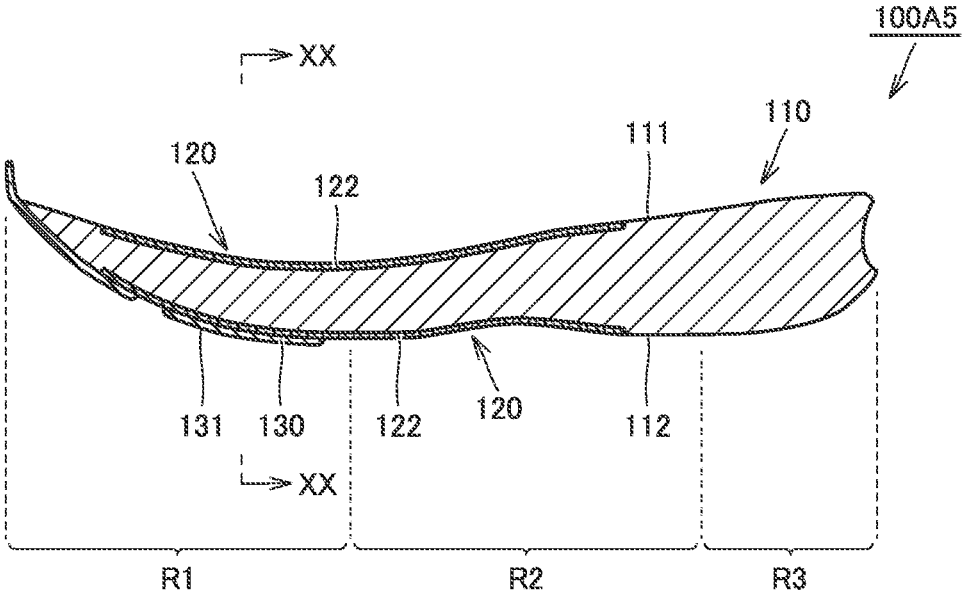
FIG. 19 is a schematic longitudinal cross-sectional view of a shoe sole according to a fifth modification.
Figure 20:
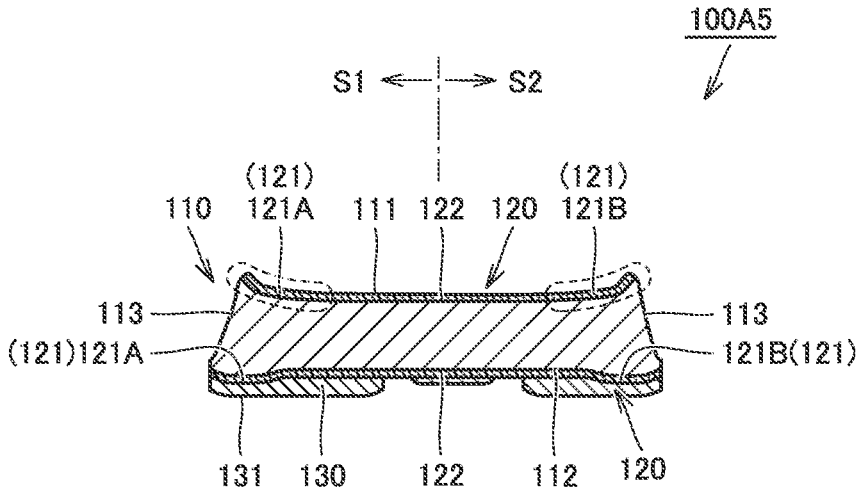
FIG. 20 is a schematic transverse cross-sectional view of the shoe sole shown in FIG. 19.

FIG. 19 is a schematic longitudinal cross-sectional view of a shoe sole according to a fifth modification based on the above-described first embodiment. FIG. 20 is a schematic transverse cross-sectional view taken along a line XX-XX shown in FIG. 19. The following describes a shoe sole 100A5 according to the present modification with reference to FIGS. 19 and 20. Note that the shoe sole 100A5 according to the present modification is provided in the shoe 1 in place of the shoe sole 100A according to the above-described first embodiment.

As shown in FIGS. 19 and 20, when comparing the shoe sole 100A5 according to the present modification with the shoe sole 100A according to the above-described first embodiment, the number and the positions of the highly rigid members 120 are the main differences therebetween. Specifically, the shoe sole 100A5 includes two highly rigid members 120. One highly rigid member 120 is disposed on the upper surface 111 of the midsole 110 and fixed to the midsole 110 while the other highly rigid member 120 is disposed on the lower surface 112 of the midsole 110 and fixed to the midsole 110.

In the shoe sole 100A5 according to the present modification, each of these two highly rigid members 120 is provided with: a curved plate portion 121 having an inverted arch-shaped cross section; and a connecting plate portion 122 having a substantially flat plate shape. The curved plate portion 121 includes: a medial foot side curved plate portion 121A disposed along a portion located on the medial foot side and including a part Q1 for supporting a big toe of the wearer's foot; and a lateral foot side curved plate portion 121B disposed along a portion located on the lateral foot side and including a part Q2 for supporting a little toe of the wearer's foot. In FIG. 20, the portion corresponding to the curved plate portion 121 in the highly rigid member 120 disposed on the upper surface 111 of the midsole 110 is surrounded by a broken line for the sake of easy understanding.

Also in such a configuration, the shoe sole 100A5 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In particular, in the case where the highly rigid members 120 are stacked in this way, the repulsive force of the highly rigid members 120 obtained at the time of kicking the ground is thereby increased, and the propulsive force is increased accordingly, and further, the stability at foot landing is also further improved.

Sixth Modification

Figure 21:
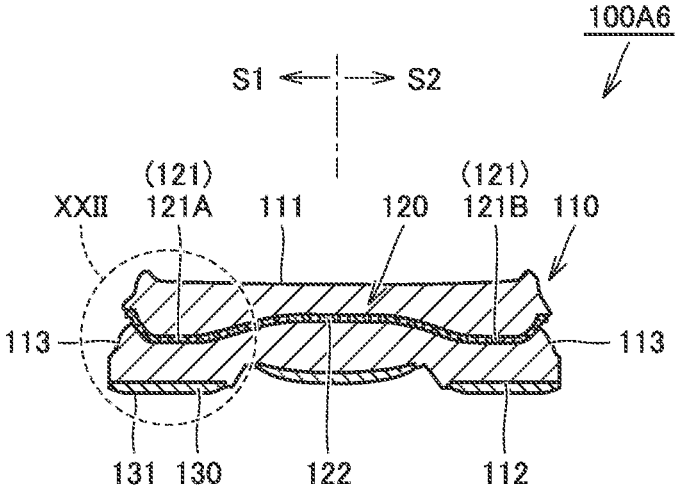
FIG. 21 is a schematic transverse cross-sectional view of a shoe sole according to a sixth modification.
Figure 22:
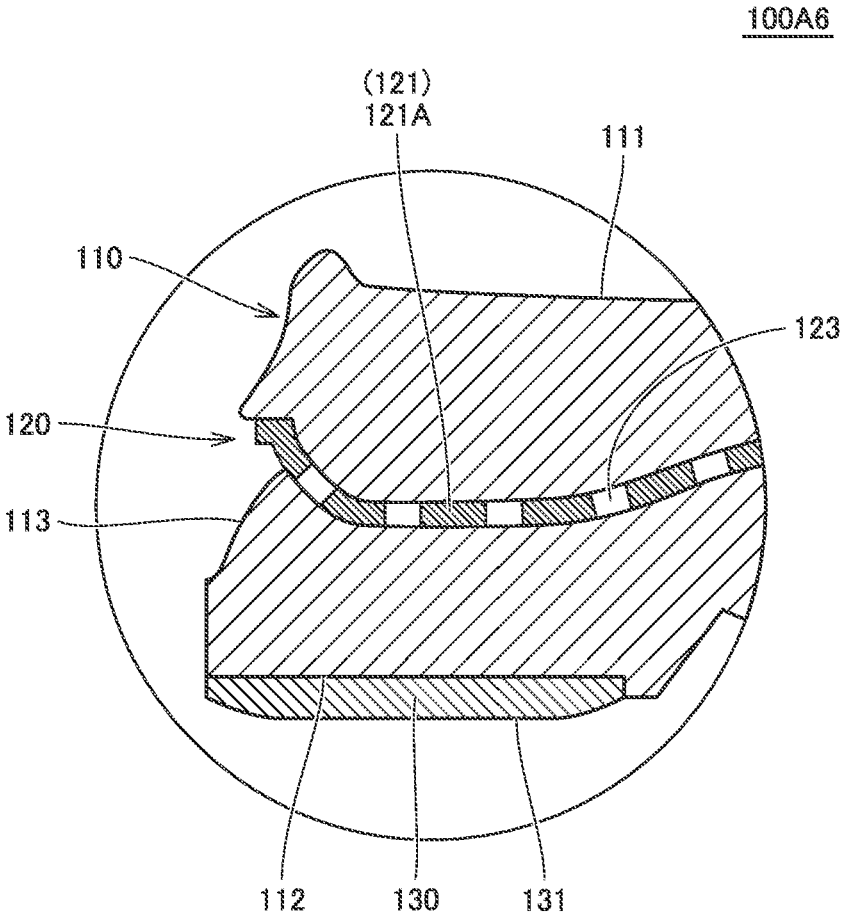
FIG. 22 is an enlarged transverse cross-sectional view of a main part of the shoe sole shown in FIG. 21.

FIG. 21 is a schematic transverse cross-sectional view of a shoe sole according to a sixth modification based on the above-described first embodiment. FIG. 22 is an enlarged view of a region XXII shown in FIG. 21. The following describes a shoe sole 100A6 according to the present modification with reference to FIGS. 21 and 22. The shoe sole 100A6 according to the present modification is provided in the shoe 1 in place of the shoe sole 100A according to the above-described first embodiment.

As shown in FIGS. 21 and 22, when comparing the shoe sole 100A6 according to the present modification with the shoe sole 100A according to the above-described first embodiment, the position and the rough shape of the highly rigid member 120 are the same but the detailed shape of the highly rigid member 120 is the difference therebetween. Specifically, in the shoe sole 100A6, the highly rigid member 120 is provided with a plurality of through holes 123 (particularly see FIG. 22).

The plurality of through holes 123 are provided to penetrate through the highly rigid member 120 from the upper surface to the lower surface in its thickness direction. The plurality of through holes 123 are spaced apart from each other. In the present modification, as shown in the figure, the plurality of through holes 123 are located in the entire area of the highly rigid member 120 and are provided in each of the medial foot side curved plate portion 121A, the lateral foot side curved plate portion 121B, and the connecting plate portion 122. Note that the plurality of through holes 123 may be provided only in specific portions of the medial foot side curved plate portion 121A, the lateral foot side curved plate portion 121B, and the connecting plate portion 122.

Also in such a configuration, the shoe sole 100A6 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, when the highly rigid member 120 is provided with the plurality of through holes 123 as described above, the highly rigid member 120 can be reduced in weight without impairing its function. The shape of each through hole 123 is not particularly limited, but each through hole 123 may be variously shaped, for example, a circular hole or an elliptical hole in a plan view, a polygonal hole, a track-shaped hole (an elongated hole), and the like.

Seventh Modification

Figure 23:
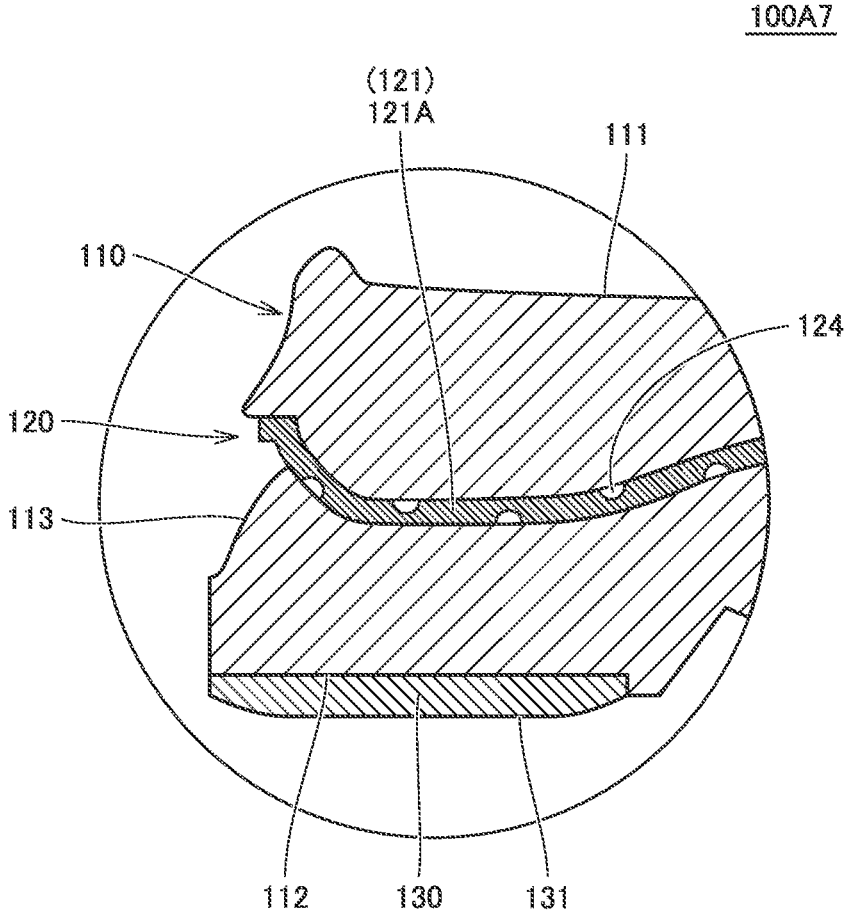
FIG. 23 is an enlarged transverse cross-sectional view of a main part of a shoe sole according to a seventh modification.

FIG. 23 is a schematic transverse cross-sectional view of a main part of a shoe sole according to a seventh modification based on the above-described first embodiment. The following describes a shoe sole 100A7 according to the present modification with reference to FIG. 23. The shoe sole 100A7 according to the present modification is provided in the shoe 1 in place of the shoe sole 100A according to the above-described first embodiment.

As shown in FIG. 23, when comparing the shoe sole 100A7 according to the present modification with the shoe sole 100A according to the above-described first embodiment, the position and the rough shape of the highly rigid member 120 are the same but the detailed shape of the highly rigid member 120 is the difference therebetween.

Specifically, in the shoe sole 100A7, the highly rigid member 120 is provided with a plurality of recesses 124.

The plurality of recesses 124 are provided on the upper surface and the lower surface of the highly rigid member 120 and are spaced apart from each other. In the present modification, as shown in the figure, the plurality of recesses 124 are located in the entire area of the highly rigid member 120 and provided in each of the medial foot side curved plate portion 121A, the lateral foot side curved plate portion 121B, and the connecting plate portion 122. Note that the plurality of recesses 124 may be provided only in specific portions in the medial foot side curved plate portion 121A, the lateral foot side curved plate portion 121B, and the connecting plate portion 122, and further, may be provided only in one of the upper surface and the lower surface of the highly rigid member 120.

Also in such a configuration, the shoe sole 100A7 includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, when the highly rigid member 120 is provided with the plurality of recesses 124 as described above, the highly rigid member 120 can be reduced in weight without impairing its function. The shape of each recess 124 is not particularly limited, but each recess 124 may be variously shaped, for example, a circular recess or an elliptical recess in a plan view, a polygonal recess, a track-shaped recess (an elongated recess), and the like.

Second Embodiment

Figure 24:
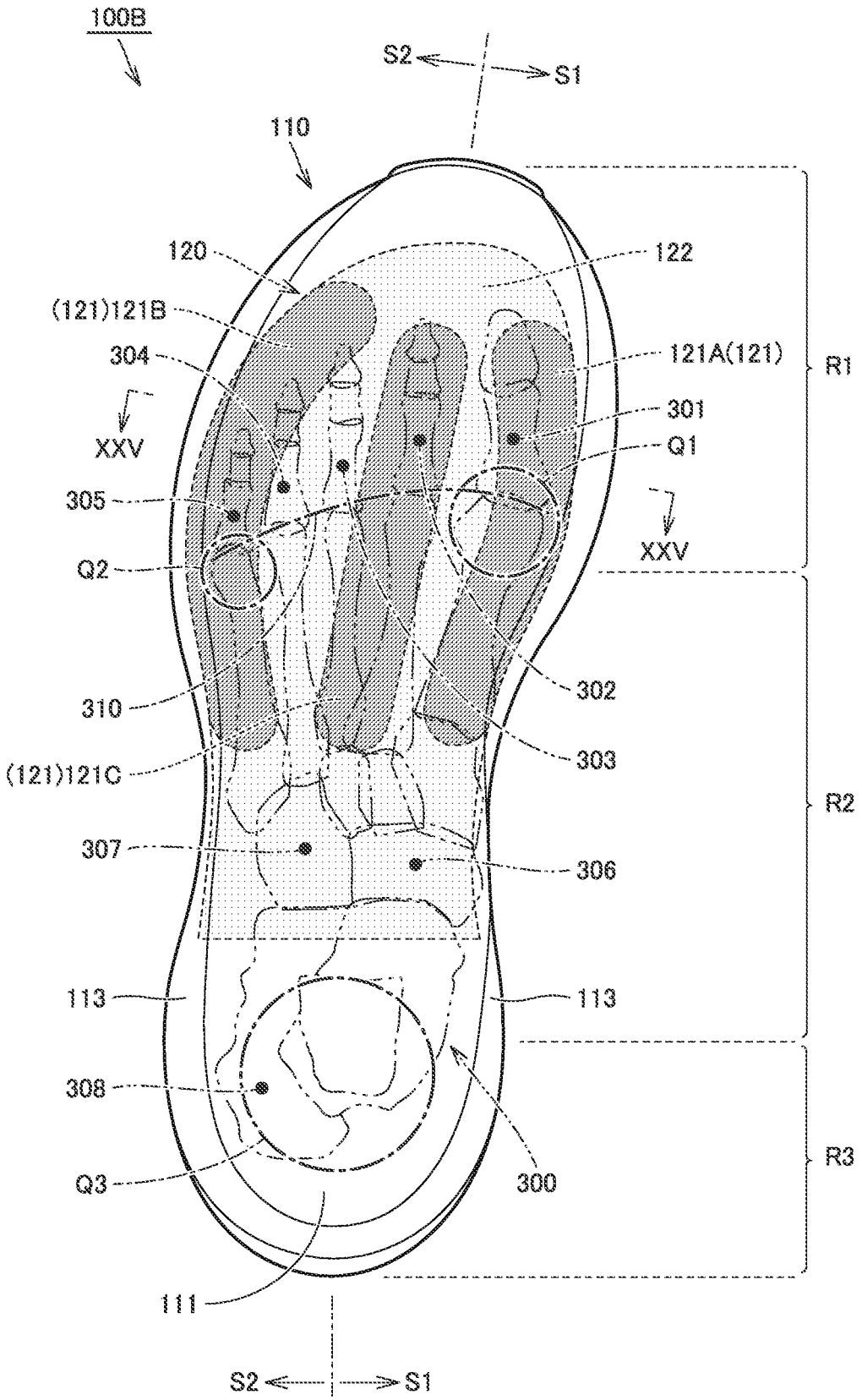
FIG. 24 is a schematic plan view of a shoe sole according to a second embodiment.
Figure 25:
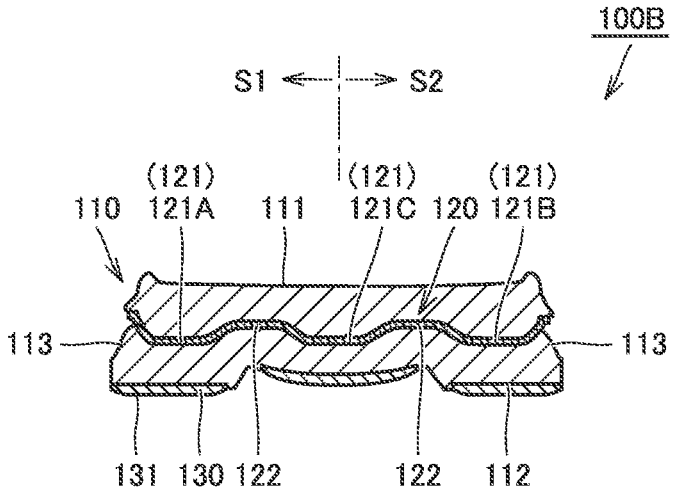
FIG. 25 is a schematic transverse cross-sectional view of the shoe sole shown in FIG. 24.

FIG. 24 is a schematic plan view of a shoe sole according to a second embodiment. FIG. 25 is a schematic transverse cross-sectional view taken along a line XXV-XXV shown in FIG. 24. The following describes a shoe sole 100B according to the present embodiment with reference to FIGS. 24 and 25. The shoe sole 100B according to the present embodiment is provided in the shoe 1 in place of the shoe sole 100A according to the above-described first embodiment.

As shown in FIGS. 24 and 25, when comparing the shoe sole 100B according to the present embodiment with the shoe sole 100A according to the above-described first embodiment, the shape of the highly rigid member 120 is the main difference therebetween. As in the shoe sole 100A according to the above-described first embodiment, the shoe sole 100B includes a midsole 110, a highly rigid member 120, and an outsole 130. The highly rigid member 120 may be formed of a single member and located to extend continuously from a forefoot portion R1 to a midfoot portion R2.

The highly rigid member 120 includes a curved plate portion 121 and a connecting plate portion 122. The curved plate portion 121 includes an intermediate curved plate portion 121C in addition to a medial foot side curved plate portion 121A and a lateral foot side curved plate portion 121B. The medial foot side curved plate portion 121A, the lateral foot side curved plate portion 121B, and the intermediate curved plate portion 121C are provided separately from each other and connected to each other through the connecting plate portion 122. In FIG. 24, the curved plate portion 121 is colored in dark gray and the connecting plate portion 122 is colored in light gray for the sake of easy understanding.

As shown in FIG. 24, the intermediate curved plate portion 121C is located to extend continuously from the forefoot portion R1 to the midfoot portion R2. More specifically, the intermediate curved plate portion 121C extends substantially in the front-rear direction of the shoe sole 100B so as to be located between a portion located on the medial foot side (i.e., a portion on the S1 side) and including a part Q1 for supporting a big toe of the wearer's foot and a portion located on the lateral foot side (i.e., a portion on the S2 side) and including a part Q2 for supporting a little toe of the wearer's foot.

Specifically, the intermediate curved plate portion 121C has a front end located in a portion corresponding to the second distal phalanx, and a rear end located in a portion corresponding to a rear end portion of each of the second metatarsal bone and the third metatarsal bone. Thus, in a plan view, the intermediate curved plate portion 121C substantially overlaps with the second distal phalanx, the second middle phalanx, the second proximal phalanx, the second metatarsal bone, and the third metatarsal bone of the wearer's foot. In FIG. 24, only the second proximal phalanx of the bones 300 of a foot is denoted by reference numeral 302.

As shown in FIG. 25, the intermediate curved plate portion 121C has an inverted arch shaped portion that protrudes toward a ground contact surface 131 of the shoe sole 100B in a cross section taken along a line orthogonal to a direction in which the intermediate curved plate portion 121C extends. In other words, the intermediate curved plate portion 121C is formed in a curved plate shape such that both ends thereof in the right-left direction are located close to an upper 200 and a central portion thereof in the right-left direction is located close to the ground contact surface 131. Also, a curved concave portion formed on the upper surface side of the intermediate curved plate portion 121C is located to extend substantially in the front-rear direction.

In such a configuration, plantarflexion of the shoe sole 100B can be effectively suppressed not only in the portion where the medial foot side curved plate portion 121A and the lateral foot side curved plate portion 121B are provided and in the vicinity thereof (i.e., the end portions in the right-left direction in each of the forefoot portion R1 and the midfoot portion R2 of the shoe sole 100B) but also in the portion of the shoe sole 100B where the intermediate curved plate portion 121C is provided and in the vicinity thereof (i.e., the central portion in the right-left direction in each of the forefoot portion R1 and the midfoot portion R2 of the shoe sole 100B). Further, at the time of kicking the ground, the medial foot side curved plate portion 121A, the lateral foot side curved plate portion 121B and the intermediate curved plate portion 121C are readily dorsiflexed. Thus, the portion of the highly rigid member 120 that corresponds to the forefoot portion R1 and the midfoot portion R2 is entirely readily dorsiflexed and thereby elastically deformed. This elastic deformation produces repulsive force to thereby produce significant propulsive force.

Therefore, by the shoe sole 100B and the shoe 1 including the shoe sole 100B according to the present embodiment, both the propulsive force at the time of kicking the ground and the stability at foot landing are improved as in the above-described first embodiment. In the present embodiment, the medial foot side curved plate portion 121A, the lateral foot side curved plate portion 121B, and the intermediate curved plate portion 121C are separately provided, and thereby can be reduced in width (i.e., reduced in size in the right-left direction). Thus, plantarflexion of the shoe sole 100B can be more effectively suppressed as compared with the case where these curved plate portions are integrated into one curved plate portion 121.

In the present embodiment, the intermediate curved plate portion 121C is configured such that its front end is located in a portion corresponding to the second distal phalanx and its rear end is located in a portion corresponding to rear end portions of the second metatarsal bone and the third metatarsal bone. However, the intermediate curved plate portion 121C may be disposed at least such that its front end is located forward of the portion corresponding to the central portion of the second proximal phalanx 302 extending in the foot length direction of the wearer's foot and its rear end is located rearward of the portion corresponding to the rear end portion of the second proximal phalanx 302 extending in the foot length direction of the wearer's foot (i.e., the portion corresponding to a metatarsophalangeal joint 310). Such a configuration allows improvement both in the propulsive force at the time of kicking the ground and in the stability at foot landing. However, also in this case, the length of the intermediate curved plate portion 121C in the front-rear direction is preferably at least 10 mm or more in order to achieve an effect of suitably suppressing plantarflexion.

Note that the intermediate curved plate portion 121C may be configured, in a plan view, not only to overlap with the second distal phalanx, the second middle phalanx, the second proximal phalanx, the second metatarsal bone, and the third metatarsal bone of the wearer's foot, but also to overlap with the third proximal phalanx. In this case, the intermediate curved plate portion 121C may be disposed at least such that its front end is located forward of the portion corresponding to a central portion of the third proximal phalanx 303 extending in the foot length direction of the wearer's foot and its rear end is located rearward of the portion corresponding to a rear end portion of the third proximal phalanx 303 extending in the foot length direction of the wearer's foot (i.e., the portion corresponding to the metatarsophalangeal joint 310).

Third Embodiment

Figure 26:
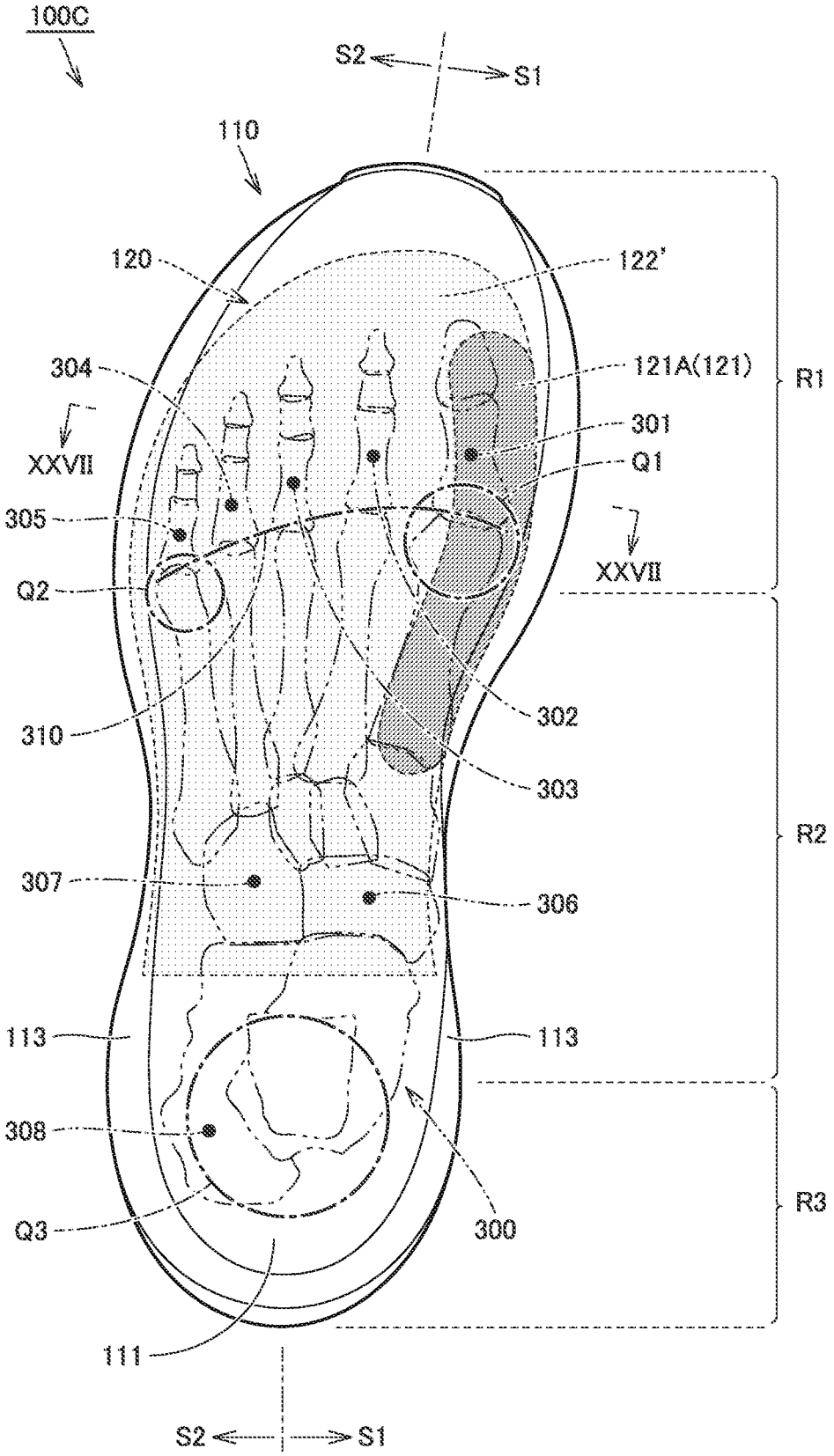
FIG. 26 is a schematic plan view of a shoe sole according to a third embodiment.
Figure 27:
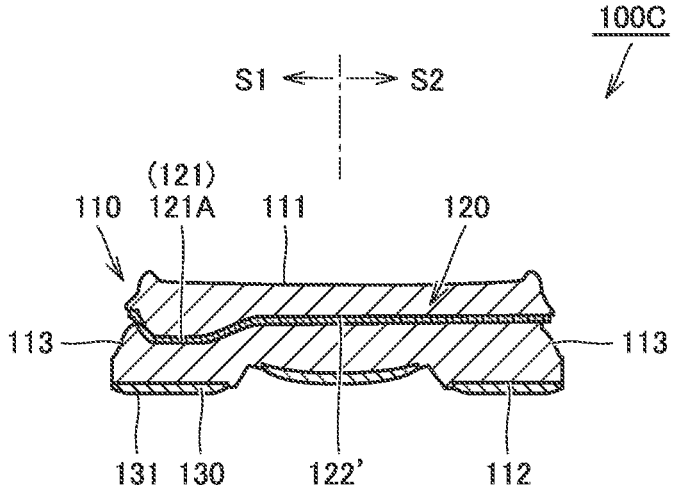
FIG. 27 is a schematic transverse cross-sectional view of the shoe sole shown in FIG. 26.

FIG. 26 is a schematic plan view of a shoe sole according to a third embodiment. FIG. 27 is a schematic transverse cross-sectional view taken along a line XXVII-XXVII shown in FIG. 26. The following describes a shoe sole 100C according to the present embodiment with reference to FIGS. 26 and 27. The shoe sole 100C according to the present embodiment is provided in the shoe 1 in place of the shoe sole 100A according to the above-described first embodiment.

As shown in FIGS. 26 and 27, when comparing the shoe sole 100C according to the present embodiment with the shoe sole 100A according to the above-described first embodiment, the shape of the highly rigid member 120 is the main difference therebetween. As in the shoe sole 100A according to the above-described first embodiment, the shoe sole 100C includes a midsole 110, a highly rigid member 120, and an outsole 130. The highly rigid member 120 may be formed of a single member and located to extend continuously from a forefoot portion R1 to a midfoot portion R2.

The highly rigid member 120 includes a curved plate portion 121 and a base plate portion 122'. The curved plate portion 121 includes only a medial foot side curved plate portion 121A. In other words, in the shoe sole 100C according to the present embodiment, the highly rigid member 120 includes, as the curved plate portion 121, only the medial foot side curved plate portion 121A having an inverted arch shaped portion that protrudes toward a ground contact surface 131 of the shoe sole 100C in a cross section taken along a line orthogonal to a direction in which the highly rigid member 120 extends, but does not include the lateral foot side curved plate portion 121B (see FIG. 2 and the like) provided in the shoe sole 100A according to the above-described first embodiment. Thus, the highly rigid member 120 is provided with the base plate portion 122' entirely formed in a substantially flat plate shape that is curved in the front-rear direction, in place of the connecting plate portion 122 provided in the shoe sole 100A according to the above-described first embodiment. In FIG. 26, the curved plate portion 121 is colored in dark gray and the base plate portion 122' is colored in light gray for the sake of easy understanding.

In such a configuration, plantarflexion of the shoe sole 100C can be effectively suppressed in the portion where the medial foot side curved plate portion 121A is provided and in the vicinity thereof (i.e., the portion on the medial foot side in each of a forefoot portion R1 and a midfoot portion R2 of the shoe sole 100C). Further, the medial foot side curved plate portion 121A is readily dorsiflexed at the time of kicking the ground. Thus, the portion of the highly rigid member 120 that corresponds to the forefoot portion R1 and the midfoot portion R2 is entirely readily dorsiflexed and thereby elastically deformed. This elastic deformation produces repulsive force to thereby produce significant propulsive force.

Therefore, by the shoe sole 100C and the shoe 1 including the shoe sole 100C according to the present embodiment, both the propulsive force at the time of kicking the ground and the stability at foot landing are improved as in the above-described first embodiment.

Fourth Embodiment

Figure 28:
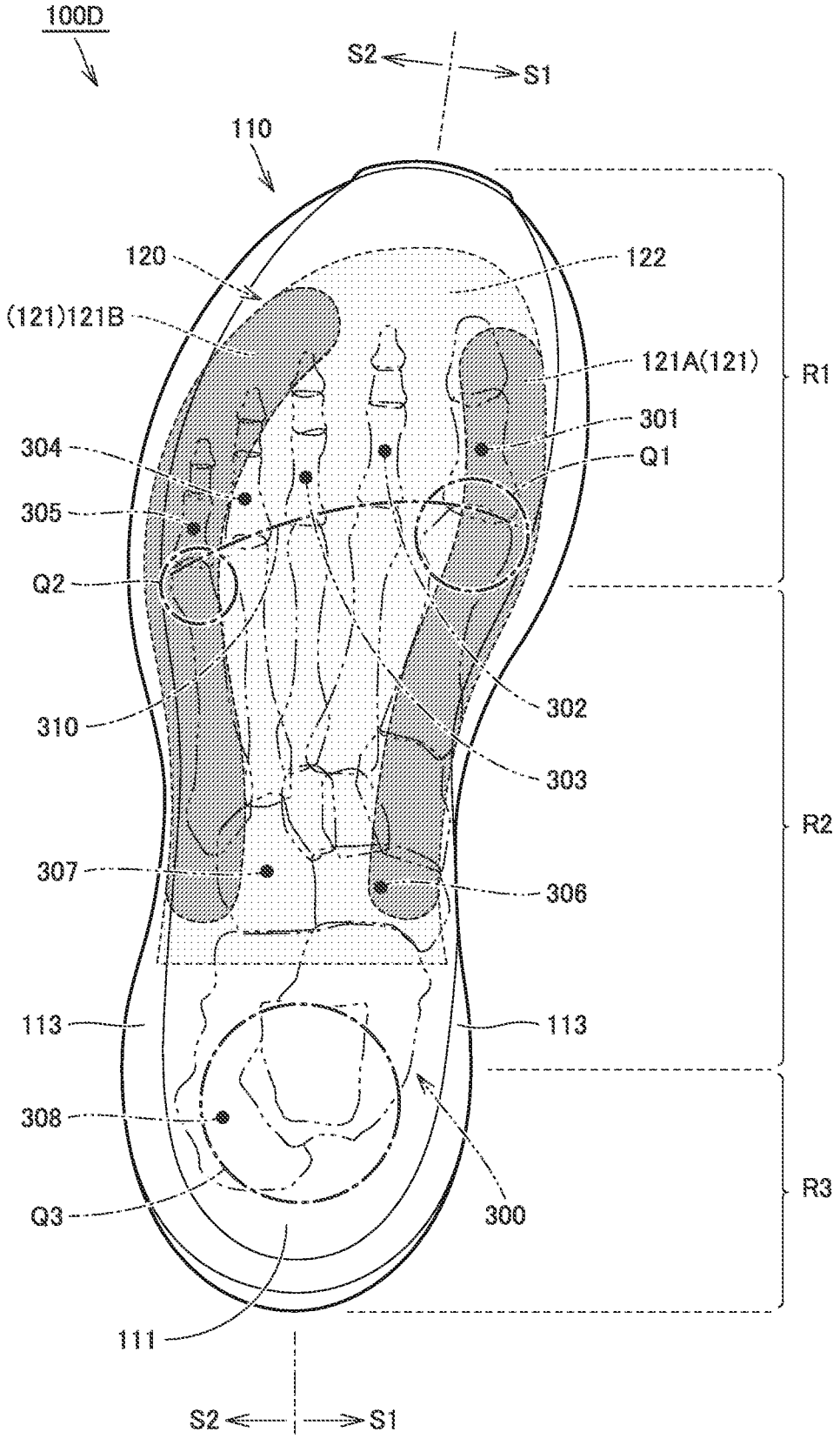
FIG. 28 is a schematic plan view of a shoe sole according to a fourth embodiment.

FIG. 28 is a schematic plan view of a shoe sole according to a fourth embodiment. The following describes a shoe sole 100D according to the present embodiment with reference to FIG. 28. The shoe sole 100D according to the present embodiment is provided in the shoe 1 in place of the shoe sole 100A according to the above-described first embodiment.

As shown in FIG. 28, when comparing the shoe sole 100D according to the present embodiment with the shoe sole 100A according to the above-described first embodiment, the shape of the highly rigid member 120 is the main difference therebetween. As in the shoe sole 100A according to the above-described first embodiment, the shoe sole 100D includes a midsole 110, a highly rigid member 120, and an outsole 130. The highly rigid member 120 may be formed of a single member and located to extend continuously from a forefoot portion R1 to a midfoot portion R2.

The highly rigid member 120 includes a curved plate portion 121 and a connecting plate portion 122. The curved plate portion 121 includes a medial foot side curved plate portion 121A and a lateral foot side curved plate portion 121B. The medial foot side curved plate portion 121A and the lateral foot side curved plate portion 121B are provided separately from each other and connected to each other through the connecting plate portion 122. In FIG. 28, the curved plate portion 121 is colored in dark gray and the connecting plate portion 122 is colored in light gray for the sake of easy understanding.

The medial foot side curved plate portion 121A is located to extend continuously from the forefoot portion R1 to the midfoot portion R2. More specifically, as in the above-described first embodiment, the medial foot side curved plate portion 121A is disposed along the portion located on the medial foot side (i.e., the portion on the S1 side) and including a part Q1 for supporting a big toe of the wearer's foot, and extends substantially in the front-rear direction of the shoe sole 100D. On the other hand, the medial foot side curved plate portion 121A is different in rear end position from that in the above-described first embodiment, and specifically, extends more rearward.

Specifically, in the present embodiment, the medial foot side curved plate portion 121A has a front end located in a portion corresponding to the first distal phalanx, and a rear end located in a portion corresponding to a navicular bone. Thus, in a plan view, the medial foot side curved plate portion 121A substantially overlaps with the first distal phalanx, the first proximal phalanx, the first metatarsal bone, a medial cuneiform bone, and the navicular bone of the wearer's foot. In FIG. 28, only the first proximal phalanx and the navicular bone of the bones 300 of a foot are denoted by reference numerals 301 and 306, respectively.

The lateral foot side curved plate portion 121B is located to extend continuously from the forefoot portion R1 to the midfoot portion R2. More specifically, as in the above-described first embodiment, the lateral foot side curved plate portion 121B is disposed along the portion located on the medial foot side (i.e., the portion on the S2 side) and including a part Q2 for supporting a little toe of the wearer's foot, and extends substantially in the front-rear direction of the shoe sole 100D. On the other hand, the lateral foot side curved plate portion 121B is different in rear end position from that in the above-described first embodiment, and specifically, extends more rearward.

Specifically, in the present embodiment, the lateral foot side curved plate portion 121B has a front end located in a portion corresponding to the third distal phalanx, and a rear end located in a portion corresponding to a cuboid bone. Therefore, in a plan view, the lateral foot side curved plate portion 121B substantially overlaps with the third distal phalanx, the fourth distal phalanx, the fourth middle phalanx, the fifth distal phalanx, the fifth middle phalanx, the fifth proximal phalanx, the fifth metatarsal bone, and the cuboid bone of the wearer's foot. In FIG. 28, only the fifth proximal phalanx and the cuboid bone of the bones 300 of a foot are denoted by reference numerals 305 and 307, respectively.

As in the above-described first embodiment, each of the medial foot side curved plate portion 121A and the lateral foot side curved plate portion 121B has an inverted arch shaped portion that protrudes toward the ground contact surface 131 of the shoe sole 100D in a cross section taken along a line orthogonal to a direction in which these curved plate portions extend. Further, the portion extending more rearward than that in the above-described first embodiment also has this inverted arch shape.

On the other hand, the connecting plate portion 122 is located to extend continuously from the forefoot portion R1 to the midfoot portion R2, and includes: a portion located between the medial foot side curved plate portion 121A and the lateral foot side curved plate portion 121B; and portions protruding forward and rearward of the portion located between the medial foot side curved plate portion 121A and the lateral foot side curved plate portion 121B.

Therefore, by the shoe sole 100D and the shoe 1 including the shoe sole 100D according to the present embodiment, both the propulsive force at the time of kicking the ground and the stability at foot landing are improved as in the above-described first embodiment. Further, the stability in the midfoot portion R2 at foot landing is enhanced to the extent that the medial foot side curved plate portion 121A and the lateral foot side curved plate portion 121B each having an inverted arch shape extend more rearward than that in the first embodiment.

Fifth Embodiment

Figure 29:
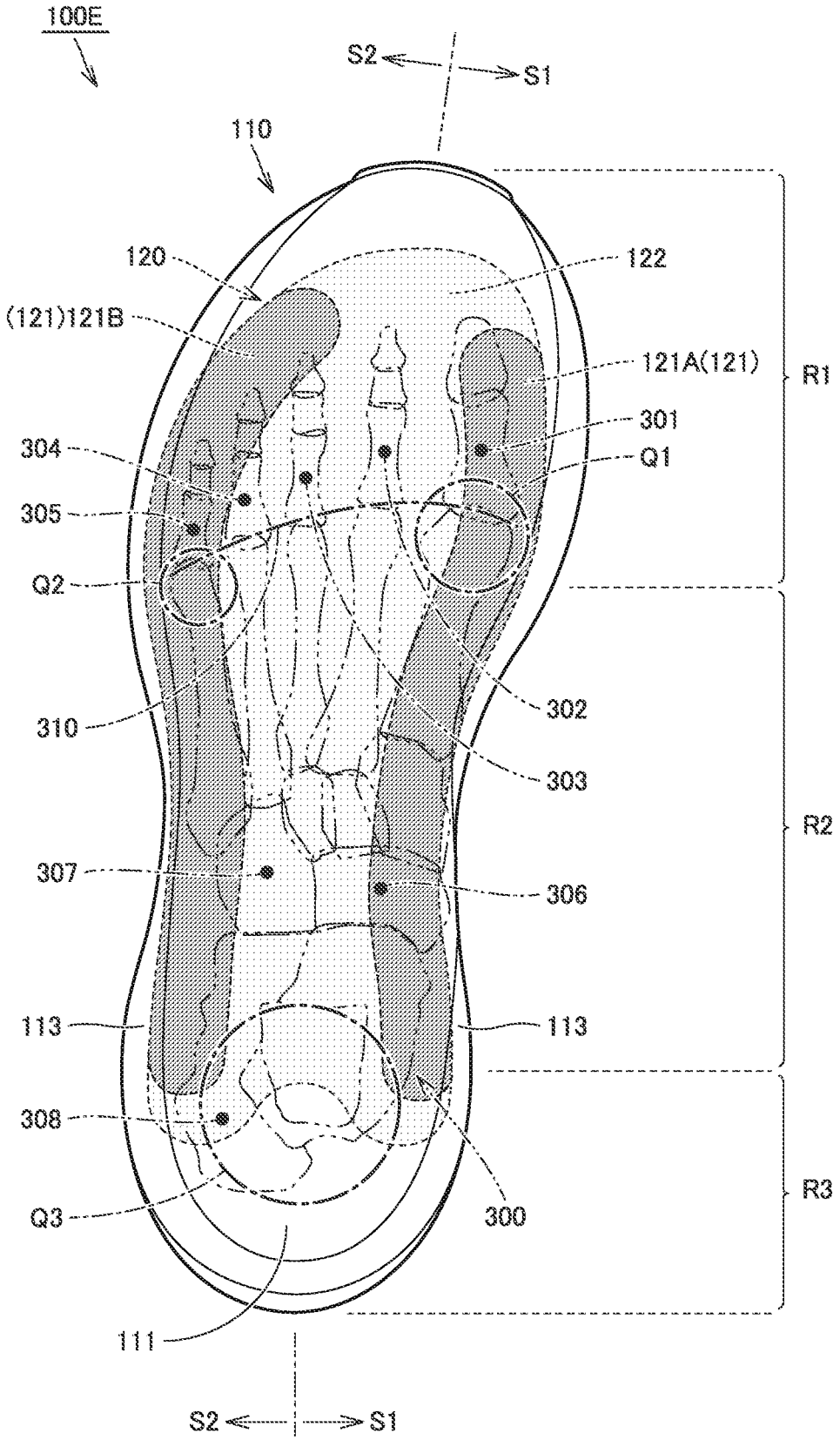
FIG. 29 is a schematic plan view of a shoe sole according to a fifth embodiment.

FIG. 29 is a schematic plan view of a shoe sole according to a fifth embodiment. The following describes a shoe sole 100E according to the present embodiment with reference to FIG. 29. The shoe sole 100E according to the present embodiment is provided in the shoe 1 in place of the shoe sole 100A according to the above-described first embodiment.

As shown in FIG. 29, when comparing the shoe sole 100E according to the present embodiment with the shoe sole 100A according to the above-described first embodiment, the shape of the highly rigid member 120 is the main difference therebetween. As in the shoe sole 100A according to the above-described first embodiment, the shoe sole 100E includes a midsole 110, a highly rigid member 120, and an outsole 130. The highly rigid member 120 may be formed of a single member and located to extend continuously from a forefoot portion R1 to a rearfoot portion R3.

The highly rigid member 120 includes a curved plate portion 121 and a connecting plate portion 122. The curved plate portion 121 includes a medial foot side curved plate portion 121A and a lateral foot side curved plate portion 121B. The medial foot side curved plate portion 121A and the lateral foot side curved plate portion 121B are provided separately from each other and connected to each other through the connecting plate portion 122. In FIG. 29, the curved plate portion 121 is colored in dark gray and the connecting plate portion 122 is colored in light gray for the sake of easy understanding.

The medial foot side curved plate portion 121A is located to extend continuously from the forefoot portion R1 through the midfoot portion R2 to the rearfoot portion R3. More specifically, as in the above-described first embodiment, the medial foot side curved plate portion 121A is disposed along the portion located on the medial foot side (i.e., the portion on the S1 side) and including a part Q1 for supporting a big toe of the wearer's foot, and extends substantially in the front-rear direction of the shoe sole 100E. On the other hand, the medial foot side curved plate portion 121A is different in rear end position from that in the above-described first embodiment, and specifically, extends more rearward.

Specifically, in the present embodiment, the medial foot side curved plate portion 121A has a front end located in a portion corresponding to the first distal phalanx, and a rear end located in a portion corresponding to a heel bone. Thus, in a plan view, the medial foot side curved plate portion 121A substantially overlaps with the first distal phalanx, the first proximal phalanx, the first metatarsal bone, the medial cuneiform bone, the navicular bone, and the heel bone of the wearer's foot, and the rear end of the medial foot side curved plate portion 121A reaches the portion on the medial foot side of a part Q3 for supporting the heel bone. In FIG. 29, only the first proximal phalanx, the navicular bone, and the heel bone of the bones 300 of a foot are denoted by reference numerals 301, 306, and 308, respectively.

The lateral foot side curved plate portion 121B is located to extend continuously from the forefoot portion R1 through the midfoot portion R2 to the rearfoot portion R3. More specifically, as in the above-described first embodiment, the lateral foot side curved plate portion 121B is disposed along the portion located on the medial foot side (i.e., the portion on the S2 side) and including a part Q2 for supporting a little toe of the wearer's foot, and extends substantially in the front-rear direction of the shoe sole 100E. On the other hand, the lateral foot side curved plate portion 121B is different in rear end position from that in the above-described first embodiment, and specifically, extends more rearward.

Specifically, in the present embodiment, the lateral foot side curved plate portion 121B has a front end located in a portion corresponding to the third distal phalanx, and a rear end located in a portion corresponding to the heel bone. Thus, in a plan view, the lateral foot side curved plate portion 121B substantially overlaps with the third distal phalanx, the fourth distal phalanx, the fourth middle phalanx, the fifth distal phalanx, the fifth middle phalanx, the fifth proximal phalanx, the fifth metatarsal bone, the cuboid bone, and the heel bone of the wearer's foot. Also, the rear end of the lateral foot side curved plate portion 121B reaches the portion located on the lateral foot side in the part Q3 for supporting the heel bone. In FIG. 29, only the fifth proximal phalanx, the cuboid bone, and the heel bone of the bones 300 of a foot are denoted by reference numerals 305, 307, and 308, respectively.

As in the above-described first embodiment, each of the medial foot side curved plate portion 121A and the lateral foot side curved plate portion 121B has an inverted arch shape protruding toward a ground contact surface 131 of the shoe sole 100E in a cross section taken along a line orthogonal to a direction in which these curved plate portions extend. Further, the portion extending more rearward than that in the above-described first embodiment also has this inverted arch shape.

On the other hand, the connecting plate portion 122 is located to extend continuously from the forefoot portion R1 to the rearfoot portion R3, and includes: a portion located between the medial foot side curved plate portion 121A and the lateral foot side curved plate portion 121B; and portions protruding forward and rearward of the portion located between the medial foot side curved plate portion 121A and the lateral foot side curved plate portion 121B.

Therefore, by the shoe sole 100E and the shoe 1 including the shoe sole 100E according to the present embodiment, both the propulsive force at the time of kicking the ground and the stability at foot landing are improved as in the above-described first embodiment. Further, the stability in the midfoot portion R2 and the rearfoot portion R3 at foot landing is enhanced to the extent that the medial foot side curved plate portion 121A and the lateral foot side curved plate portion 121B each having an inverted arch shape extend more rearward than that in the first embodiment.

Sixth Embodiment

Figure 30:
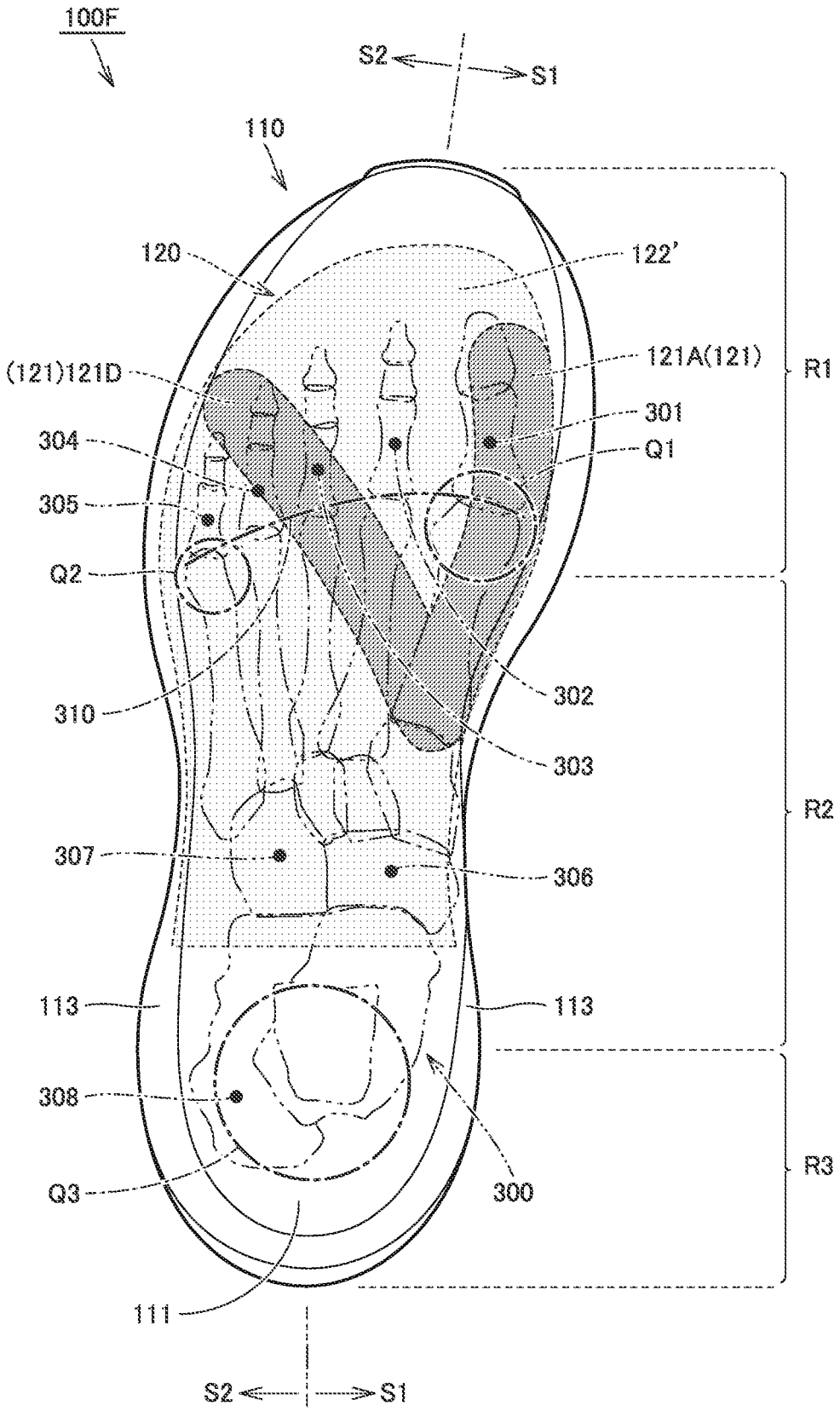
FIG. 30 is a schematic plan view of a shoe sole according to a sixth embodiment.

FIG. 30 is a schematic plan view of a shoe sole according to a sixth embodiment. The following describes a shoe sole 100F according to the present embodiment with reference to FIG. 30. The shoe sole 100F according to the present embodiment is provided in the shoe 1 in place of the shoe sole 100A according to the above-described first embodiment.

As shown in FIG. 30, when comparing the shoe sole 100F according to the present embodiment with the shoe sole 100A according to the above-described first embodiment, the shape of the highly rigid member 120 is the main difference therebetween. The shoe sole 100F includes a midsole 110, a highly rigid member 120, and an outsole 130 as in the shoe sole 100A according to the above-described first embodiment. The highly rigid member 120 may be formed of a single member and located to extend continuously from a forefoot portion R1 to a midfoot portion R2.

The highly rigid member 120 includes a curved plate portion 121 and a base plate portion 122'. The curved plate portion 121 includes a medial foot side curved plate portion 121A and a first diagonally curved plate portion 121D. The medial foot side curved plate portion 121A and the first diagonally curved plate portion 121D are connected to each other at their rear ends in the front-rear direction. Thus, in place of the connecting plate portion 122 provided in the shoe sole 100A according to the above-described first embodiment, the highly rigid member 120 includes a base plate portion 122' entirely formed in a substantially flat plate shape that is curved in the front-rear direction. The base plate portion 122' has: a portion located between the medial foot side curved plate portion 121A and the first diagonally curved plate portion 121D; a portion protruding forward of the medial foot side curved plate portion 121A and the first diagonally curved plate portion 121D; and a portion protruding rearward of the medial foot side curved plate portion 121A and the first diagonally curved plate portion 121D. In FIG. 30, the curved plate portion 121 is colored in dark gray and the base plate portion 122' is colored in light gray for the sake of easy understanding.

The medial foot side curved plate portion 121A is located to extend continuously from a forefoot portion R1 to a midfoot portion R2. More specifically, as in the above-described first embodiment, the medial foot side curved plate portion 121A is disposed along the portion located on the medial foot side (i.e., the portion on the S1 side) and including a part Q1 for supporting a big toe of the wearer's foot, and extends substantially in the front-rear direction of the shoe sole 100F.

The first diagonally curved plate portion 121D is located to extend continuously from the forefoot portion R1 to the midfoot portion R2. More specifically, the first diagonally curved plate portion 121D is disposed diagonally such that the distance from the edge portion of the shoe sole on the lateral foot side (i.e., the edge portion on the S2 side shown in the figure) increases from the front side toward the rear side in the front-rear direction. Thus, the first diagonally curved plate portion 121D extends in the diagonal direction.

Specifically, the first diagonally curved plate portion 121D has a front end located in a portion corresponding to the fourth distal phalanx, and a rear end located in a portion corresponding to a rear end portion of the first metatarsal bone. Thus, in a plan view, the first diagonally curved plate portion 121D substantially overlaps with the fourth distal phalanx, the fourth middle phalanx, the fourth proximal phalanx, the third proximal phalanx, the third metatarsal bone, the second metatarsal bone, and the first metatarsal bone of the wearer's foot.

The first diagonally curved plate portion 121D has an inverted arch shaped portion that protrudes toward a ground contact surface 131 of the shoe sole 100F in a cross section taken along a line orthogonal to the direction in which the first diagonally curved plate portion 121D extends. In other words, the first diagonally curved plate portion 121D is formed in a curved plate shape such that both ends thereof in the right-left direction are located close to an upper 200 and a central portion thereof in the right-left direction is located close to the ground contact surface 131. Also, a curved concave portion formed on the upper surface side of the first diagonally curved plate portion 121D is located to extend in the above-mentioned diagonal direction.

In such a configuration, plantarflexion of the shoe sole 100F can be effectively suppressed not only in the portion where the medial foot side curved plate portion 121A is provided and in the vicinity thereof (i.e., the portion on the medial foot side in each of the forefoot portion R1 and the midfoot portion R2 of the shoe sole 100F) but also in the portion where the first diagonally curved plate portion 121D is provided and in the vicinity thereof (i.e., the portion on the lateral foot side in the forefoot portion R1 of the shoe sole 100F and the central portion in the right-left direction in each of the forefoot portion R1 and the midfoot portion R2 of the shoe sole 100F). Also, at the time of kicking the ground, the medial foot side curved plate portion 121A and the first diagonally curved plate portion 121D are readily dorsiflexed. Thus, the portion of the highly rigid member 120 that corresponds to the forefoot portion R1 and the midfoot portion R2 is entirely readily dorsiflexed and thereby elastically deformed. This elastic deformation produces repulsive force to thereby produce significant propulsive force.

Therefore, by the shoe sole 100F and the shoe 1 including the shoe sole 100F according to the present embodiment, both the propulsive force at the time of kicking the ground and the stability at foot landing are improved as in the above-described first embodiment. In addition, in the shoe sole 100F according to the present embodiment, the first diagonally curved plate portion 121D is provided in addition to the medial foot side curved plate portion 121A, and thereby, the bending direction of the shoe sole 100F at the time of kicking the ground can be controlled to be further toward a big toe. Thus, what is called excessive supination of the wearer's foot can be suppressed, with the result that the forward propulsion efficiency can be further enhanced.

In addition, from the viewpoint of suppressing such excessive supination, the first diagonally curved plate portion 121D may be disposed at least such that its front end is located in a portion corresponding to the fourth proximal phalanx or the fifth proximal phalanx and its rear end is located in a portion corresponding to the rear end portion of the first metatarsal bone.

Seventh Embodiment

Figure 31:
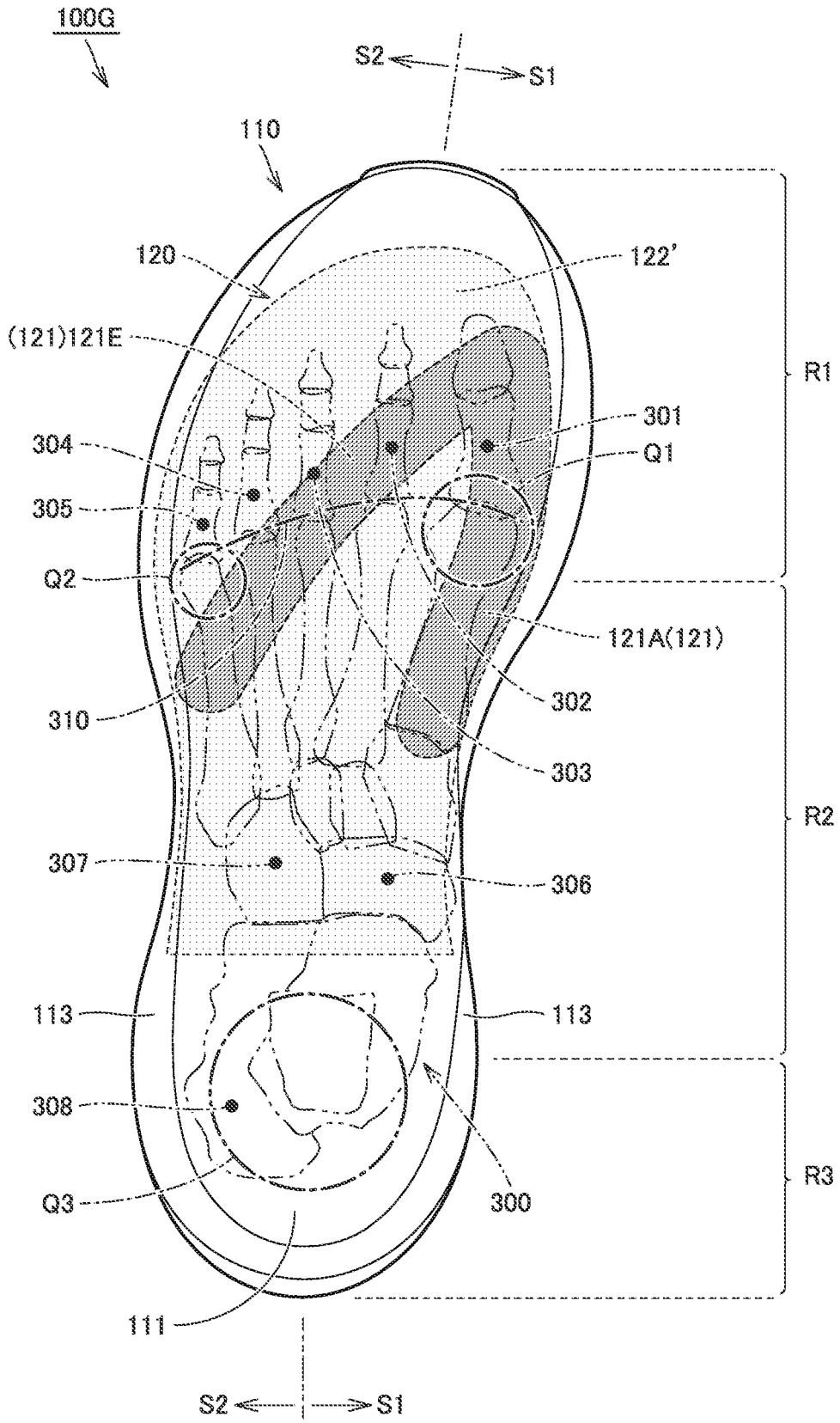
FIG. 31 is a schematic plan view of a shoe sole according to a seventh embodiment.

FIG. 31 is a schematic plan view of a shoe sole according to a seventh embodiment. The following describes a shoe sole 100G according to the present embodiment with reference to FIG. 31. The shoe sole 100G according to the present embodiment is provided in the shoe 1 in place of the shoe sole 100A according to the above-described first embodiment.

As shown in FIG. 31, when comparing the shoe sole 100G according to the present embodiment with the shoe sole 100A according to the above-described first embodiment, the shape of the highly rigid member 120 is the main difference therebetween. As in the shoe sole 100A according to the above-described first embodiment, the shoe sole 100G includes a midsole 110, a highly rigid member 120, and an outsole 130. The highly rigid member 120 may be formed of a single member and located to extend continuously from a forefoot portion R1 to a midfoot portion R2.

The highly rigid member 120 includes a curved plate portion 121 and a base plate portion 122'. The curved plate portion 121 includes a medial foot side curved plate portion 121A and a second diagonally curved plate portion 121E. The medial foot side curved plate portion 121A and the second diagonally curved plate portion 121E are connected to each other at their front ends in the front-rear direction. Accordingly, in place of the connecting plate portion 122 provided in the shoe sole 100A according to the above-described first embodiment, the highly rigid member 120 includes a base plate portion 122' entirely formed in a substantially flat plate shape that is curved in the front-rear direction. The base plate portion 122' has: a portion located between the medial foot side curved plate portion 121A and the second diagonally curved plate portion 121E; a portion protruding forward of the medial foot side curved plate portion 121A and the second diagonally curved plate portion 121E; and a portion protruding rearward of the medial foot side curved plate portion 121A and the second diagonally curved plate portion 121E. In FIG. 31, the curved plate portion 121 is colored in dark gray and the base plate portion 122' is colored in light gray for the sake of easy understanding.

The medial foot side curved plate portion 121A is located to extend continuously from the forefoot portion R1 to the midfoot portion R2. More specifically, as in the above-described first embodiment, the medial foot side curved plate portion 121A is disposed along the portion located on the medial foot side (i.e., the portion on the S1 side) and including a part Q1 for supporting a big toe of the wearer's foot, and extends substantially in the front-rear direction of the shoe sole 100G.

The second diagonally curved plate portion 121E is located to extend continuously from the forefoot portion R1 to the midfoot portion R2. More specifically, the second diagonally curved plate portion 121E is disposed diagonally such that the distance from the edge portion of the shoe sole on the medial foot side (i.e., the edge portion on the S1 side shown in the figure) increases from the front side toward the rear side in the front-rear direction. Thus, the second diagonally curved plate portion 121E extends in the diagonal direction.

Specifically, the second diagonally curved plate portion 121E has a front end located in a portion corresponding to the first distal phalanx, and a rear end located in a portion corresponding to a central portion of the fifth metatarsal bone in the front-rear direction. Thus, in a plan view, the second diagonally curved plate portion 121E substantially overlaps with the first distal phalanx, the first proximal phalanx, the second middle phalanx, the second proximal phalanx, the third proximal phalanx, the third metatarsal bone, the fourth metatarsal bone, and the fifth metatarsal bone of the wearer's foot.

The second diagonally curved plate portion 121E has an inverted arch shaped portion that protrudes toward a ground contact surface 131 of the shoe sole 100G in a cross section taken along a line orthogonal to a direction in which the second diagonally curved plate portion 121E extends. In other words, the second diagonally curved plate portion 121E is formed in a curved plate shape such that both ends thereof in the right-left direction are located close to an upper 200 and a central portion thereof in the right-left direction is located close to the ground contact surface 131. Also, a curved concave portion formed on the upper surface side of the second diagonally curved plate portion 121E is located to extend in the above-mentioned diagonal direction.

In such a configuration, plantarflexion of the shoe sole 100G can be effectively suppressed not only in the portion where the medial foot side curved plate portion 121A is provided and in the vicinity thereof (i.e., the portion on the medial foot side in each of the forefoot portion R1 and the midfoot portion R2 of the shoe sole 100G) but also in the portion where the second diagonally curved plate portion 121E is provided and in the vicinity thereof (i.e., the portion on the medial foot side and the central portion in the right-left direction in the forefoot portion R1 of the shoe sole 100G, and the portion on the lateral foot side in the midfoot portion R2 of the shoe sole 100G). Also, at the time of kicking the ground, the medial foot side curved plate portion 121A and the second diagonally curved plate portion 121E are readily dorsiflexed. Thus, the portion of the highly rigid member 120 that corresponds to the forefoot portion R1 and the midfoot portion R2 is entirely readily dorsiflexed and thereby elastically deformed. This elastic deformation produces repulsive force to thereby produce significant propulsive force.

Therefore, by the shoe sole 100G and the shoe 1 including the shoe sole 100G according to the present embodiment, both the propulsive force at the time of kicking the ground and the stability at foot landing are improved as in the above-described first embodiment. In addition, in the shoe sole 100G according to the present embodiment, the second diagonally curved plate portion 121E is provided in addition to the medial foot side curved plate portion 121A, and thereby, the bending direction of the shoe sole 100G at the time of kicking the ground can be controlled to be further toward a little toe. Thus, what is called excessive pronation of the wearer's foot can be suppressed, with the result that the forward propulsion efficiency can be further enhanced.

From the viewpoint of suppressing such excessive pronation, the second diagonally curved plate portion 121E may be disposed at least such that its front end is located in a portion corresponding to the first proximal phalanx and its rear end is located in a portion corresponding to a central portion of the fourth metatarsal bone in the front-rear direction or a central portion of the fifth metatarsal bone in the front-rear direction.

Eighth Embodiment

Figure 32:
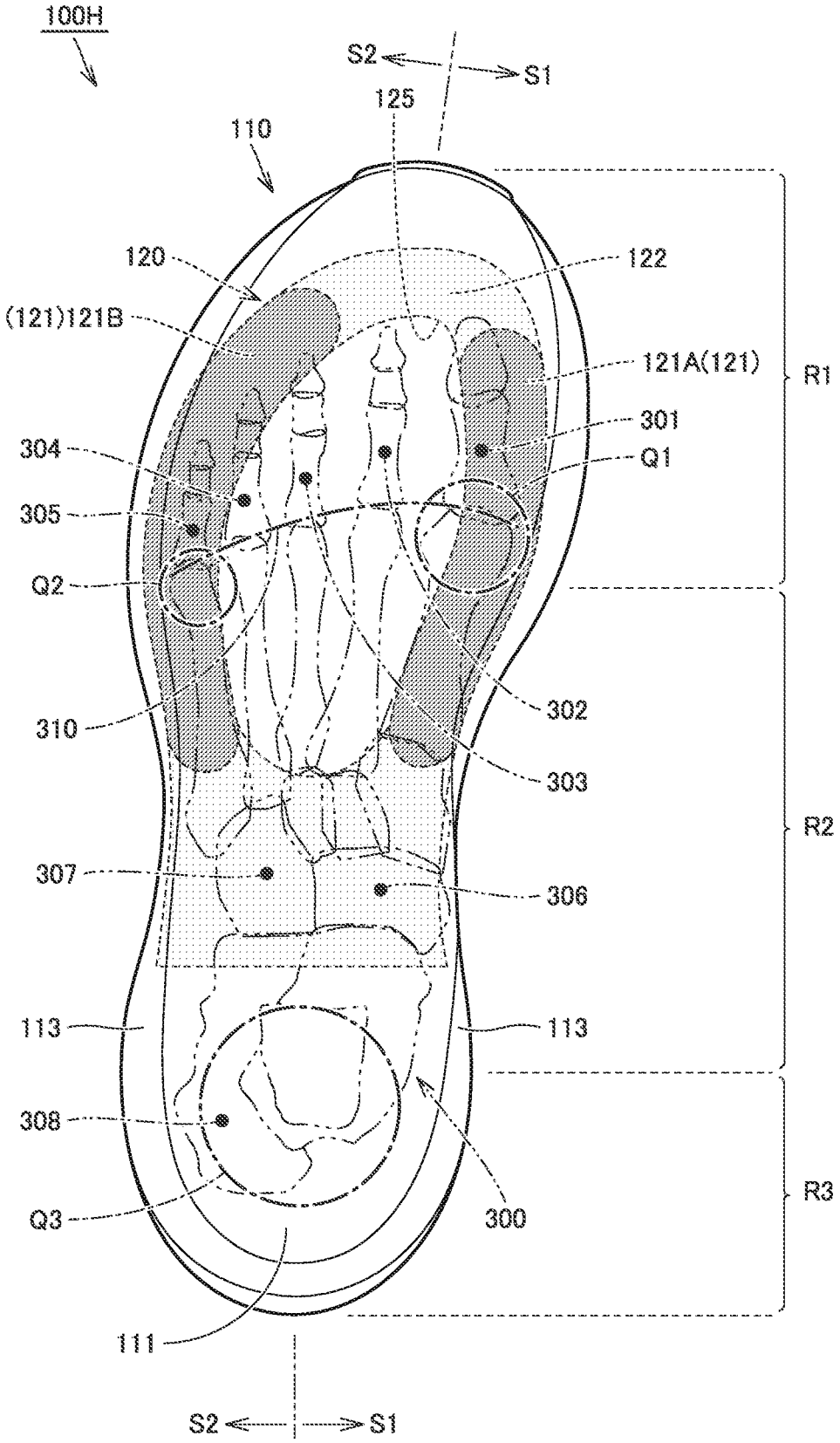
FIG. 32 is a schematic plan view of a shoe sole according to an eighth embodiment.

FIG. 32 is a schematic plan view of a shoe sole according to an eighth embodiment. The following describes a shoe sole 100H according to the present embodiment with reference to FIG. 32. The shoe sole 100H according to the present embodiment is provided in the shoe 1 in place of the shoe sole 100A according to the above-described first embodiment.

As shown in FIG. 32, when comparing the shoe sole 100H according to the present embodiment with the shoe sole 100A according to the above-described first embodiment, the shape of the highly rigid member 120 is the main difference therebetween. Specifically, in the shoe sole 100H, the highly rigid member 120 has: a medial foot side curved plate portion 121A and a lateral foot side curved plate portion 121B as a curved plate portion 121; and a connecting plate portion 122 as in the above-described first embodiment, but the connecting plate portion 122 is different in configuration. In FIG. 32, the curved plate portion 121 is colored in dark gray and the connecting plate portion 122 is colored in light gray for the sake of easy understanding.

More specifically, the connecting plate portion 122 includes only portions protruding forward and rearward of the portion located between the medial foot side curved plate portion 121A and the lateral foot side curved plate portion 121B. In other words, unlike the above-described first embodiment, the connecting plate portion 122 does not include the portion located between the medial foot side curved plate portion 121A and the lateral foot side curved plate portion 121B (see FIG. 2 and the like), but is provided with an opening 125 in this portion.

Also in such a configuration, the shoe sole 100H includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, in the case of the shoe sole 100H and the shoe 1 including the shoe sole 100H according to the present embodiment, the highly rigid member 120 is provided with the opening 125, thereby allowing significant weight reduction.

Ninth Embodiment

Figure 33:
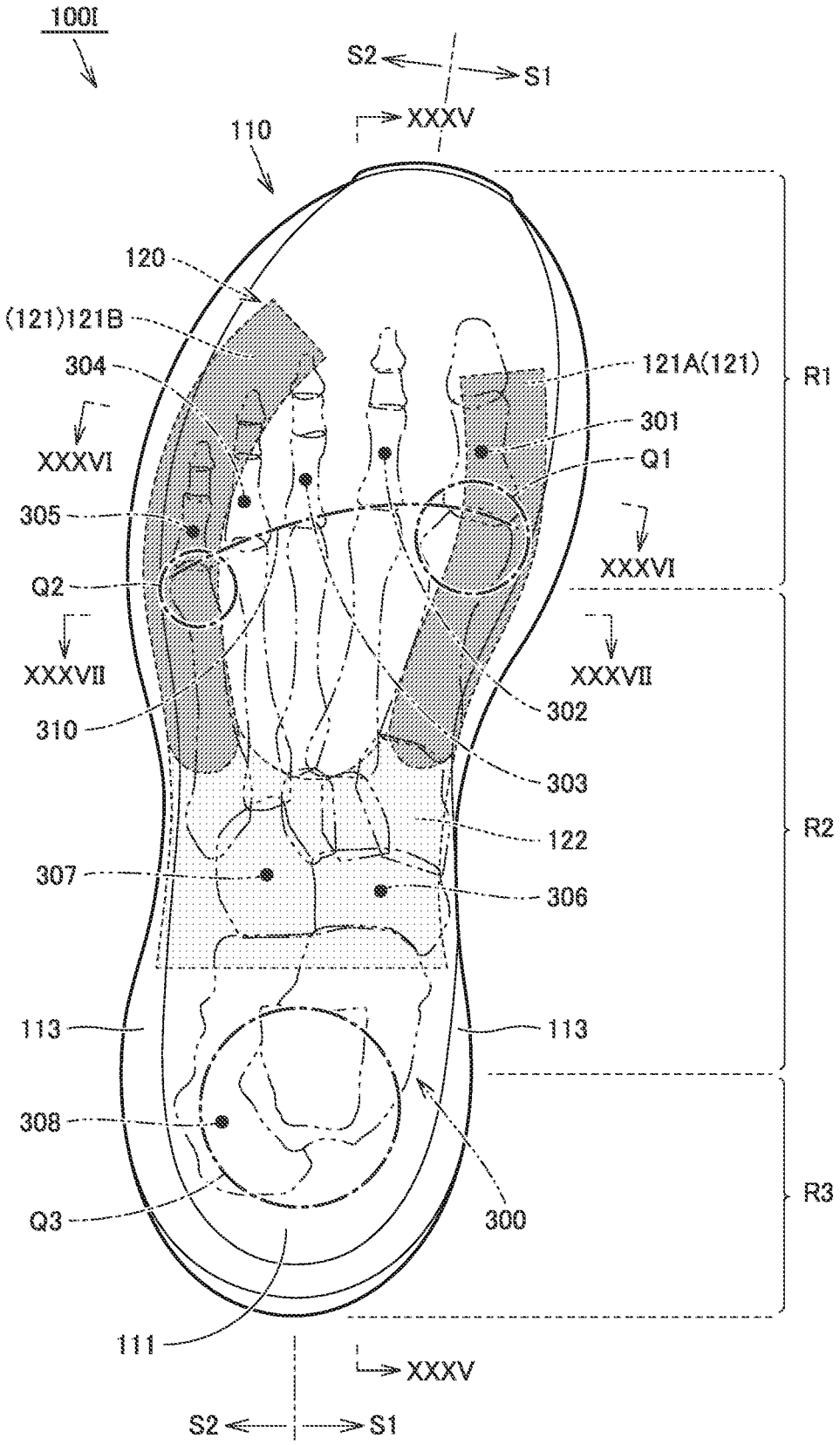
FIG. 33 is a schematic plan view of a shoe sole according to a ninth embodiment.
Figure 34:
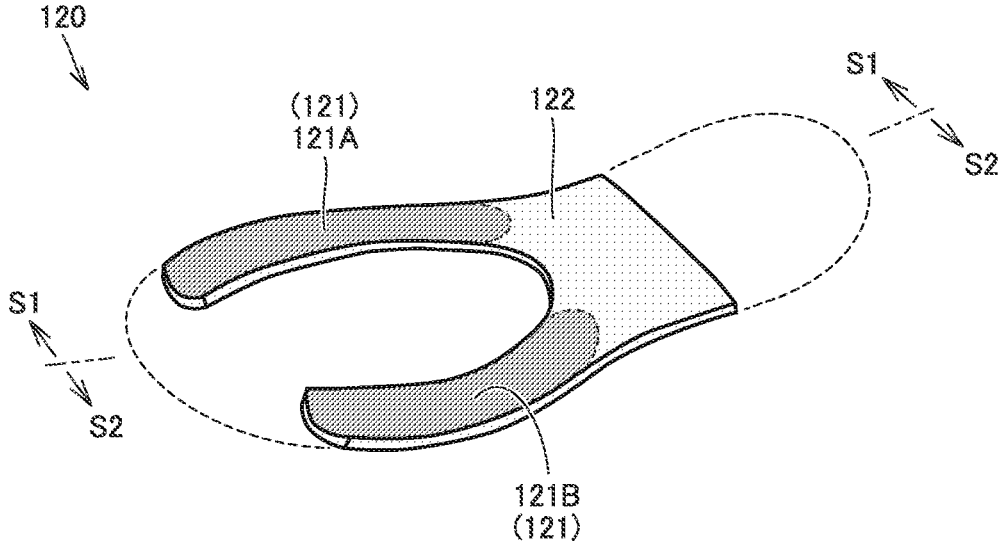
FIG. 34 is a schematic perspective view of a highly rigid member shown in FIG. 33.
Figure 35:
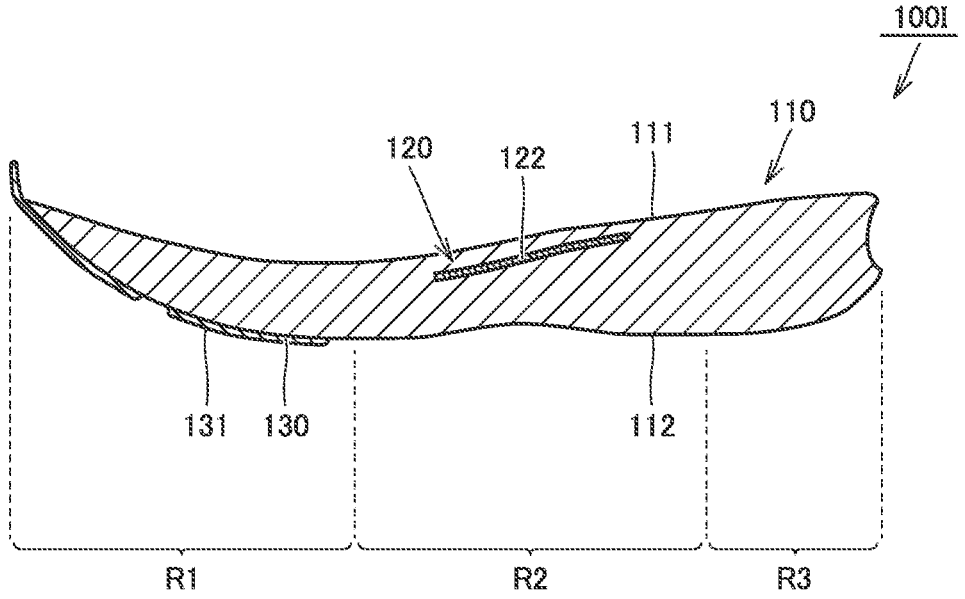
FIG. 35 is a schematic longitudinal cross-sectional view of the shoe sole shown in FIG. 33.
Figure 36:
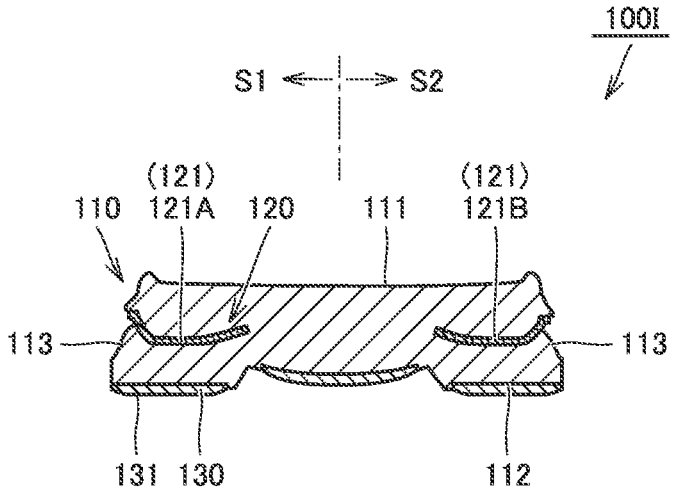
FIG. 36 is a schematic transverse cross-sectional view of the shoe sole shown in FIG. 33.
Figure 37:
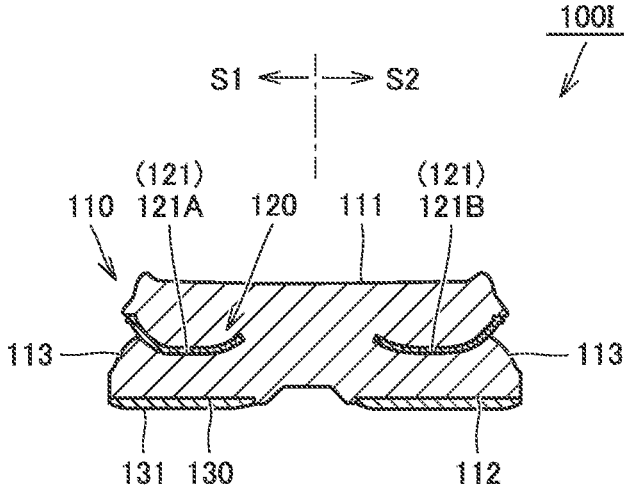
FIG. 37 is a schematic transverse cross-sectional view of the shoe sole shown in FIG. 33.

FIG. 33 is a schematic plan view of a shoe sole according to a ninth embodiment. FIG. 34 is a schematic perspective view of a highly rigid member shown in FIG. 33. FIG. 35 is a schematic longitudinal cross-sectional view taken along a line XXXV-XXXV shown in FIG. 33. FIGS. 36 and 37 are schematic transverse cross-sectional views taken along lines XXXVI-XXXVI and XXXVII-XXXVII, respectively, shown in FIG. 33. The following describes a shoe sole 100I according to the present embodiment with reference to FIGS. 33 to 37. The shoe sole 100I according to the present embodiment is provided in the shoe 1 in place of the shoe sole 100A according to the above-described first embodiment.

As shown in FIGS. 33 to 37, when comparing the shoe sole 100I according to the present embodiment with the shoe sole 100A according to the above-described first embodiment, the shape of the highly rigid member 120 is the main difference therebetween. Specifically, in the shoe sole 100I, the highly rigid member 120 has: a medial foot side curved plate portion 121A and a lateral foot side curved plate portion 121B as a curved plate portion 121; and a connecting plate portion 122 as in the above-described first embodiment, but the connecting plate portion 122 is different in configuration.

More specifically, particularly referring to FIG. 34, the connecting plate portion 122 includes only a portion protruding rearward of a portion located between the medial foot side curved plate portion 121A and the lateral foot side curved plate portion 121B. In other words, unlike the above-described first embodiment, the connecting plate portion 122 does not include: a portion located between the medial foot side curved plate portion 121A and the lateral foot side curved plate portion 121B (see FIG. 2 and the like); and a portion protruding forward of the portion located between the medial foot side curved plate portion 121A and the lateral foot side curved plate portion 121B (see FIG. 2 and the like). Also, each of the medial foot side curved plate portion 121A and the lateral foot side curved plate portion 121B is located to protrude forward from the front end of the connecting plate portion 122. In FIGS. 33 to 34, the curved plate portion 121 is colored in dark gray and the connecting plate portion 122 is colored in light gray for the sake of easy understanding.

As shown in FIGS. 36 and 37, each of the medial foot side curved plate portion 121A and the lateral foot side curved plate portion 121B that are disposed to protrude forward from the connecting plate portion 122 has an inverted arch shaped portion that protrudes toward a ground contact surface 131 of the shoe sole 100I in a cross section taken along a line orthogonal to a direction in which these curved plate portions extend, as in the above-described first embodiment.

On the other hand, as shown in FIGS. 35 to 37, the connecting plate portion 122 is entirely formed in a substantially flat plate shape that is slightly curved in the front-rear direction. Although not explicitly shown in the figures, the medial foot side curved plate portion 121A and the lateral foot side curved plate portion 121B each are curved in the front-rear direction to be continuous from the connecting plate portion 122, and more specifically, each have a curved plate shape such that both ends thereof in the front-rear direction are located close to an upper 200 and a central portion thereof in the front-rear direction is located close to the ground contact surface 131 as in the first embodiment.

Also in such a configuration, the shoe sole 100I includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, the shoe sole 100I and the shoe 1 including the shoe sole 100I according to the present embodiment includes, as the connecting plate portion 122, only a portion protruding rearward of the portion located between the medial foot side curved plate portion 121A and the lateral foot side curved plate portion 121B, thereby allowing significant weight reduction.

Tenth Embodiment

Figure 38:
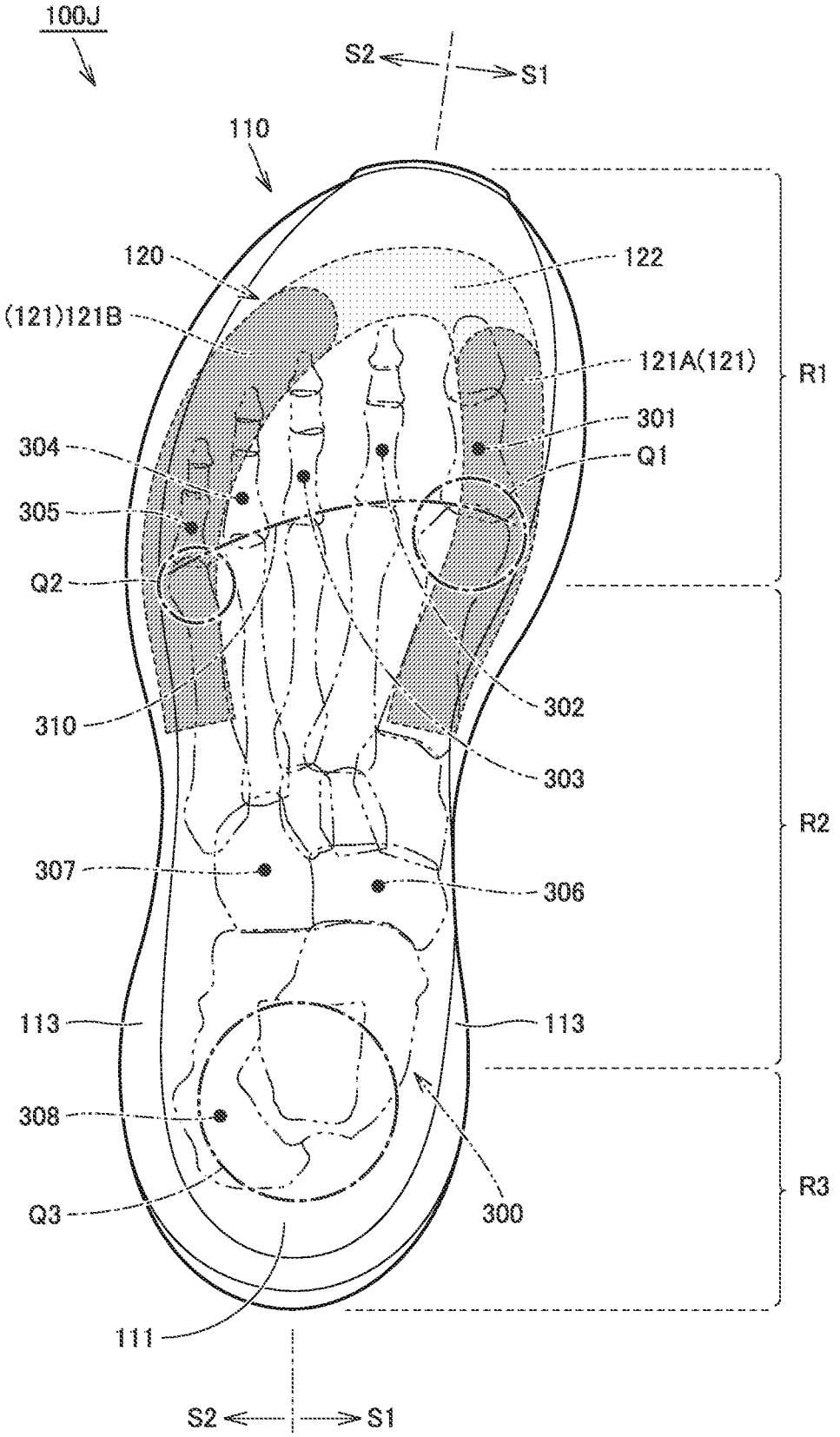
FIG. 38 is a schematic plan view of a shoe sole according to a tenth embodiment.

FIG. 38 is a schematic plan view of a shoe sole according to a tenth embodiment. The following describes a shoe sole 100J according to the present embodiment with reference to FIG. 38. The shoe sole 100J according to the present embodiment is provided in the shoe 1 in place of the shoe sole 100A according to the above-described first embodiment.

As shown in FIG. 38, when comparing the shoe sole 100J according to the present embodiment with the shoe sole 100A according to the above-described first embodiment, the shape of the highly rigid member 120 is the main difference therebetween. Specifically, in the shoe sole 100J, the highly rigid member 120 has: a medial foot side curved plate portion 121A and a lateral foot side curved plate portion 121B as a curved plate portion 121; and a connecting plate portion 122 as in the above-described first embodiment, but the connecting plate portion 122 is different in configuration.

More specifically, the connecting plate portion 122 includes only a portion protruding forward of the portion located between the medial foot side curved plate portion 121A and the lateral foot side curved plate portion 121B. In other words, unlike the above-described first embodiment, the connecting plate portion 122 does not include: the portion located between the medial foot side curved plate portion 121A and the lateral foot side curved plate portion 121B (see FIG. 2 and the like); and the portion protruding rearward of the portion located between the medial foot side curved plate portion 121A and the lateral foot side curved plate portion 121B (see FIG. 2 and the like). The medial foot side curved plate portion 121A and the lateral foot side curved plate portion 121B each are located to protrude rearward from the rear end of the connecting plate portion 122. In FIG. 38, the curved plate portion 121 is colored in dark gray and the connecting plate portion 122 is colored in light gray for the sake of easy understanding.

Also in such a configuration, the shoe sole 100J includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, the shoe sole 100J and the shoe 1 including the shoe sole 100J according to the present embodiment includes, as the connecting plate portion 122, only a portion protruding forward of the portion located between the medial foot side curved plate portion 121A and the lateral foot side curved plate portion 121B as described above, thereby allowing significant weight reduction.

Eleventh Embodiment

Figure 39:
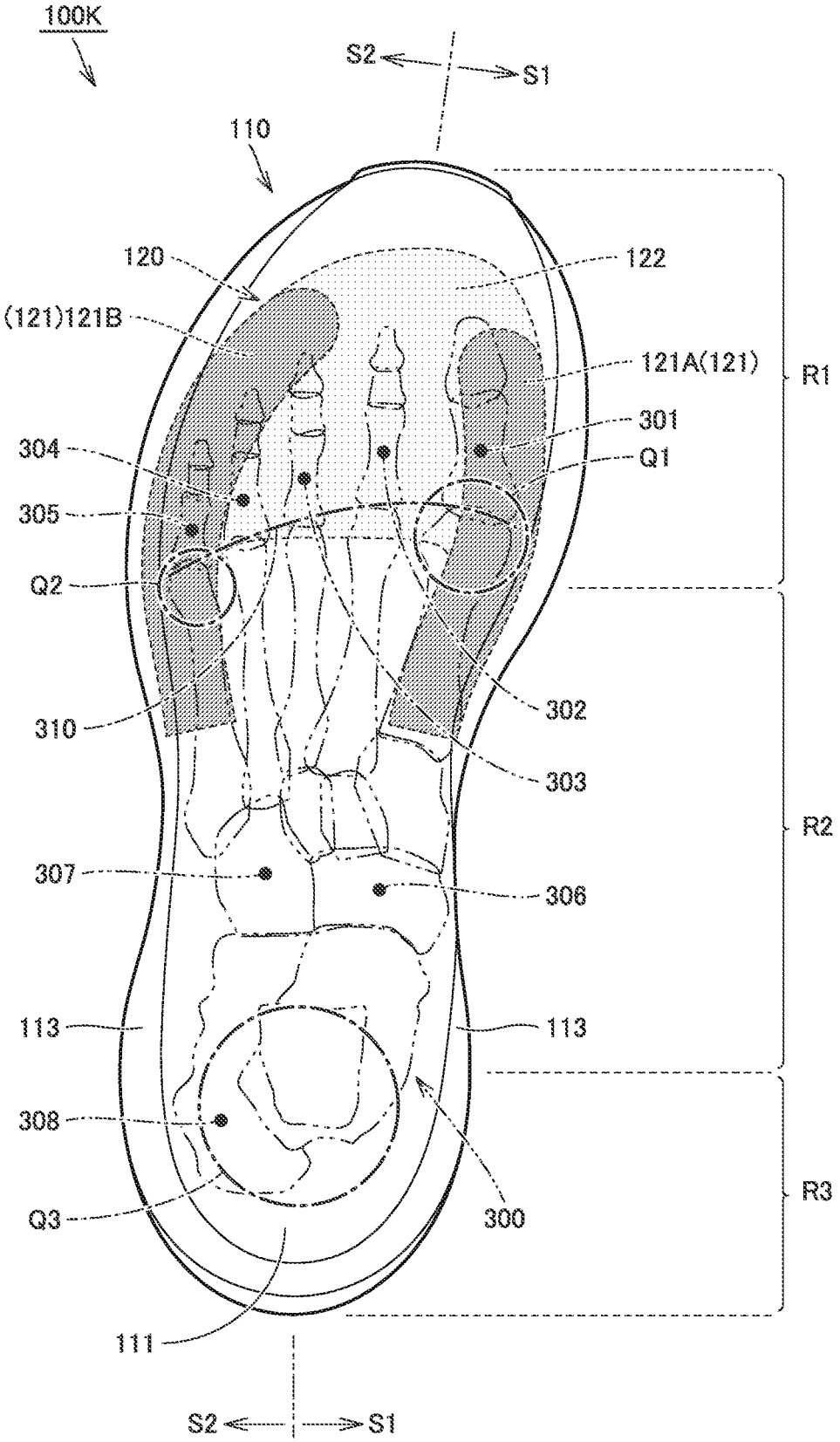
FIG. 39 is a schematic plan view of a shoe sole according to an eleventh embodiment.

FIG. 39 is a schematic plan view of a shoe sole according to an eleventh embodiment. The following describes a shoe sole 100K according to the present embodiment with reference to FIG. 39. The shoe sole 100K according to the present embodiment is provided in the shoe 1 in place of the shoe sole 100A according to the above-described first embodiment.

As shown in FIG. 39, when comparing the shoe sole 100K according to the present embodiment with the shoe sole 100A according to the above-described first embodiment, the shape of the highly rigid member 120 is the main difference therebetween. Specifically, in the shoe sole 100K, the highly rigid member 120 has: a medial foot side curved plate portion 121A and a lateral foot side curved plate portion 121B as a curved plate portion 121; and a connecting plate portion 122 as in the above-described first embodiment, but the connecting plate portion 122 is different in configuration.

More specifically, the connecting plate portion 122 includes only: a portion located between the medial foot side curved plate portion 121A and the lateral foot side curved plate portion 121B; and a portion protruding forward of the portion located between the medial foot side curved plate portion 121A and the lateral foot side curved plate portion 121B. In other words, unlike the above-described first embodiment, the connecting plate portion 122 does not include a portion protruding rearward of the portion located between the medial foot side curved plate portion 121A and the lateral foot side curved plate portion 121B (see FIG. 2 and the like). Further, unlike the above-described first embodiment, the portion located between the medial foot side curved plate portion 121A and the lateral foot side curved plate portion 121B is provided only in the portion corresponding to the forefoot portion R1 but is not provided in the portion corresponding to the midfoot portion R2. In FIG. 39, the curved plate portion 121 is colored in dark gray and the connecting plate portion 122 is colored in light gray for the sake of easy understanding.

Also in such a configuration, the shoe sole 100K includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, in the case of the shoe sole 100K and the shoe 1 including the shoe sole 100K according to the present embodiment, as described above, the connecting plate portion 122 is provided only in the portion corresponding to the forefoot portion R1 but not provided in the portion corresponding to the midfoot portion R2, in the portion located between the medial foot side curved plate portion 121A and the lateral foot side curved plate portion 121B. Thereby, weight reduction can be achieved while improving the stability in the forefoot portion R1 at foot landing.

Twelfth Embodiment

Figure 40:
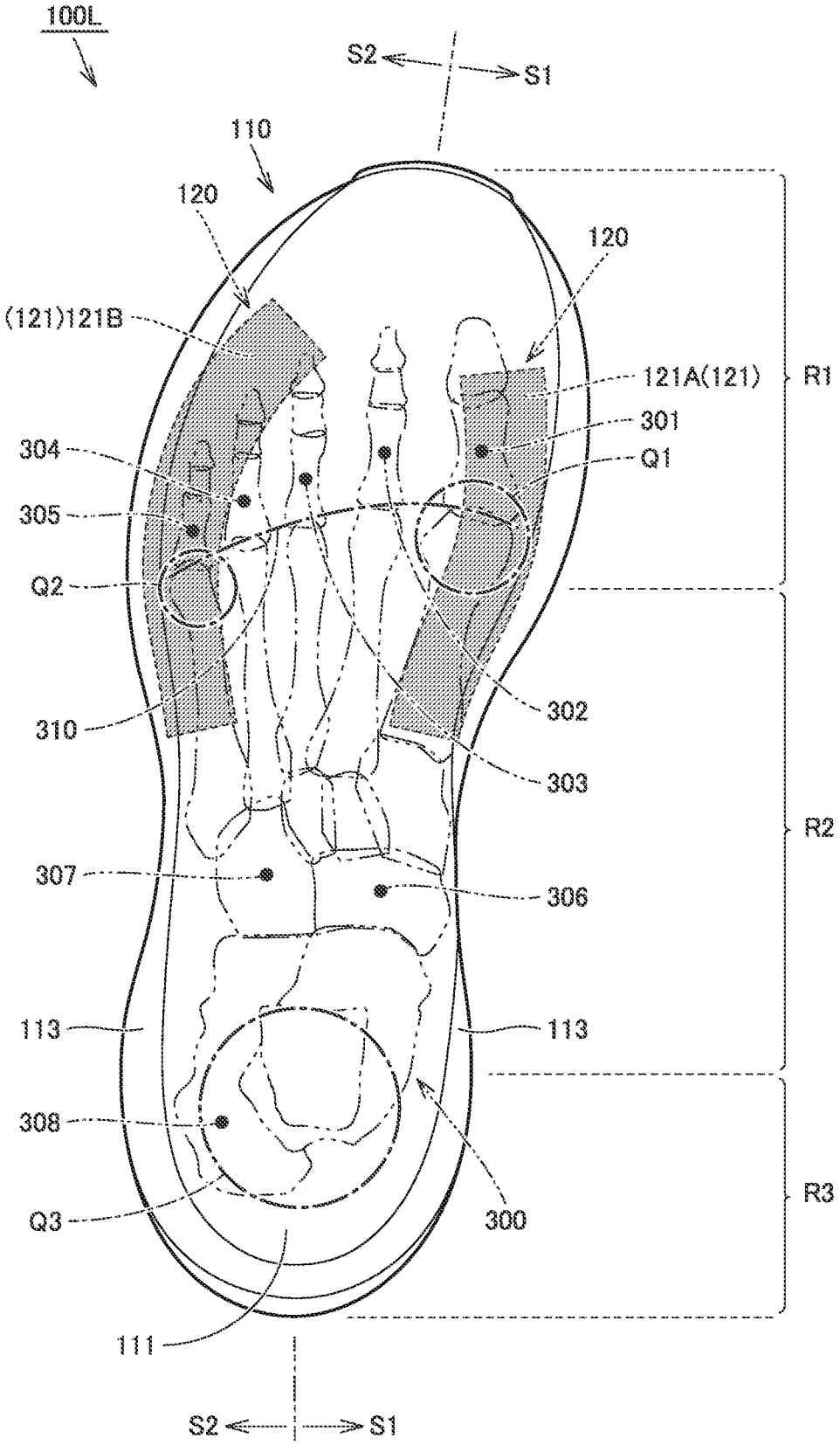
FIG. 40 is a schematic plan view of a shoe sole according to a twelfth embodiment.

FIG. 40 is a schematic plan view of a shoe sole according to a twelfth embodiment. The following describes a shoe sole 100L according to the present embodiment with reference to FIG. 40. The shoe sole 100L according to the present embodiment is provided in the shoe 1 in place of the shoe sole 100A according to the above-described first embodiment.

As shown in FIG. 40, when comparing the shoe sole 100L according to the present embodiment with the shoe sole 100A according to the above-described first embodiment, the shape of the highly rigid member 120 is the main difference therebetween. Specifically, in the shoe sole 100L, the highly rigid member 120 includes only a medial foot side curved plate portion 121A and a lateral foot side curved plate portion 121B as a curved plate portion 121 but does not include a connecting plate portion 122 (see FIG. 2 and the like), unlike the above-described first embodiment.

In other words, in the present embodiment, the highly rigid member 120 may be formed of two members including: a single member forming the medial foot side curved plate portion 121A and a single member forming the lateral foot side curved plate portion 121B. These two members are embedded in the midsole 110. In FIG. 40, the curved plate portion 121 formed of these two members is colored in dark gray for the sake of easy understanding.

As in the above-described first embodiment, each of the medial foot side curved plate portion 121A and the lateral foot side curved plate portion 121B as these two members has an inverted arch shaped portion that protrudes toward a ground contact surface 131 of the shoe sole 100L in a cross section taken along a line orthogonal to the direction in which these two curved plate portions extend. Although not explicitly shown in the figure, the medial foot side curved plate portion 121A and the lateral foot side curved plate portion 121B each have a curved shape such that both ends thereof in the front-rear direction are located close to an upper 200 and a central portion thereof in the front-rear direction is located close to the ground contact surface 131, as in the first embodiment.

Also in such a configuration, the shoe sole 100L includes the highly rigid member 120 provided with the curved plate portion 121 having an inverted arch-shaped cross section, thereby allowing improvement both in the propulsive force at the time of kicking the ground and in the stability at foot landing as in the above-described first embodiment. In addition, in the case of the shoe sole 100L and the shoe 1 including the shoe sole 100L according to the present embodiment, the connecting plate portion 122 (see FIG. 2 and the like) is not provided as described above, thereby allowing significant weight reduction.

Thirteenth Embodiment

Figure 41:
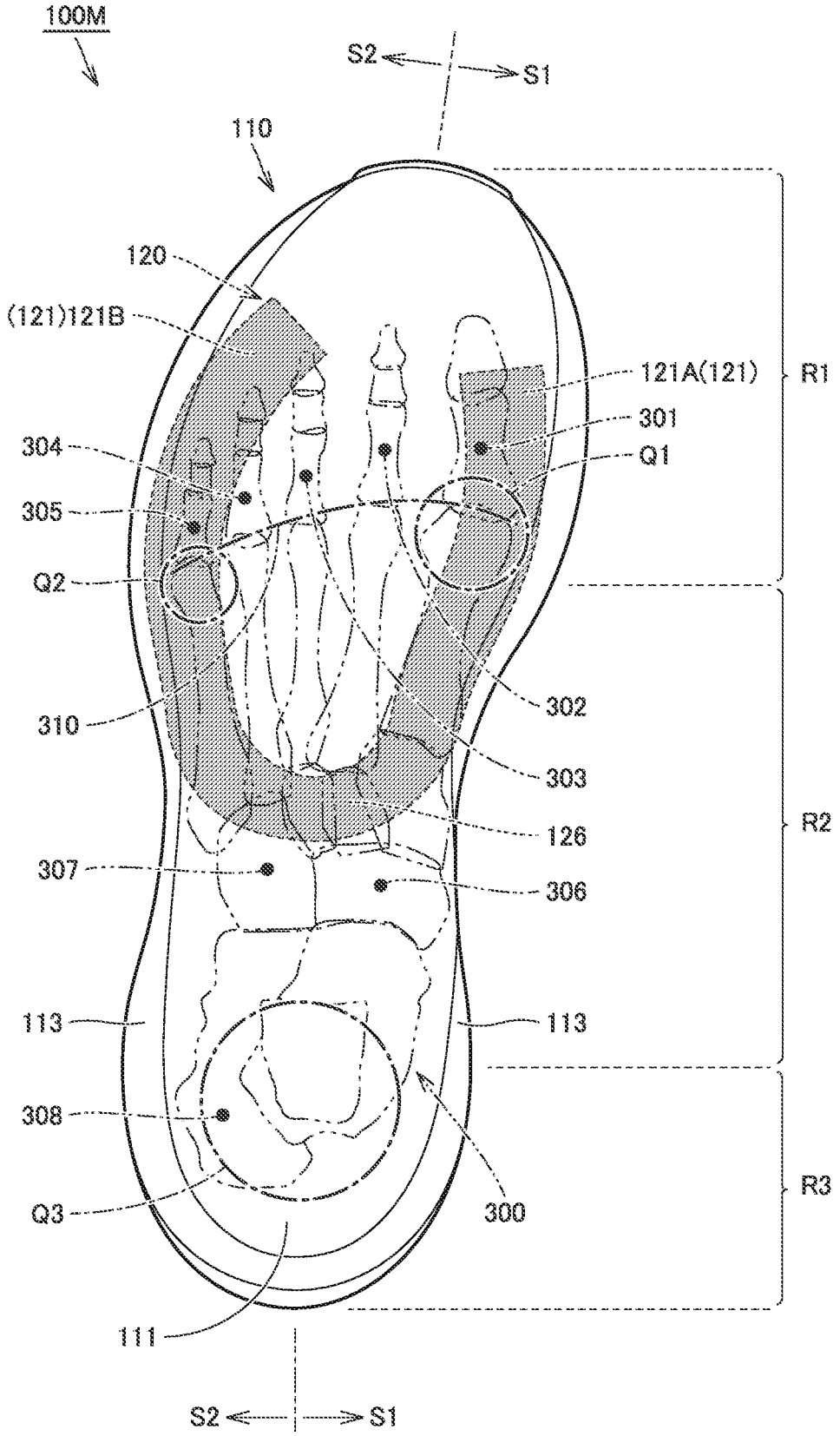
FIG. 41 is a schematic plan view of a shoe sole according to a thirteenth embodiment.

FIG. 41 is a schematic plan view of a shoe sole according to a thirteenth embodiment. The following describes a shoe sole 100M according to the present embodiment with reference to FIG. 41. The shoe sole 100M according to the present embodiment is provided in the shoe 1 in place of the shoe sole 100A according to the above-described first embodiment.

As shown in FIG. 41, when comparing the shoe sole 100M according to the present embodiment with the shoe sole 100A according to the above-described first embodiment, the shape of the highly rigid member 120 is the main difference therebetween. Specifically, in the shoe sole 100M, the highly rigid member 120 has: a medial foot side curved plate portion 121A and a lateral foot side curved plate portion 121B as a curved plate portion 121; and a connecting curved plate portion 126.

Among these plate portions, the connecting curved plate portion 126 connects the medial foot side curved plate portion 121A and the lateral foot side curved plate portion 121B in place of the connecting plate portion 122 in the shoe sole 100A according to the above-described first embodiment (see FIG. 2 and the like), and smoothly connects the rear end of the medial foot side curved plate portion 121A and the rear end of the lateral foot side curved plate portion 121B. In FIG. 41, the curved plate portion 121 and also the connecting curved plate portion 126 are colored in dark gray for the sake of easy understanding.

As in the above-described first embodiment, each of the medial foot side curved plate portion 121A and the lateral foot side curved plate portion 121B has an inverted arch shaped portion that protrudes toward a ground contact surface 131 of the shoe sole 100M in a cross section taken along a line orthogonal to the direction in which these curved plate portions extend. Although not explicitly shown in the figure, the medial foot side curved plate portion 121A and the lateral foot side curved plate portion 121B each have a curved shape such that both ends thereof in the front-rear direction are located close to an upper 200 and a central portion thereof in the front-rear direction is located close to the ground contact surface 131, as in the first embodiment.

As in the medial foot side curved plate portion 121A and the lateral foot side curved plate portion 121B, the connecting curved plate portion 126 has an inverted arch shaped portion that protrudes toward the ground contact surface 131 of the shoe sole 100M in a cross section taken along a line orthogonal to the direction in which the connecting curved plate portion 126 extends. However, this extending direction corresponds not to the front-rear direction but substantially to the right-left direction, unlike the medial foot side curved plate portion 121A and the lateral foot side curved plate portion 121B.

Also in such a configuration, the shoe sole 100M includes the highly rigid member 120 provided with the curved plate portion 121 having an inverted arch-shaped cross section, thereby allowing improvement both in the propulsive force at the time of kicking the ground and in the stability at foot landing as in the above-described first embodiment.

Fourteenth Embodiment

Figure 42:
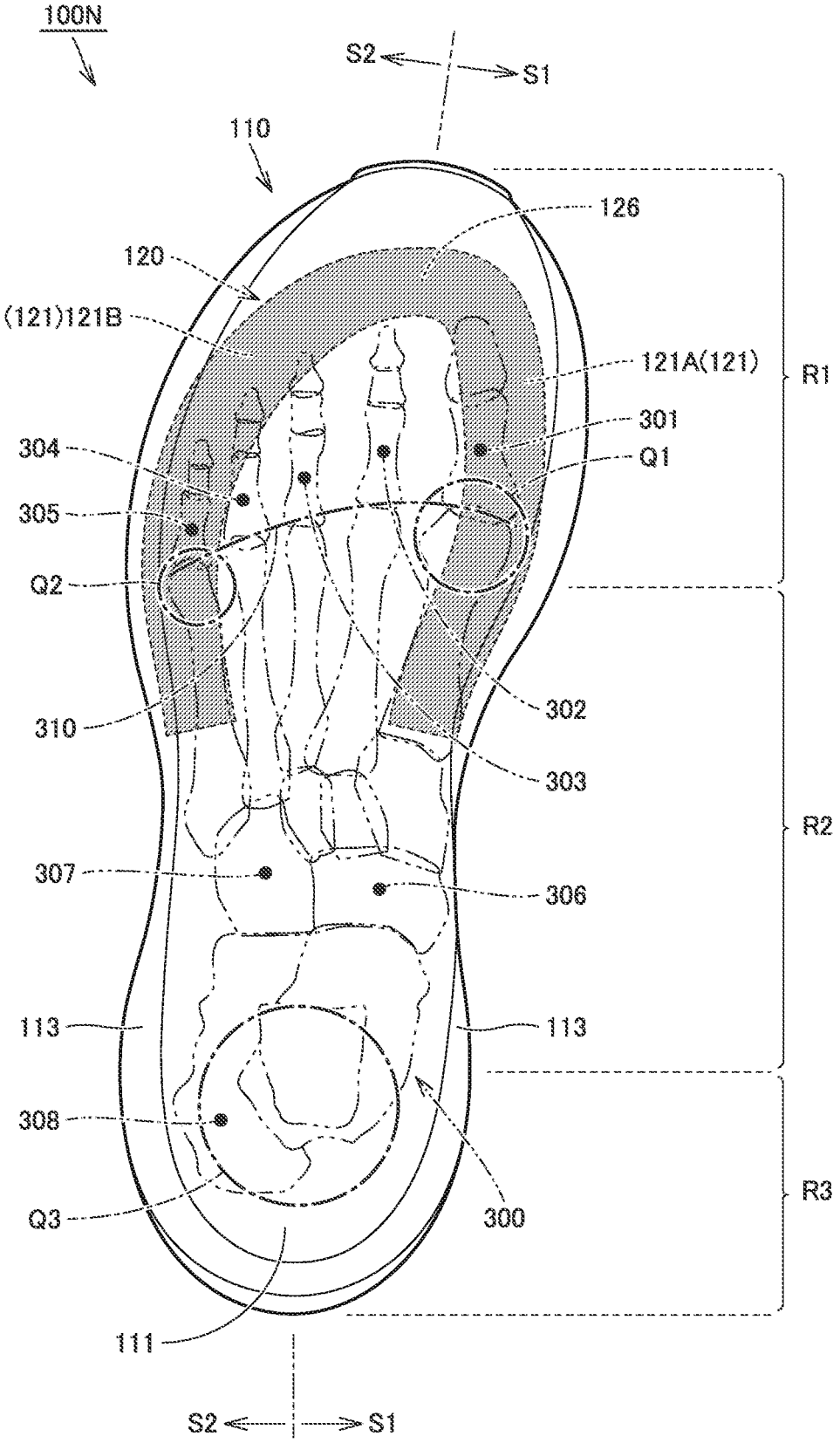
FIG. 42 is a schematic plan view of a shoe sole according to a fourteenth embodiment.

FIG. 42 is a schematic plan view of a shoe sole according to a fourteenth embodiment. The following describes a shoe sole 100N according to the present embodiment with reference to FIG. 42. The shoe sole 100N according to the present embodiment is provided in the shoe 1 in place of the shoe sole 100A according to the above-described first embodiment.

As shown in FIG. 42, when comparing the shoe sole 100N according to the present embodiment with the shoe sole 100A according to the above-described first embodiment, the shape of the highly rigid member 120 is the main difference therebetween. Specifically, in the shoe sole 100N, the highly rigid member 120 has: a medial foot side curved plate portion 121A and a lateral foot side curved plate portion 121B as a curved plate portion 121; and a connecting curved plate portion 126.

Among these plate portions, the connecting curved plate portion 126 connects the medial foot side curved plate portion 121A and the lateral foot side curved plate portion 121B in place of the connecting plate portion 122 in the shoe sole 100A according to the above-described first embodiment (see FIG. 2 and the like), and smoothly connects the front end of the medial foot side curved plate portion 121A and the front end of the lateral foot side curved plate portion 121B. In FIG. 42, the curved plate portion 121 and also this connecting curved plate portion 126 are colored in dark gray for the sake of easy understanding.

As in the above-described first embodiment, each of the medial foot side curved plate portion 121A and the lateral foot side curved plate portion 121B has an inverted arch shaped portion that protrudes toward a ground contact surface 131 of the shoe sole 100N in a cross section taken along a line orthogonal to the direction in which these curved plate portions extend. Although not explicitly shown in the figure, the medial foot side curved plate portion 121A and the lateral foot side curved plate portion 121B each have a curved shape such that both ends thereof in the front-rear direction are located close to an upper 200 and a central portion thereof in the front-rear direction is located close to the ground contact surface 131, as in the first embodiment.

As in the medial foot side curved plate portion 121A and the lateral foot side curved plate portion 121B, the connecting curved plate portion 126 has an inverted arch shaped portion that protrudes toward the ground contact surface 131 of the shoe sole 100N in a cross section taken along a line orthogonal to the direction in which the connecting curved plate portion 126 extends. However, this extending direction corresponds not to the front-rear direction but substantially to the right-left direction, unlike the medial foot side curved plate portion 121A and the lateral foot side curved plate portion 121B.

Also in such a configuration, the shoe sole 100N includes the highly rigid member 120 provided with the curved plate portion 121 having an inverted arch-shaped cross section, thereby allowing improvement both in the propulsive force at the time of kicking the ground and in the stability at foot landing as in the above-described first embodiment.

Fifteenth Embodiment

Figure 43:
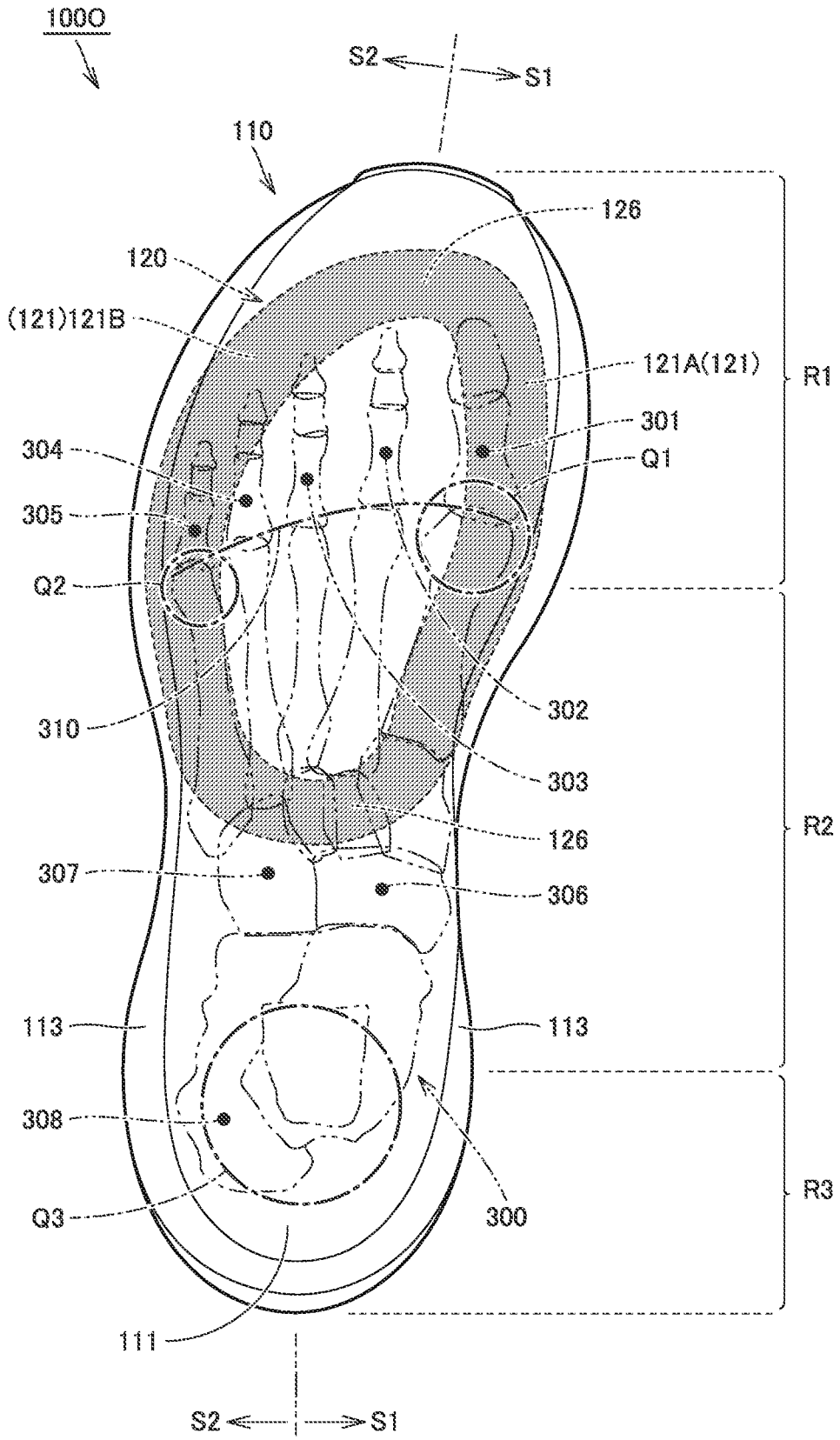
FIG. 43 is a schematic plan view of a shoe sole according to a fifteenth embodiment.

FIG. 43 is a schematic plan view of a shoe sole according to a fifteenth embodiment. The following describes a shoe sole 100O according to the present embodiment with reference to FIG. 43. The show sole 100O according to the present embodiment is provided in the shoe 1 in place of the shoe sole 100A according to the above-described first embodiment.

As shown in FIG. 43, when comparing the shoe sole 100O according to the present embodiment with the shoe sole 100A according to the above-described first embodiment, the shape of the highly rigid member 120 is the main difference therebetween. Specifically, in the shoe sole 100O, the highly rigid member 120 has: a medial foot side curved plate portion 121A and a lateral foot side curved plate portion 121B as a curved plate portion 121; and a pair of connecting curved plate portions 126.

Among these plate portions, the pair of connecting curved plate portions 126 connects the medial foot side curved plate portion 121A and the lateral foot side curved plate portion 121B in place of the connecting plate portion 122 in the shoe sole 100A according to the above-described first embodiment (see FIG. 2 and the like). One connecting curved plate portion 126 of the pair of connecting curved plate portions 126 smoothly connects the front end of the medial foot side curved plate portion 121A and the front end of the lateral foot side curved plate portion 121B. The other connecting curved plate portion 126 of the pair of connecting curved plate portions 126 smoothly connects the rear end of the medial foot side curved plate portion 121A and the rear end of the lateral foot side curved plate portion 121B. In FIG. 43, the curved plate portion 121 and also the pair of connecting curved plate portions 126 are colored in dark gray for the sake of easy understanding.

As in the above-described first embodiment, each of the medial foot side curved plate portion 121A and the lateral foot side curved plate portion 121B has an inverted arch shaped portion that protrudes toward a ground contact surface 131 of the shoe sole 100O in a cross section taken along a line orthogonal to the direction in which these curved plate portions extend. Although not explicitly shown in the figure, the medial foot side curved plate portion 121A and the lateral foot side curved plate portion 121B each have a curved shape such that both ends thereof in the front-rear direction are located close to an upper 200 and a central portion thereof in the front-rear direction is located close to the ground contact surface 131, as in the first embodiment.

As in the medial foot side curved plate portion 121A and the lateral foot side curved plate portion 121B, the pair of connecting curved plate portions 126 each have an inverted arch shaped portion that protrudes toward the ground contact surface 131 of the shoe sole 100M in a cross section taken along a line orthogonal to the direction in which the pair of connecting curved plate portions 126 extend. However, this extending direction corresponds not to the front-rear direction but substantially to the right-left direction, unlike the medial foot side curved plate portion 121A and the lateral foot side curved plate portion 121B.

Also in such a configuration, the shoe sole 100M includes the highly rigid member 120 provided with the curved plate portion 121 having an inverted arch-shaped cross section, thereby allowing improvement both in the propulsive force at the time of kicking the ground and in the stability at foot landing as in the above-described first embodiment.

Summary of Disclosure in Embodiments

The characteristic configurations disclosed in the above-described first to fifteenth embodiments and modifications thereof will be summarized below.

A shoe sole according to an aspect of the present disclosure includes: a forefoot portion that supports a toe portion and a ball portion of a foot of a wearer; a midfoot portion that supports an arch portion of the foot; and a rearfoot portion that supports a heel portion of the foot, in which the forefoot portion, the midfoot portion, and the rearfoot portion are connected in a front-rear direction corresponding to a foot length direction of the foot of the wearer. The shoe sole includes: a sole body located to extend continuously from the forefoot portion to the rearfoot portion; and a highly rigid member fixed to the sole body, the highly rigid member being formed of a material that is higher in rigidity than a material forming the sole body. The highly rigid member includes a curved plate portion extending in a direction crossing a right-left direction that corresponds to a foot width direction of the foot of the wearer. The curved plate portion has an inverted arch shaped portion that protrudes toward a ground contact surface of the shoe sole in a cross section taken along a line orthogonal to a direction in which the curved plate portion extends. At least a part of the curved plate portion is disposed in the forefoot portion.

In the shoe sole according to an aspect of the present disclosure, at least one additional curved plate portion is provided in the highly rigid member, so that a plurality of the curved plate portions are provided. In this case, the highly rigid member may further include a connecting plate portion having a substantially flat plate shape and connecting the curved plate portions to each other.

In the shoe sole according to an aspect of the present disclosure, the curved plate portion may include a medial foot side curved plate portion disposed along a portion of the forefoot portion, the portion of the forefoot portion being located on a medial foot side and including a part for supporting a big toe of the foot of the wearer.

In the shoe sole according to an aspect of the present disclosure, a front end of the medial foot side curved plate portion may be located forward of a portion corresponding to a central portion of a first proximal phalanx extending in the foot length direction of the foot of the wearer, and a rear end of the medial foot side curved plate portion may be located rearward of a portion corresponding to a rear end portion of the first proximal phalanx extending in the foot length direction of the foot of the wearer.

In the shoe sole according to an aspect of the present disclosure, the medial foot side curved plate portion may be disposed to extend from the forefoot portion to the midfoot portion. In this case, the rear end of the medial foot side curved plate portion may be located in a portion corresponding to a navicular bone of the foot of the wearer.

In the shoe sole according to an aspect of the present disclosure, the medial foot side curved plate portion may be disposed to extend from the forefoot portion through the midfoot portion to the rearfoot portion. In this case, the rear end of the medial foot side curved plate portion may be located in a portion corresponding to a heel bone of the foot of the wearer.

In the shoe sole according to an aspect of the present disclosure, the curved plate portion may include a lateral foot side curved plate portion disposed along a portion of the forefoot portion, the portion of the forefoot portion being located on a lateral foot side and including a part for supporting a little toe of the foot of the wearer.

In the shoe sole according to an aspect of the present disclosure, a front end of the lateral foot side curved plate portion may be located forward of a portion corresponding to a central portion of a fifth proximal phalanx extending in the foot length direction of the foot of the wearer, and a rear end of the lateral foot side curved plate portion may be located rearward of a portion corresponding to a rear end portion of the fifth proximal phalanx extending in the foot length direction of the foot of the wearer.

In the shoe sole according to an aspect of the present disclosure, the lateral foot side curved plate portion may be disposed to extend from the forefoot portion to the midfoot portion. In this case, the rear end of the lateral foot side curved plate portion may be located in a portion corresponding to a cuboid bone of the foot of the wearer.

In the shoe sole according to an aspect of the present disclosure, the lateral foot side curved plate portion may be disposed to extend from the forefoot portion through the midfoot portion to the rearfoot portion. In this case, the rear end of the lateral foot side curved plate portion may be located in a portion corresponding to a heel bone of the foot of the wearer.

In the shoe sole according to an aspect of the present disclosure, the curved plate portion may include an intermediate curved plate portion disposed to extend in the front-rear direction at an intermediate position of the forefoot portion in the right-left direction.

In the shoe sole according to an aspect of the present disclosure, a front end of the intermediate curved plate portion may be located forward of a portion corresponding to a central portion of a second proximal phalanx extending in the foot length direction of the foot of the wearer, and a rear end of the intermediate curved plate portion may be located rearward of a portion corresponding to a rear end portion of the second proximal phalanx extending in the foot length direction of the foot of the wearer.

In the shoe sole according to an aspect of the present disclosure, the curved plate portion may include a first diagonally curved plate portion that extends from the forefoot portion to the midfoot portion, the first diagonally curved plate portion being diagonally disposed such that a distance from an edge portion of the shoe sole on a lateral foot side increases from a front side toward a rear side in the front-rear direction.

In the shoe sole according to an aspect of the present disclosure, the curved plate portion may include a second diagonally curved plate portion that extends from the forefoot portion to the midfoot portion, the second diagonally curved plate portion being diagonally disposed such that a distance from an edge portion of the shoe sole on a medial foot side increases from a front side toward a rear side in the front-rear direction.

In the shoe sole according to an aspect of the present disclosure, the sole body may include a midsole located to extend continuously from the forefoot portion to the rearfoot portion. In this case, the highly rigid member may be embedded in the midsole.

In the shoe sole according to an aspect of the present disclosure, the sole body may include a midsole located to extend continuously from the forefoot portion to the rearfoot portion. In this case, the highly rigid member may be provided on an upper surface or a lower surface of the midsole.

In the shoe sole according to an aspect of the present disclosure, the sole body may include a midsole located to extend continuously from the forefoot portion to the rearfoot portion. In this case, by placing at least a part of the highly rigid member to be embedded in the midsole, the highly rigid member may be located such that a distance from an upper surface of the midsole increases from a front side toward a rear side in the front-rear direction.

In the shoe sole according to an aspect of the present disclosure, the curved plate portion may be provided with a through hole that passes through the curved plate portion in a thickness direction of the curved plate portion.

In the shoe sole according to an aspect of the present disclosure, at least one of an upper surface and a lower surface of the curved plate portion may be provided with a recess.

A shoe according to an aspect of the present disclosure includes: the shoe sole according to an aspect of the above-described present disclosure; and an upper provided above the shoe sole.

Other Configurations

Specific shapes, configurations, numbers, positions, and the like of the respective portions disclosed in the above-described first to fifteenth embodiments and modifications thereof can be modified as appropriate.

For example, the second embodiment has been described with reference to an example in which the medial foot side curved plate portion, the lateral foot side curved plate portion, and the intermediate curved plate portion are connected to each other through the connecting plate portion, but these three curved plate portions may be provided separately from each other without providing the connecting plate portion. Alternatively, any two of the medial foot side curved plate portion, the lateral foot side curved plate portion, and the intermediate curved plate portion may be connected through the connecting plate portion, and the remaining one may be provided separately from these two connected curved plate portions. In other words, the connecting plate portion may be partially or entirely omitted.

The sixth embodiment has been described with reference to an example in which the rear end of the medial foot side curved plate portion and the rear end of the first diagonally curved plate portion are connected to each other, but these two curved plate portions may be provided separately from each other. In this case, these two curved plate portions may be stacked on top of the other at a distance from each other in the thickness direction of the shoe sole such that the rear ends of the two curved plate portions overlap with each other in a plan view.

Further, the seventh embodiment has been described with reference to an example in which the front end of the medial foot side curved plate portion and the front end of the second diagonally curved plate portion are connected to each other, but these two curved plate portions may be provided separately from each other. In this case, these two curved plate portions may be stacked on top of the other at a distance from each other in the thickness direction of the shoe sole such that the front ends of these two curved plate portions overlap with each other in a plan view.

Further, the above-described first to fifteenth embodiments and modifications thereof have been described with reference to an example of a shoe configured such that a shoelace is used to bring an upper body into close contact with a foot. In this case, the shoe may be configured such that the upper body is brought into close contact with a foot by a hook-and-loop fastener, or may be configured to have an upper body formed in a sock shape such that the upper body is brought into close contact with a foot only by inserting the foot into the upper body. In other words, the shape of the upper may be modified as appropriate depending on the intended use of shoes.

In addition, the characteristic configurations disclosed in the above-described first to fifteenth embodiments and modifications thereof can be combined with each other without departing from the gist of the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A shoe sole including a forefoot portion configured to support a toe portion and a ball portion of a foot of a wearer, a midfoot portion configured to support an arch portion of the foot, and a rearfoot portion configured to support a heel portion of the foot;

the forefoot portion, the midfoot portion, and the rearfoot portion being connected in a front-rear direction corresponding to a foot length direction of the foot of the wearer, the shoe sole comprising:

a sole body located to extend continuously from the forefoot portion to the rearfoot portion, the sole body including a medial foot side and a lateral foot side, the medial foot side including a medial foot side edge, the lateral foot side including a lateral foot side edge, the sole body including a midsole;

a highly rigid member fixed to the midsole, the highly rigid member being formed of a material that is higher in rigidity than a material forming the midsole;

the highly rigid member including, in the forefoot portion, a first inverted arch shape in the medial foot side that protrudes toward a ground contact surface of the shoe sole in a cross section of the shoe sole taken orthogonal to the front-rear direction, the first inverted arch shape being adjacent to the medial foot side edge, and a second inverted arch shape in the lateral foot side that protrudes toward the ground contact surface of the shoe sole in the cross section of the shoe sole taken orthogonal to the front-rear direction, the second inverted arch shape being adjacent to the lateral foot side edge;

the highly rigid member including, in the forefoot portion, a connecting plate portion, positioned between the first inverted arch shape and the second inverted arch shape, the connecting plate portion including a flat plate shape in the cross section of the shoe sole taken orthogonal to the front-rear direction; and the midsole including a first midsole portion positioned above the connecting plate portion, and a second midsole portion positioned below the connecting plate portion, the connecting plate portion sandwiched between and in contact with the first midsole portion and the second midsole portion at a position halfway between the medial foot side edge and the lateral foot side edge along the cross section of the shoe sole taken orthogonal to the front-rear direction in the forefoot portion.

2. The shoe sole according to claim 1, wherein the first inverted arch shape is configured to support a big toe of the wearer, and the second inverted arch shape is configured to support a little toe of the wearer.

3. The shoe sole according to claim 1, wherein the connecting plate portion extends from the first inverted arch shape to the second inverted arch shape, and wherein the connecting plate portion is in contact with the first midsole portion and the second midsole portion at the first inverted arch shape and at the second inverted arch shape along the cross section of the shoe sole taken orthogonal to the front-rear direction in the forefoot portion.

4. The shoe sole according to claim 1, wherein the highly rigid member includes a third inverted arch shape positioned between the first inverted arch shape and the second inverted arch shape.

5. The shoe sole according to claim 1, the midsole positioned to extend from the forefoot portion to the rearfoot portion, wherein the highly rigid member is entirely embedded in the midsole.

6. The shoe sole according to claim 1, wherein, in the forefoot portion, the first inverted arch shape includes a plurality of through holes extending from a top surface to a bottom surface thereof.

7. The shoe sole according to claim 1, wherein, in the forefoot portion, at least one of an upper surface and a lower surface of the first inverted arch shape includes a plurality of recesses.

8. A shoe comprising the shoe sole according to claim 1, further comprising an upper coupled to the shoe sole, and an outsole coupled to the second midsole portion directly below the position halfway between the medial foot side edge and the lateral foot side edge along the cross section of the shoe sole taken orthogonal to the front-rear direction in the forefoot portion.

9. A shoe sole including a forefoot portion configured to support a toe portion and a ball portion of a foot of a wearer, a midfoot portion configured to support an arch portion of the foot, and a rearfoot portion configured to support a heel portion of the foot;

the forefoot portion, the midfoot portion, and the rearfoot portion being connected in a front-rear direction corresponding to a foot length direction of the foot of the wearer, the shoe sole comprising:

a sole body located to extend continuously from the forefoot portion to the rearfoot portion, the sole body including a medial foot side and a lateral foot side, the medial foot side including a medial foot side edge, the lateral foot side including a lateral foot side edge, the sole body including a midsole; and a highly rigid member fixed to the midsole, the highly rigid member being formed of a material that is higher in rigidity than a material forming the midsole;

wherein the highly rigid member includes, in the forefoot portion, in at least one of the medial foot side and the lateral foot side, an inverted arch shape that protrudes toward a ground contact surface of the shoe sole in a cross section of the shoe sole taken orthogonal to the front rear direction; and wherein the highly rigid member, further includes, in the forefoot portion, a connecting plate portion extending from an end of the inverted arch shape, the connecting plate portion including a lower surface facing toward the ground contact surface of the shoe sole, the lower surface in contact with the midsole at a position halfway between the medial foot side edge and the lateral foot side edge along the cross section of the shoe sole taken orthogonal to the front-rear direction in the forefoot portion.

10. The shoe sole according to claim 9, wherein the connecting plate portion including a flat plate shape in the cross section taken orthogonal to the front-rear direction.

11. The shoe sole according to claim 9, wherein:

the inverted arch shape is a first inverted arch shape located in the medial foot side;

the highly rigid member further includes a second inverted arch shape located in the lateral foot side; and the second inverted arch shape protrudes toward the ground contact surface of the shoe sole in the cross section taken orthogonal to the front-rear direction in the forefoot portion.

12. The shoe sole according to claim 11, wherein the connecting plate portion is positioned between the first inverted arch shape and the second inverted arch shape, the connecting plate portion including a flat plate shape in the cross section taken orthogonal to the front-rear direction in the forefoot portion.

13. The shoe sole according to claim 12, wherein the connecting plate portion extends from the end of the first inverted arch shape second end to the second inverted arch shape.

14. The shoe sole according to claim 11, wherein the first inverted arch shape is configured to support a big toe of the wearer, and the second inverted arch shape is configured to support a little toe of the wearer.

15. The shoe sole according to claim 9, the midsole positioned to extend from the forefoot portion to the rearfoot portion, wherein the highly rigid member is entirely embedded in the midsole.

16. The shoe sole according to claim 9, wherein, in the forefoot portion, the inverted arch shape includes a configuration selected from a plurality of through holes extending from a top surface to a bottom surface of the inverted arch shape, and a plurality of recesses in at least one of an upper surface and a lower surface of the inverted arch shape.

17. A shoe comprising the shoe sole according to claim 9, further comprising an upper coupled to the shoe sole, and an outsole coupled to the midsole directly below the position halfway between the medial foot side edge and the lateral foot side edge along the cross section of the shoe sole taken orthogonal to the front-rear direction in the forefoot portion.

18. A shoe sole including a forefoot portion configured to support a toe portion and a ball portion of a foot of a wearer, a midfoot portion configured to support an arch portion of the foot, and a rearfoot portion configured to support a heel portion of the foot;

the forefoot portion, the midfoot portion, and the rearfoot portion being connected in a front-rear direction corresponding to a foot length direction of the foot of the wearer, the shoe sole comprising:

a sole body located to extend continuously from the forefoot portion to the rearfoot portion, the sole body including a medial foot side and a lateral foot side, the medial foot side including a medial foot side edge, the lateral foot side including a lateral foot side edge, the sole body including a midsole;

a highly rigid member fixed to the midsole, the highly rigid member being formed of a material that is higher in rigidity than a material forming the midsole;

the highly rigid member including, in the forefoot portion, in the medial foot side, a first inverted arch shape that protrudes toward a ground contact surface of the shoe sole in a cross section of the shoe sole taken orthogonal to the front-rear direction;

the highly rigid member including, in the forefoot portion, in the lateral foot side, a second inverted arch shape that protrudes toward the ground contact surface of the shoe sole in the cross section of the shoe sole taken orthogonal to the front-rear direction;

the highly rigid member including, in the forefoot portion, a connecting plate portion positioned between the first inverted arch shape and the second inverted arch shape, the connecting plate portion extending from the first inverted arch shape to the second inverted arch shape, the connecting plate portion including a flat plate shape in the cross section of the shoe sole taken orthogonal to the front-rear direction; and the midsole including a first midsole portion positioned above and in contact with the connecting plate portion, and a second midsole portion positioned below and in contact with the connecting plate portion, at a position halfway between the medial foot side edge and the lateral foot side edge along the cross section of the shoe sole taken orthogonal to the front-rear direction in the forefoot portion.

19. A shoe comprising the shoe sole according to claim 18, further comprising an upper coupled to the shoe sole, and an outsole coupled to the second midsole portion.

* * * * *